US006499643B1

(12) United States Patent
Hewitt

(10) Patent No.: US 6,499,643 B1
(45) Date of Patent: Dec. 31, 2002

(54) DRIVE CHANNEL FOR NAILER

(75) Inventor: Charles W. Hewitt, Warwick, RI (US)

(73) Assignee: Stanley Fastenening Systems, L.P., East Greenwich, RI (US)

( * ) Notice: Subject to any disclaimer, the term of this patent is extended or adjusted under 35 U.S.C. 154(b) by 27 days.

(21) Appl. No.: 09/635,779

(22) Filed: Aug. 11, 2000

Related U.S. Application Data

(63) Continuation-in-part of application No. 09/398,456, filed on Sep. 17, 1999.

(60) Provisional application No. 60/204,803, filed on May 16, 2000, provisional application No. 60/120,892, filed on Feb. 19, 1999, and provisional application No. 60/101,038, filed on Sep. 18, 1998.

(51) Int. Cl.[7] ..... B25C 1/04

(52) U.S. Cl. ..... 227/131; 227/130; 227/131; 227/136; 173/201

(58) Field of Search ..... 227/119, 136, 227/131, 130, 123, 137, 120; 173/201

(56) References Cited

U.S. PATENT DOCUMENTS

| | | | | |
|---|---|---|---|---|
| 3,203,610 A | | 8/1965 | Farrell | |
| 3,260,437 A | * | 7/1966 | Parr | 227/119 |
| 3,299,967 A | * | 1/1967 | Cabot et al. | 173/201 |
| 3,366,302 A | * | 1/1968 | Blicharski | 227/131 |
| 3,554,246 A | * | 1/1971 | Halstead | 227/136 |
| 3,936,407 A | | 2/1976 | Parkinson | |
| 4,253,598 A | * | 3/1981 | Haytayan | 227/119 |
| 4,433,782 A | | 2/1984 | Figge et al. | |
| 4,671,443 A | | 6/1987 | Becht | |
| 4,741,467 A | | 5/1988 | Glassner et al. | |
| 5,452,835 A | * | 9/1995 | Shkolnikov | 227/119 |
| 5,579,975 A | * | 12/1996 | Moorman | 227/136 |
| 5,810,239 A | * | 9/1998 | Stich | 227/123 |

FOREIGN PATENT DOCUMENTS

| | | |
|---|---|---|
| EP | 0 644 020 | 3/1995 |
| EP | 0 739 690 | 10/1996 |
| FR | 1 062 838 | 12/1953 |
| GB | 1 587 082 | 3/1981 |
| WO | WO 99/30873 | 6/1999 |
| WO | WO 00/16947 | 3/2000 |

* cited by examiner

*Primary Examiner*—Scott A. Smith
(74) *Attorney, Agent, or Firm*—Pillsbury Winthrop LLP

(57) ABSTRACT

A fastening device for driving a fastener into a workpiece by effecting multiple blows upon the fastener comprises a housing and a striker assembly movably mounted within the housing. The striker assembly includes a driver assembly adapted to strike the fastener to be driven into the workpiece. A nose assembly is movably mounted on the housing and has a fastener drive track along which the driver assembly and the fastener travel when the fastener is driven into the workpiece. The fastening device has a feed mechanism operatively connected to the nose assembly for mechanically advancing the fastener into the fastener drive track. The fastener drive track has a guide surface adjacent the aperture of the nose assembly to direct the fastener as it is driven into the workpiece. A releasable fastener assembly releasably secures the nose assembly to the housing of the fastening device. A control assembly controls the operation of the fastening device to conserve energy. A coil of collated roofing nails is adapted for use with the fastening device. Each of the nails of the coil of collated roofing nails is coated with a thermoplastic material that serves as a lubricant which facilitates driving of the nails.

19 Claims, 44 Drawing Sheets

DRIVE CHANNEL FOR NAILER

CROSS-REFERENCE TO RELATED APPLICATIONS

This application is a continuation-in-part of U.S. application Ser. No. 09/398,456, entitled "Multi-stroke Fastening Device" filed Sep. 17, 1999, pending and claims benefit of provisional applications No. 60/101,038 filed Sep. 18, 1998, and No. 60/120,892 filed Feb. 19, 1999. This application also relates to U.S. Provisional Application No. 60/204,803, entitled "Fastener Driving System and Magazine Assembly Therefor" filed May 16, 2000. The contents of these applications are hereby incorporated by reference in full.

FIELD OF THE INVENTION

The present invention relates to automatic fastening devices and, in particular, a fastening device that drives a fastener into a workpiece by effecting multiple blows upon the fastener. More specifically, the invention relates to a fastening device having a feed assembly operatively connected to a nose assembly for mechanically advancing the fastener into a fastener drive channel. Furthermore, the invention relates to a fastening device wherein a fastener drive channel has a guide surface adjacent the aperture of the nose assembly to direct the fastener as it is driven into the workpiece. The invention also relates to a fastening device having a releasable fastener assembly for releasably securing the nose assembly to the housing of the fastening device. The invention also relates to a fastening device having a control assembly for controlling the operation of the fastening device to conserve energy. Finally, the present invention relates to a coil of collated roofing nails wherein each of the nails is coated with a thermoplastic material that serves as a lubricant which facilitates driving of the nails. The coil of collated roofing nails is adapted for use with the fastening device.

BACKGROUND OF THE INVENTION

The most typical type of nailing or fastening device used to drive a fastener into a workpiece is that of the "single stroke" type. In these types of devices, a driver assembly is driven to fasten a fastener into a workpiece with a single blow or impact. A disadvantage of these devices is that they require very high levels of impact energy, especially when longer fastener lengths are used.

There have been some attempts to provide a "multi-stroke" fastening device, which employs a striker assembly, which is driven to provide a plurality of blows or impacts upon the fastener head for progressively fastening the fastener into a workpiece. Such devices have been proposed by U.S. Pat. Nos. 1,767,485; 2,796,608; 3,203,610; 4,183,453; 4,724,992; and 4,807,793. The disadvantage with these proposed devices is that the fastener striker assembly is driven through a plurality of driving strokes, the lengths of the strokes are progressively increased as the fastener is progressively driven into the workpiece. As a result, the timing for driving the striker assembly becomes more difficult to manage. In addition, because the stroke length of the striker assembly increases during the course of each fastening cycle, the "feel" of the tool is somewhat irregular. Therefore, there is a need for a multi-stroke fastening device having a uniform stroke length.

Prior art fastening devices that drive a fastener into a workpiece with a single blow need not be concerned with the fastener driver maintaining a coupled relation with respect to the fastener being driven. Multi-blow fastening devices, on the other hand are presented with a unique problem in that if a plurality of fastening impacts are to be imparted upon a single fastener to drive the fastener into the workpiece, the tool tends to bounce off the fastener head with each drive stroke. This may lead to an inefficient and rather clumsy operation of the tool.

Typical multiple blow fastening devices are pneumatically operated, therefore there has been little concern to conserve power. A battery operated fastening device is a lot more mobile and requires less equipment and assembly to operate than pneumatically operated devices. Therefore, there is a need for a fastening device that is battery operated and is constructed and arranged to conserve power during a fastening operation.

Power fastening devices for driving nails into a workpiece come in a variety of types. The fasteners used in such fastening devices vary according to the application. Most fasteners are made from a steel material. It is known in the art that the diameter of the fastener shank has a bearing on the strength of the connection provided. Basically, the greater the shank diameter, the greater the securing function provided.

For certain applications, such as in, pneumatically operated framing nailers, it has been known that the framing nails can be coated with a thermoplastic material that partially liquifies while the nails are being driven and then acts as an adhesive when the thermoplastic again solidifies after the nails are driven into the workpiece.

The adhesive nature of the thermoplastic is advantageous for certain applications because it increases the strength of the connection without requiring enlargement of the metal shank diameter. An ancillary benefit to providing the thermoplastic coating is that it reduces the energy required to drive the nail into the workpiece.

A disadvantage of providing a thermoplastic coating onto fastening nails is that it significantly increases the cost of manufacture in comparison with the same nails that are not so coated.

Roofing nails, which typically have a shank diameter of about 0.120"±0.0015" and a head diameter of about 0.350"–0.438", are typically used to fastener shingles onto a roof. Heretofore, roofing nails have not been coated because the shank and head dimensions are sufficiently large to provide a relatively strong connection, particularly in light of the typically relatively soft shingle material that often tears before the nails would be pulled out. The cost of coating roofing nails has been considered to far outweigh any benefit to be gained.

Through experimentation with the unique fastening device described herein, applicants have recognized that in the particular application of a battery operated roofing fastener assembly, conservation of energy (i.e., battery life) is critical. Therefore, although roofing nails provide a more than adequate securement of shingles without the need for coating the same, and although thermoplastic coating significantly adds to the cost of manufacture, applicants have determined that the amount of increase in battery life results from providing coated roofing nails warrants the added cost for this particular application.

In order to remove jams and repair fastening devices, it is necessary to remove the nose assembly of the fastener assembly. Typically, the nose assembly is fastened to the housing and requires tools to disassemble, thus increasing downtime. Therefore, there is a need for a fastening device which facilitates quick and easy removal of the nose assembly to remove jams, thus reducing downtime.

Because the fasteners of fastening devices are typically collated by a flexible collation material, the leading fastener tends to pivot about the collation material, as the fastener is driven into the workpiece, until the collation fractures. Substantial movement can disorient the fastener in the drive track. This may cause the fastener to be deformed and/or driven into the workpiece incorrectly. Therefore, there is a need to adjust the orientation of the fastener while the fastener is being driven into the workpiece.

SUMMARY OF THE INVENTION

It is an object of the present invention to provide a multi-stroke fastening device for driving fasteners into a workpiece. This multi-stroke fastening device provides a housing, a fastener drive track carried by the housing, a striker assembly guide track mounted within the housing, a striker assembly mounted in slidable relation within said guide track, a power drive assembly, and a feed mechanism. The striker assembly includes a driver member constructed and arranged to strike a fastener disposed in the fastener drive track. The striker assembly is constructed and arranged to be moved along the guide track through a plurality of alternating drive strokes and return strokes to effect a plurality of impacts of the driver member upon the fastener in order to drive the fastener into the workpiece. The striker assembly has a substantially constant drive stroke length relative to the guide track. The power drive assembly is constructed and arranged to drive the striker assembly to effect the plurality of impacts of the driver member upon the fastener, and the feed mechanism is constructed and arranged to feed successive fasteners into the drive track to be struck by the striker assembly.

It is also an object of the invention to provide a multi-stroke fastening device which includes a striker assembly having a drive stroke length which does not progressively increase as the fastener is progressively driven into the workpiece.

It is a further object of the present invention to provide a multi-stroke fastening device for driving fasteners into a workpiece, comprising a housing, a striker assembly guide track mounted within the housing, and a striker assembly mounted in slidable relation with respect to the guide track. The striker assembly includes a driver member constructed and arranged to strike a fastener to be driven into a workpiece. The striker assembly is moveable along the guide track through a plurality of alternating drive strokes and return strokes to effect a plurality of impacts of the driver member upon the fastener. Each drive stroke has substantially the same length. A power drive assembly is constructed and arranged to drive the striker assembly through the plurality of alternating drive strokes and return strokes to effect the plurality of impacts of the driver member upon the fastener. A nose assembly is carried by the housing and defines a fastener drive track along which the driver travels during the drive strokes and return strokes. Furthermore, a fastener head engaging structure is constructed and arranged to engage a portion of the head of the fastener to be driven at least during the return stroke. A resilient structure is operatively coupled to the fastener head engaging structure. The resilient structure is constructed and arranged to permit limited longitudinal movement of the fastener head engaging structure relative to the striker assembly guide track, and dampens impact of engagement between the fastener head engaging structure and the head of the fastener to be driven.

It is a further object of one embodiment of the present invention to provide a multi-stroke fastening device that employs a fastener impacting driver assembly that is coupled to the driving structure so that impacts of the driver assembly are very effectively damped to reduce vibrations and shock in the system. In accordance with this object, the present invention provides a multi-stroke fastening device for driving fasteners into a workpiece, comprising a housing. The nose assembly is carried by the housing and defines a drive track. A mechanical fastener feed mechanism includes a fastener feed pawl that moves successive fasteners into the drive track. A cylinder guide track is mounted within the housing, the cylinder guide track having a forward end and a rearward end. A driver assembly is disposed in slidably sealed relation with the cylinder guide track, the driver assembly being movable forwardly through the cylinder drive track during a fastener impacting drive stroke thereof and movable rearwardly through the cylinder guide track during a return stroke thereof. The driver assembly includes a driver member movable through the drive track during alternating drive strokes and return strokes to impart a plurality of impacts upon a fastener to be driven into the workpiece so as to drive the fastener into the workpiece. A piston is disposed in slidably sealed relation with the cylinder guide track, the piston being rearwardly spaced from the driver assembly, with an air space disposed between the piston and driver assembly. A motor is operatively connected with the piston and constructed and arranged to drive the piston forwardly and rearwardly through the cylinder guide track to effect the alternating drive strokes and return strokes. Movement of the piston forwardly through the cylinder guide track compresses air within the air space so as to force the driver assembly forwardly through the cylinder guide track to effect the fastener impacting drive stroke so that the driver member impacts the fastener to be driven.

It is a further object of the present invention to provide a fastening device that employs a manually operated feed assembly so that energy may be conserved. In accordance with this object, the present invention provides a fastening device for driving a fastener into a workpiece comprising a housing and a striker assembly movably mounted within the housing. The striker assembly includes a driver assembly adapted to strike the fastener to be driven into the workpiece. A nose assembly is operatively connected to the housing. The nose assembly has a fastener drive channel along which the driver assembly and the fastener travel when the fastener is driven into the workpiece. A mechanical feed assembly is operatively connected to the nose assembly for advancing a fastener into the fastener drive channel at a predetermined time. The feed assembly advances the fastener into the fastener drive channel in response to an application of a mechanical force on the nose assembly.

The present invention is directed to a fastening device for driving a fastener into a workpiece having a housing, and a striker assembly movably mounted within the housing. The fastening device also includes a magazine constructed and arranged to carry a coil of collated fasteners. In accordance with the present invention, the nose assembly includes a feed assembly constructed and arranged to advance a lead fastener within the coil of collated fasteners in response to manually generated movement of the nose assembly into the housing during a fastener driving operation. The nose assembly also includes a spring that biases the nose assembly outwardly from the housing. The spring is compressed in response to the manually generated movement of the nose assembly into the housing.

It is a further object of the present invention to provide a fastening device having an energy control assembly to control the operation of the device so that energy may be conserved. In accordance with this object, the present invention provides a fastening device for driving a fastener into a workpiece comprising a housing and a striker assembly movably mounted within the housing. The device includes an energy control assembly for controlling the operation of the fastening device. The energy control assembly controls the operation of the fastener device in order to conserve power and extend battery life.

The energy control assembly may include an actuator that terminates operation of the fastening device when actuated. The actuator is actuated in response to the nose assembly being moved a selected distance inwardly with respect to the housing. The energy control assembly further includes an adjuster assembly constructed and arranged to adjust the position of the actuator and hence adjust the selected distance which the nose assembly must move in order to actuate the actuator and thereby terminate operation of the fastening device.

It is a further object of the present invention to provide a fastening device having a nose releasing assembly to facilitate the removal of the nose assembly. In accordance with this object, the present invention provides a fastening device for driving at least one fastener into a workpiece comprising a housing and a striker assembly movably mounted within the housing. A nose assembly is releasably secured to the housing and has a fastener drive track along which the driver assembly and the at least one fastener travel when the at least one fastener is driven into the workpiece. The device includes a nose releasing assembly for releasably securing the nose assembly to the housing. The releasable fastener assembly permits easy removal of the nose assembly from the fastening device in the event of a fastener jam.

The present invention is also directed to fastening device for driving a fastener into a workpiece having a housing, a striker assembly movably mounted within the housing, a nose assembly releasably secured to the housing, and a manually operable nose releasing assembly constructed and arranged to releasably secure the nose assembly to the housing. The releasing assembly including a manually engageable release member being manually movable from a latched position to a released position.

It is a further object of the present invention to provide a fastening device that includes at least one guide surface for adjusting the orientation of the fastener while the fastener is being driven into the workplace. In accordance with this object, the present invention provides a fastening device for driving a fastener into a workpiece comprising a housing and a striker assembly movably mounted within the housing. A nose assembly is releasably secured to the housing and has a fastener drive channel along which the driver assembly and the fastener travel when the fastener is driven into the workpiece. The fastener drive channel terminates at an aperture in one end of the nose assembly through which the fastener passes as the fastener is driven into the workpiece. The fastener drive channel includes at least one guide surface adjacent the aperture to control the movement of the fastener within the guide channel.

The present invention is also directed to a multi-stroke fastening device for driving a fastener within a coil of collated fasteners into a workpiece. The fastening device comprising a housing, a striker assembly movably mounted within the housing, and nose assembly operatively connected to the housing. The nose assembly has a fastener drive channel along which the driver assembly and the fastener travel when the fastener is driven into the workpiece. The fastening device also includes a magazine assembly constructed and arranged to engage at least one fastener within the coil of fasteners in order to move a lead fastener within the coil of fasteners in a first direction toward the fastener drive channel. The lead fastener has a forward pointed end thereof tending to be moved in a second direction opposite the first direction in response to a rearward head end thereof being impacted by the driver assembly due to the interconnection of the collation material between the lead fastener and a subsequent fastener. In accordance with the present invention, the nose assembly includes an angled guide surface constructed and arranged to engage the tip of the lead fastener as it is being driven. The guide surface is angled so as to direct the tip of the lead fastener toward the first direction as the lead fastener is being driven.

In accordance with an embodiment of the present invention, the nose assembly further comprises a pivoted guide structure defining a pivoted guide surface disposed in opposing relation to the angled surface. The pivoted guide structure is biased towards a first position such that pivoted structure is disposed adjacent to the angled guide surface so that the pivoted guide surface and the angled guide surface form a fastener outlet which is dimensioned to be smaller than a head of the fastener. In operation, the head of a fastener engages the pivoted guide surface as the fastener is being driven so as to force the pivoted guide structure away from the angled guide surface against the spring bias to enable the outlet to be sufficiently sized to permit the fastener head to pass therethrough. The angled guide surface and the pivoted guide surface guidably engaging the head as the head passes thereby.

It is a further object of the present invention to provide coated nails to facilitate driving of the nails into the workpiece so that energy may be conserved. In accordance with this object, the present invention provides a coil of collated roofing nails comprising a plurality of collated roofing nails interconnected by a collation material. Each of the nails has a shank portion with a shank diameter of about 0.120"±0.0015" and a head portion with a head diameter of about 0.350" to 0.438". Each of the nails is coated with a thermoplastic material that serves as a lubricant which facilitates driving of the nails into a workpiece so as to reduce the energy required to drive the nails into the workpiece.

These and other objects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The present invention will be described in conjunction with the following drawings in which like reference numerals designate like elements and wherein.

DETAILED DESCRIPTION OF THE INVENTION

Figure 1:
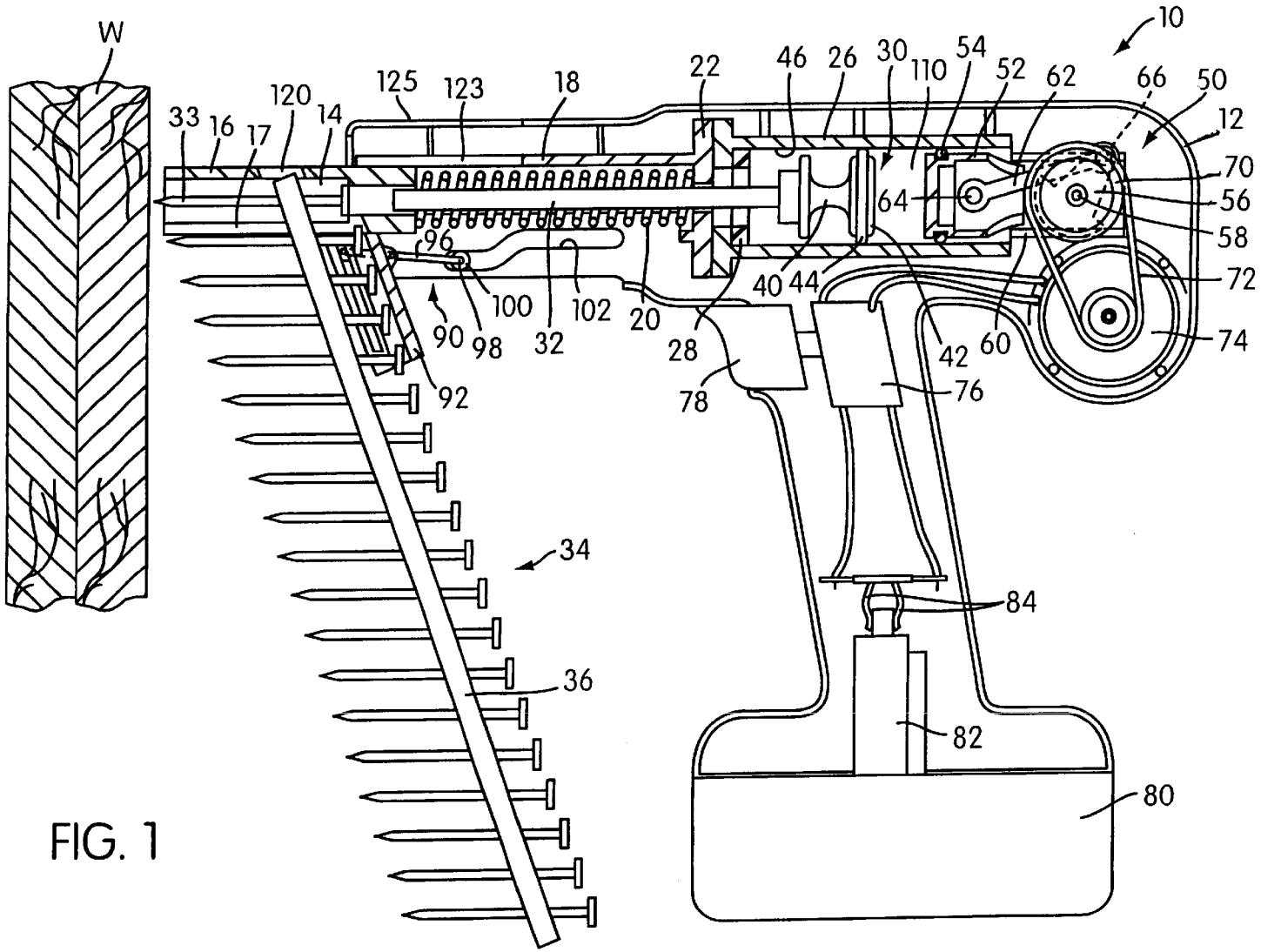
FIG. 1 is a cross-sectional view of a multi-stroke fastening device in accordance with a first embodiment of the present invention illustrating the fastening device at the start of its drive stroke.

FIG. 1 is a cross-sectional view of a multi-stroke fastening device 10 in accordance with the first embodiment of the present invention. FIG. 1 illustrates the device 10 at rest, with a first fastener 33 in the drive track 14.

The fastening device 10 has an outer clam-shell housing 12, preferably made from a rigid plastic material. A fastener drive track 14 is carried by the housing 12. In the particular embodiment shown, the drive track 14 is provided by a movable nose assembly 16, which has a lower longitudinal slot 17 for receiving fasteners to be positioned in the drive track 14. The nose assembly 16 is movable axially into the housing 12 in a direction along the fastener driving axis. More particularly, a nose receiving channel 18 is fixed within the housing 12 towards the forward end of the housing 12. The nose receiving channel 18 is preferably provided with a grooved track that receives projecting flanges integrally formed on opposite sides of the nose assembly 16 so that the channel 18 slidably receives the nose assembly 16, the nose assembly being biased outwardly of the nose receiving channel 18 by a coil spring 20. The coil spring 20 has a rearward end bearing against a mounting plate 22 fixed within the housing 12 and a forward end bearing against the rearward end of the nose assembly 16, thus biasing the nose assembly 16 forwardly towards a forward stop position thereof.

A striker assembly guide track 26 is fixed within the housing 12. In the embodiment shown in FIG. 1, the guide track is a cylindrical, metal tubular member, conventionally termed a "cylinder." It is contemplated, however, that for other arrangements in accordance with the principles of the present invention, the guide track can be any structure which slidingly guides a striker assembly for impact and return strokes. The guide track 26 has an annular resilient bumper 28, preferably made from an elastomeric material such as rubber, disposed towards the forward end of the guide track 26. It is contemplated that other elastomeric materials may be utilized to form the bumper 28.

A striker assembly 30 is mounted in slidable relation within the guide track 26. The striker assembly 30 includes a driver member 32 which is constructed and arranged to strike a fastener 33, which is the leading fastener within a group of collated fasteners 34. The collated fasteners 34 comprise a plurality of fasteners fixed to one another by a substantially rigid collation 36. As shown, the leading fastener 33 is disposed within the drive track 14.

The striker assembly 30 is movable axially along the guide track 26 through a plurality of alternating drive strokes and return strokes to effect a plurality of impacts of the driver member 32 upon the fastener 33 for driving the fastener 33 into a workpiece W. The driver member 32 extends through an opening within the mounting plate 22 and further extends through the center of coil spring 20 and is received at its forward end within an opening in the rearward end of the nose assembly 16 to be received in the drive track 14 for impacting upon the fasteners. The opening in mounting plate 22 and/or opening in the rearward end of nose assembly 16 maintains the driver member in axially aligned relation with the drive track 14 and hence, lead fastener 33.

The striker assembly 30 further comprises a plunger 40 to which the driver is connected. The plunger 40 has a substantially disc-shaped rearward end portion 42 having a peripheral annular groove for receiving a generally annular sealing member 44 disposed in slidable and sealed relation with an interior cylindrical surface 46 of the guide track 26.

As will be described in greater detail later, the striker assembly 30 has a substantially constant drive stroke length relative to its guide track 26. While the drive stroke may vary slightly, for example, as a result of slightly different resistances to the fastener being driven into a particular workpiece at progressive depths of the fastener, it should be appreciated that the drive stroke length does not progressively increase as the fastener 33 is progressively driven into the workpiece W, as is the case with prior art constructions.

A power drive assembly 50 is constructed and arranged to drive the striker assembly 30 to effect a plurality of impacts of the driver member 32 upon fastener 33. Preferably, the power drive assembly includes a piston 52, having a generally cylindrical outer configuration, and an outer periphery having a sealing member 54 disposed in slidable and sealed relation with the inner surface 46 of the guide track 26, in similar fashion to sealing member 44. The power drive assembly 50 further includes a crank member 56 rotatable about an axis 58. More specifically, the crank member 56 is mounted to a crank mounting assembly 60, which is fixed to the guide track 26. An axis pin 58 is attached to the mounting 60 and mounts the crank 56 for rotational movement. A crank arm 62 is pivotally connected at opposite ends thereof, including a first end 64 pivotally connected to the piston 52, and opposite end 66 pivotally connected with the crank 56. Thus, rotation of the crank 56 causes reciprocating motion of the piston 52 within the guide track 26.

The crank 56 includes a pulley 70 disposed on the periphery thereof and is constructed and arranged to receive a drive belt 72. The drive belt is driven by a motor 74, which rotatably drives the crank 56 via the belt 72. Rather than a pulley and belt arrangement, a gear train or other coupling arrangement could be employed.

The motor 74 is switched on and off by a control circuit 76, which includes a trigger switch, which is activated by a manually actuated trigger 78, and preferably also includes a nose switch, which is activated by a contact trip that is engaged when the nose assembly is retracted into the tool housing. The control circuit 76 is connected with a power supply assembly, preferably including a power source in the form of a battery 80, and most preferably, a rechargeable battery. The battery 80 has a battery contact 82, which can be removed from housing contacts 84 to enable the battery 80 to be recharged and/or replaced. It should be appreciated that other power sources may be used for powering the power drive assembly 50. For example, the device may be connected with line voltage, an air pressure supply where the device is pneumatically driven, combustion power, or other suitable power supplies.

A feed mechanism 90 is constructed and arranged to feed successive fasteners within the supply of collated fasteners 34 into the drive track 14 to enable the successive fasteners to be struck by the striker assembly 30. More particularly, the feed mechanism 90 is cooperable with a feed track 92, which is integrally cast with the nose assembly 16. The feed track 92 feeds the collated fasteners 34 into the drive track 14 through the longitudinal slot 17 in the nose assembly 16. The feed mechanism 90 includes a movable feed pawl 96. The feed pawl 96 is pivotable about its rearward end portion 98, which is provided with a torsion spring 100 constructed and arranged to biased feed pawl 96 in a clockwise direction (as viewed in FIG. 1) about the rearward end portion 98. The rearward end 98 of the feed pawl 96 rides along a ramped surface 102 as the nose assembly 16 moves relative to the housing 12. The feed pawl 96 further has a more forward portion thereof pivotably connected to the feed track 92 to establish somewhat of a connecting rod type motion for the feed pawl 96 as the nose assembly 16 is moved relative to the housing 12 and the rearward end portion 98 of the feed pawl 96 rides along the ramp surface 102. As a result of this connecting rod type motion, the forward end portion of the feed pawl 96 is able to feed individual fasteners into the drive track 14 as will be appreciated from the more detailed description of the operation of the device 10 to follow.

In FIG. 1, the device 10 is shown at rest prior to a fastening operation. The collated fasteners 34 are manually manipulated up through the feed track 92, so that the first two fasteners are moved beyond the feed pawl 96, which can be manually moved out of the feed track 92 for initial loading purposes. As shown, the first fastener 33 is positioned in the drive track 14. Preferably, with the tool at rest, the forward tip of the first fastener 33 projects slightly forwardly of the fully extended forward end of the nose assembly 16, as shown. This preferred arrangement enables the user to view the tip of the fastener 33 and position the tip at a very precise location. To view the leading fastener 33 even more clearly, it is possible to manually move the nose assembly 16 inwardly into the housing 12 against the bias of coil spring 20 to reveal a greater portion of the fastener 33 for positioning the tip at a precise location.

After the tip of fastener 33 is placed against the workpiece W, the operator depresses trigger 78, thereby closing the trigger switch in circuit 76 to provide power from the battery 80 to the motor 74. The motor 74 drives the belt 72, which in turn causes rotation of the crank 56. Rotation of the crank 56 causes reciprocal movement of the piston 52 through the connection of the piston 52 with the crank 56 via connecting arm 62. Reciprocal movement of the piston 52 within the guide track 26 causes corresponding reciprocal movement of the striker assembly 30.

More particularly, the power drive assembly 50 is resiliently coupled to the striker assembly 30 via a substantially sealed airspace 110 between the piston 52 and the rearward end portion 42 of plunger 40, as shown in FIG. 1. More specifically, driving piston 52 forwardly towards the plunger 40 tends to reduce the distance between the piston 52 and the plunger 40. Because airspace 110 between piston 52 and plunger 40 is substantially sealed, the airspace 110 will be pressurized during the forward stroke of the piston 52. This pressurization of airspace 110 biases the plunger 40 forwardly, away from the piston 52, so as to maintain the volume of the sealed airspace 110 within a predetermined range. Thus, it can be appreciated that the pressurization of airspace 110 drives the plunger 40, and hence the entire striker assembly 30 forwardly, so that the driver member 32 impacts upon the head of the fastener 33. This action can be seen in FIG. 2. It should be appreciated that the initial impact of the driver member 32 releases the fastener 33 from the collation 36.

Figure 2:
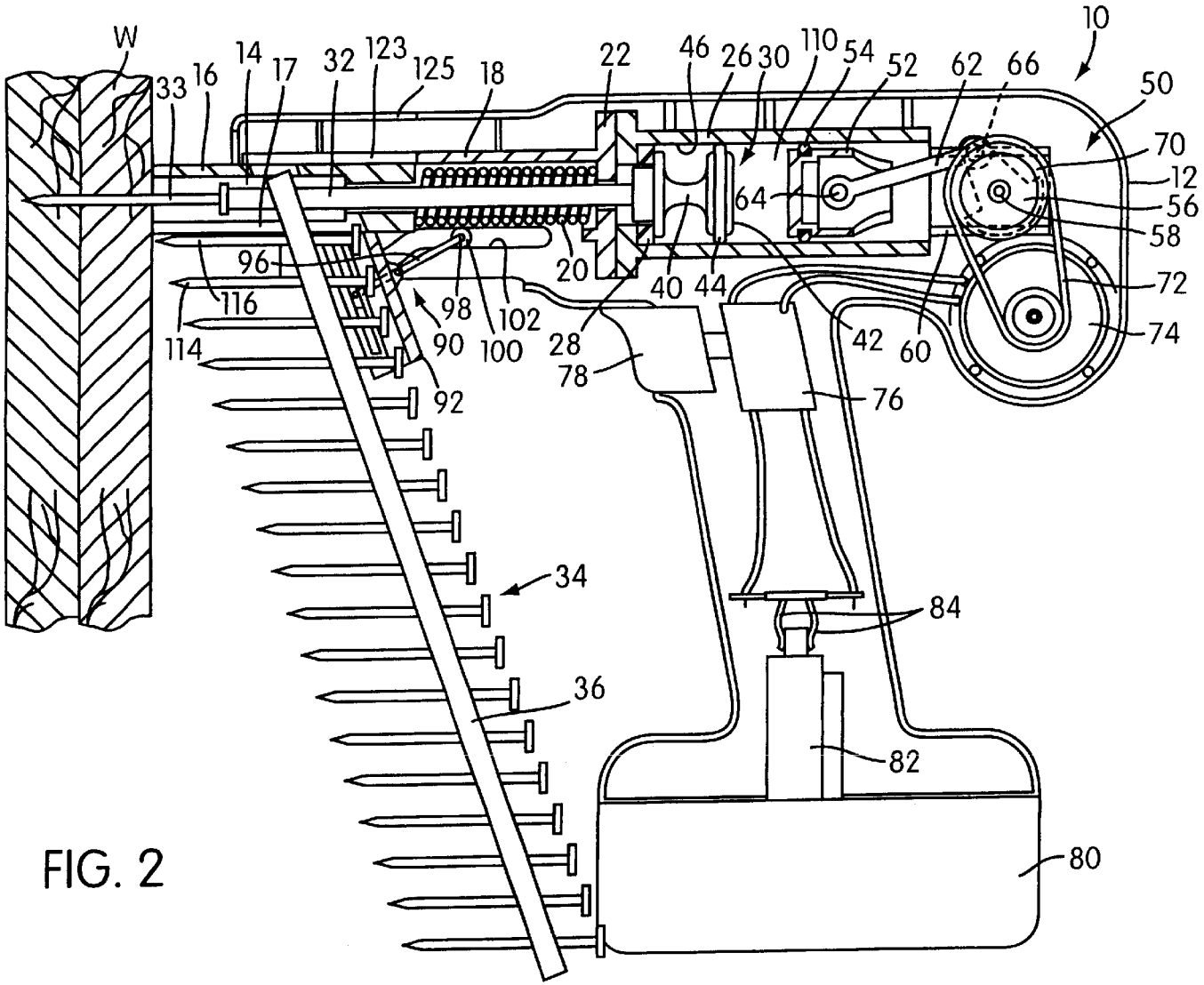
FIG. 2 is a cross-sectional view of the multi-stroke fastening device in accordance with the first embodiment of the present invention illustrating the fastening device midway through its drive stroke.

While in FIG. 2, the fastener 33 is shown having approximately two-thirds of its length driven into the workpiece W, it should be appreciated that this would typically be accomplished only after a plurality of impacts or blows upon the fastener head 33. At the bottom or end of each impact drive stroke, the plunger 40 preferably impacts the resilient bumper 28 at the forward end of the guide track 26. It should be appreciated, however, that for certain individual strokes (e.g., towards the end of a fastening operation where extreme forces may be required to finish driving the last bit of the fastener into the workpiece) and/or certain applications (e.g., for particularly hard workpieces) the resistance of the fastener 33 being driven into the workpiece W may serve to stop the movement of the striker assembly 30 prior to the plunger 40 impacting on the bumper 28. It should be appreciated, however, that it is preferred for the plunger 40 to contact the bumper 28 for every stroke for a more consistent operation of the device. In the instance in which the plunger 40 does not contact the bumper 28, it would terminate its forward stroke movement just short of the bumper 28, with minimal spacing therebetween (e.g., less than 5 mm apart). Hence, it can be appreciated that the total impact drive stroke length is fairly constant for each impact stroke.

After each impact stroke, the striker assembly 30 is drawn rearwardly within the guide track 26 as a result of its being resiliently coupled to the power drive assembly 50. More particularly, as the piston 52 is withdrawn within the guide track 26 by the action of crank 56, a vacuum is created in the substantially sealed airspace 110 so as to draw the plunger 40 rearwardly with the piston 52. This can be appreciated from FIG. 2A, where the plunger 40 is shown being drawn rearwardly relative to an impacting position as shown in FIG. 2.

It should be appreciated that the resilient coupling provided by the airspace 110 substantially cushions the driving impact of the striker assembly 30 upon fastener 33. This reduces vibration of the tool and provides for a quieter operation. In addition, after the striker assembly is pulled back by the vacuum in space 110, and the piston 52 instantaneously reverses direction so as to commence forward movement, a pressure pulse or spike in generated in airspace 110, thus creating high levels of kinetic energy for driving the striker assembly forwardly. The airspace 110 in effect acts as an airspring.

It should also be appreciated that because the vibrations of the tool are reduced, the life of the tool 10 can be increased, and the user experiences less fatigue from use of the tool as a result.

The volume of the airspace 110 remains within a predetermined range during the continuous cycling of the device, such that the piston 52 and plunger 40 remain within a predetermined range of distance therebetween. It can be appreciated that towards the end of an impact stroke, the volume of airspace is somewhat reduced after the piston 52 bottoms out on the bumper 28. The volume of airspace is then somewhat increased when the piston is pulled away from the bumper 28 during the return stroke. Similarly, the volume is decreased towards the end of the return stroke as a result of the momentum in the rearward direction of striker assembly 30 and then the instantaneous reversal of direction of the piston into the forward direction. The volume of the airspace 110 is a function of the mass of striker assembly 30, speed of the striker assembly 30, stroke length of the striker assembly 30, among other things. Preferably, the airspace is connected with an overpressurization and underpressurization bleed valve (not shown). Thus, if at any time pressure within the airspace is above or below threshold levels, air will bleed into or out of the airspace to maintain the pressure therein within a predetermined range.

It is desirable to make the striker assembly 30 sufficiently lightweight so that it follows the travel of the piston 52 for each stroke and does not become out of phase with movement of the power drive assembly 50. It is also desirable for the striker assembly to impart as much of its energy as possible to the fastener to be driven, and experience as little rebound as possible. In such manner, a sufficiently large vacuum can be drawn in airspace 110, so that for each stroke the vacuum serves to pull the striker assembly 30 rearwardly, and in phase with the power drive assembly 50, as opposed to rebound of the striker assembly adding a variable that may cause the striker assembly to be forced out of phase with the power drive assembly.

The power drive assembly 50 and striker assembly 30 continue to cycle as described above until the fastener 33 is eventually driven completely into the workpiece W. It should be appreciated that a plurality of impacts is required to drive the fastener into a typical workpiece W, such as wood. For example, it is contemplated that between about five to fifty impact strokes might be used to drive a fastener into a workpiece, depending on the application. It is also contemplated that the power drive assembly 50 would be capable of driving the striker assembly at a rate of about forty to seventy cycles or impact strokes per second, depending upon the application.

As the fastener 33 is driven into the workpiece W, the nose assembly 16 is progressively retracted into the tool housing 12 against the bias of coil spring 20. This action is largely a result of the forward manual force applied by the operator. When the device 10 is used to fasten a horizontal surface, with the nose assembly 16 pointing downwardly (e.g., wood flooring), the weight of the device 10 also assists in movement of the nose assembly into the housing 12 against the force of coil spring 20.

When the fastener 33 is completely embedded in the workpiece W, the nose assembly 16 reaches a point at which it is fully retracted within the nose receiving channel 18. In a preferred embodiment, when the nose assembly reaches this point, the nose assembly 16 engages a contact trip (not shown) which trips a nose switch (that can be included as part of circuit 76) to shut off motor 74 and terminate cycling of the power drive assembly 50 and striker assembly 30. This feature is described in greater detail in connection with the description of the embodiment of FIG. 15. The device 10 can then be pulled away from the workpiece W. As the device 10 is pulled away from the workpiece W, the nose assembly 16 is permitted to extend outwardly from the nose receiving channel 18 and hence, outwardly from the housing 12 under the force of coil spring 20. As the nose assembly 16 is forced outwardly of the nose receiving channel 18, it releases the nose contact trip that shut down motor 74. In a preferred embodiment, circuit 76 will not enable the motor 74 to be energized again until after the nose switch or nose contact trip is released and after the trigger 78 is released and then subsequently depressed again. Alternately, a second contract trip may be provided, and this second contact trip would be activated once the nose assembly 16 reaches the forwardmost position thereof. Activation of the second contact trip would reactivate the motor 74. In this way, the trigger 78 can remain depressed by the operator, and movement of the nose assembly 16 between its fully extended and fully retracted positions would be the means by which to shut off and restart motor 74 between fastening operations. It is desirable for the motor to shut down between fastening operations in order to conserve the power source 80, especially where that source is in the form of a battery.

Figure 2A:
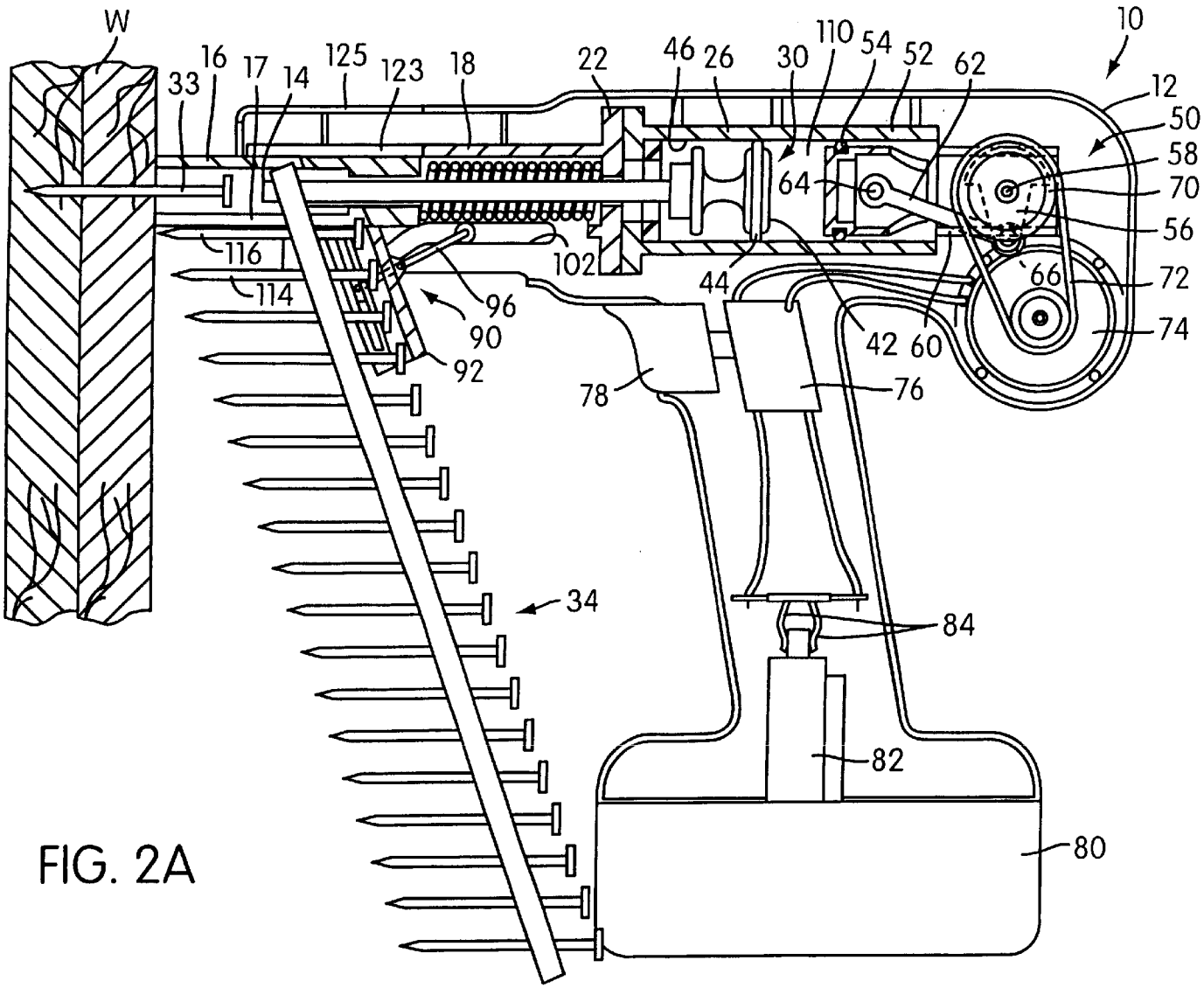
FIG. 2A is a cross-sectional view of the multi-stroke fastening device in accordance with the first embodiment of the present invention illustrating the fastening device during its return stroke.
Figure 3:
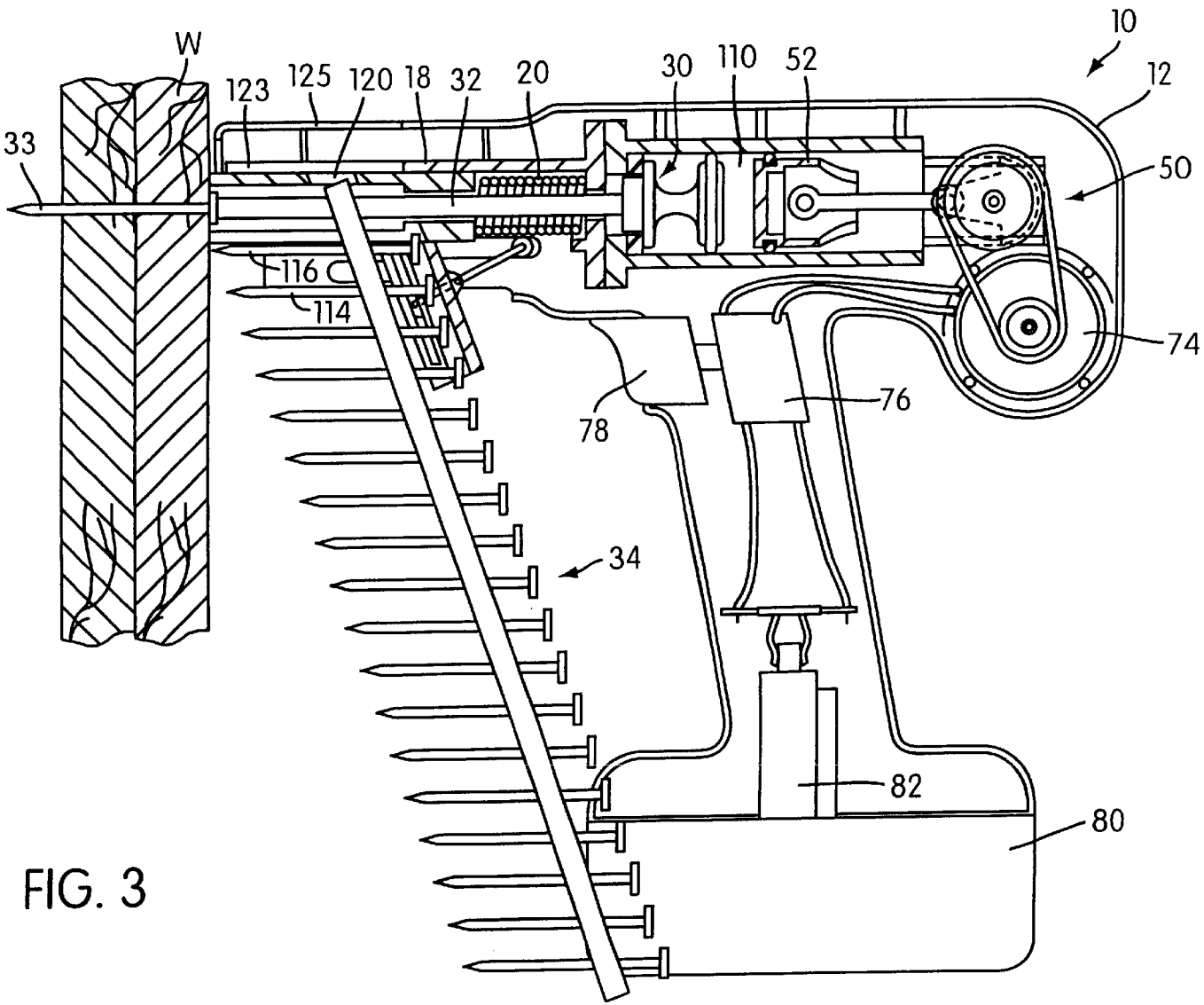
FIG. 3 is a cross-sectional view of the multi-stroke fastening device in accordance with the first embodiment of the present invention illustrating the fastening device as it completes its drive stroke.
Figure 4:
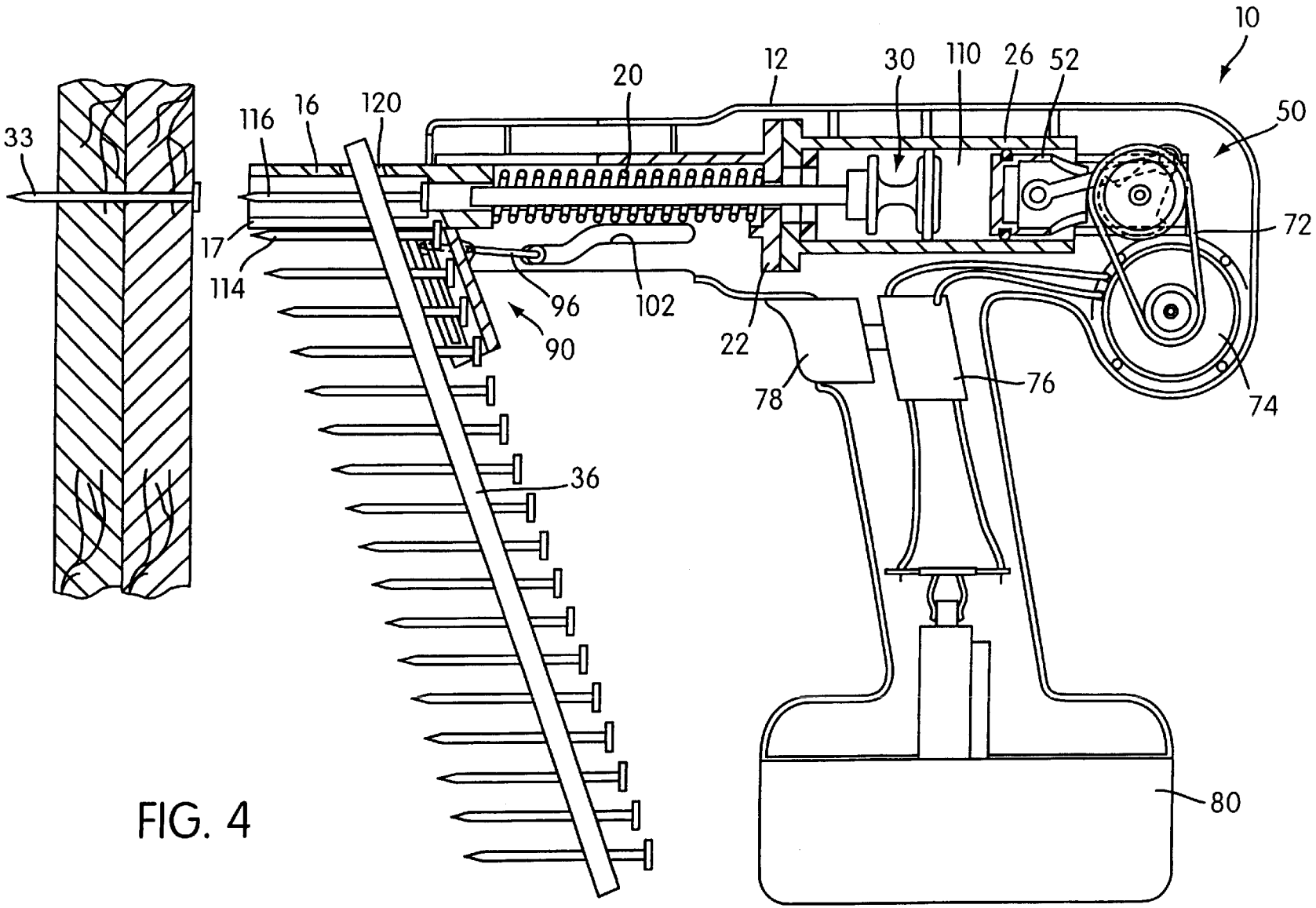
FIG. 4 is a cross-sectional view of the multi-stroke fastening device in accordance with the first embodiment of the present invention illustrating the fastening device in its reset position.
Figure 5:
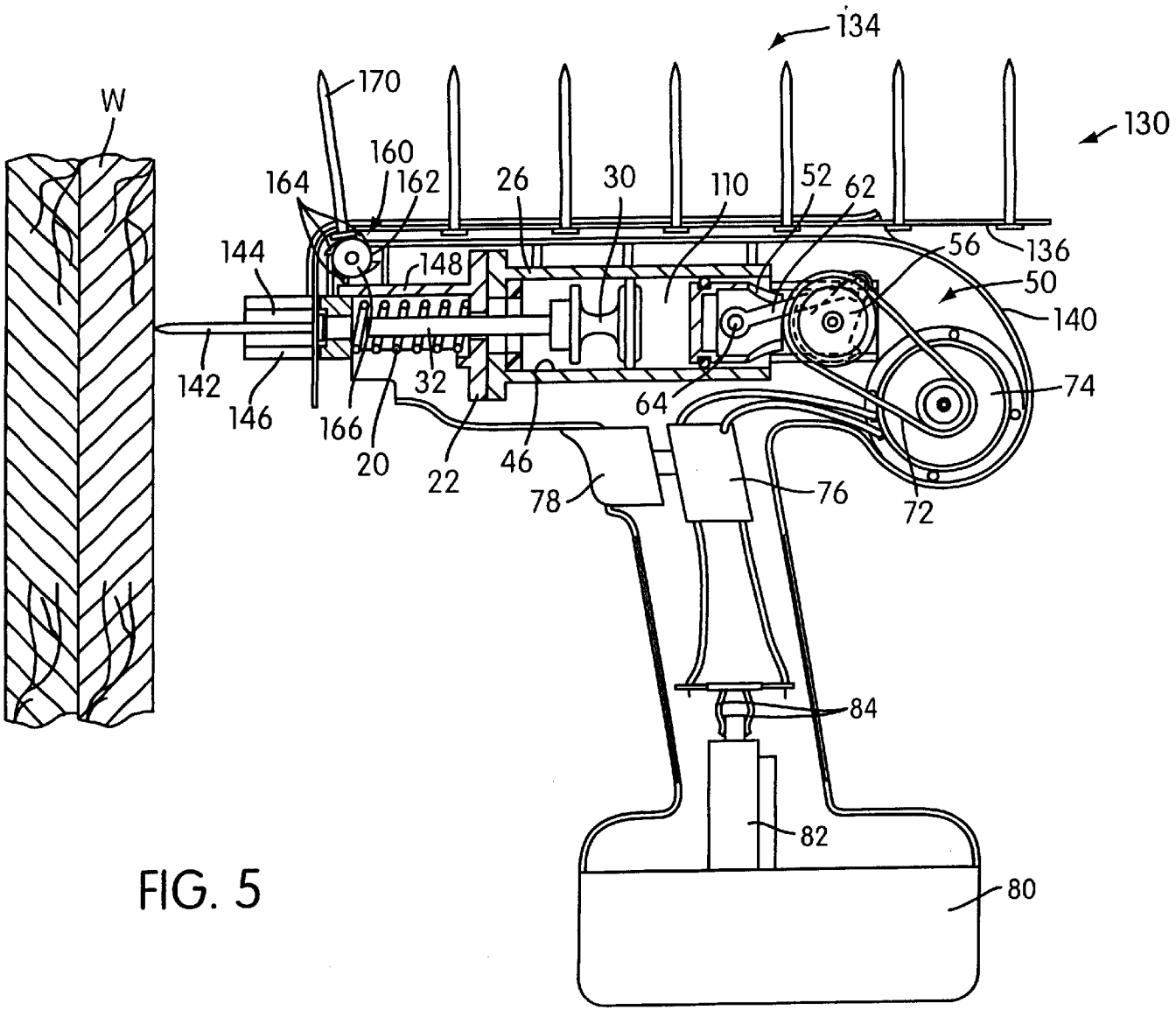
FIG. 5 is a cross-sectional view of the multi-stroke fastening device in accordance with a second embodiment of the present invention illustrating the fastening device at the start of its drive stroke.
Figure 6:
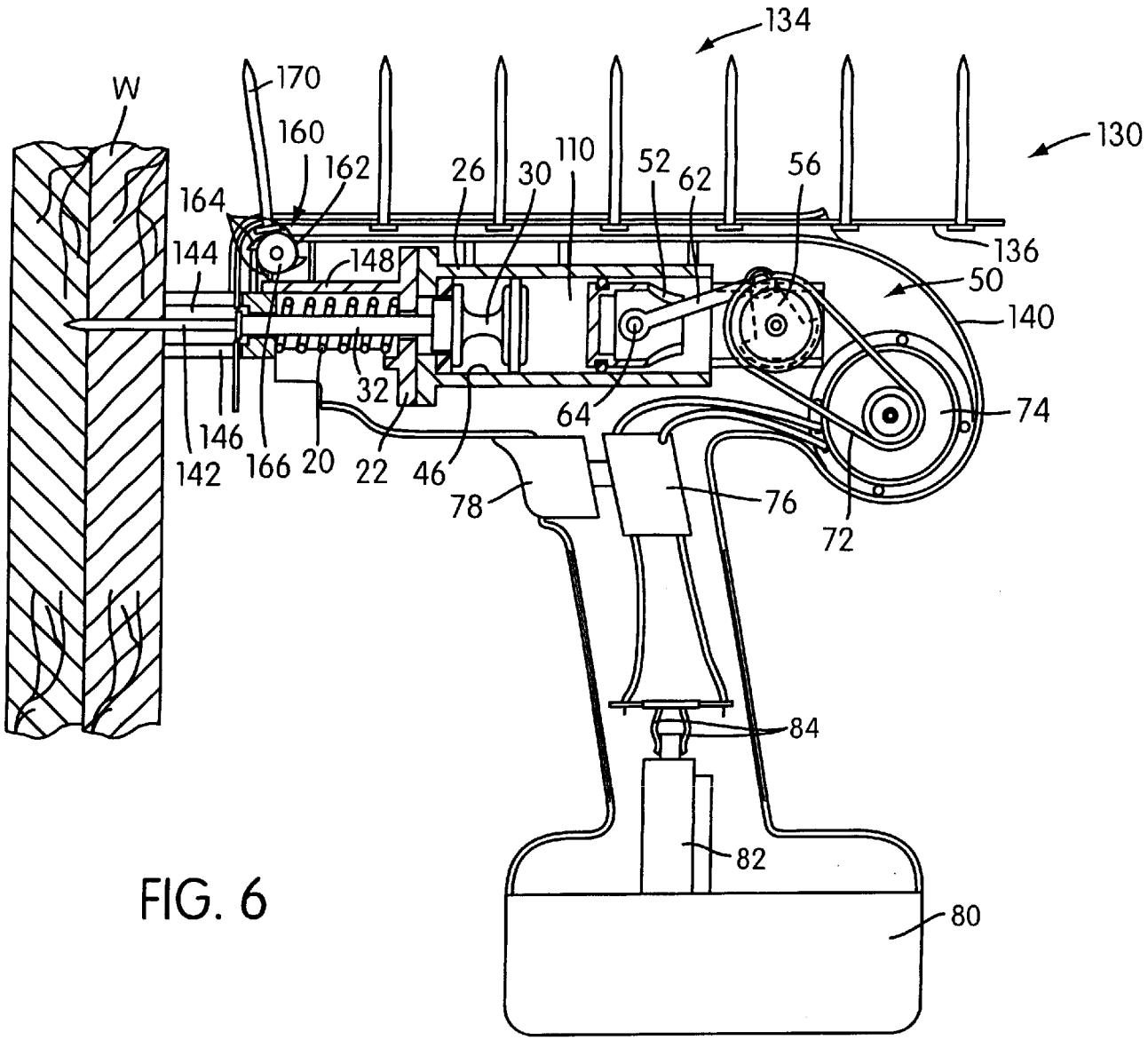
FIG. 6 is a cross-sectional view of the multi-stroke fastening device in accordance with the second embodiment of the present invention illustrating the fastening device mid-way through its drive stroke.
Figure 6A:
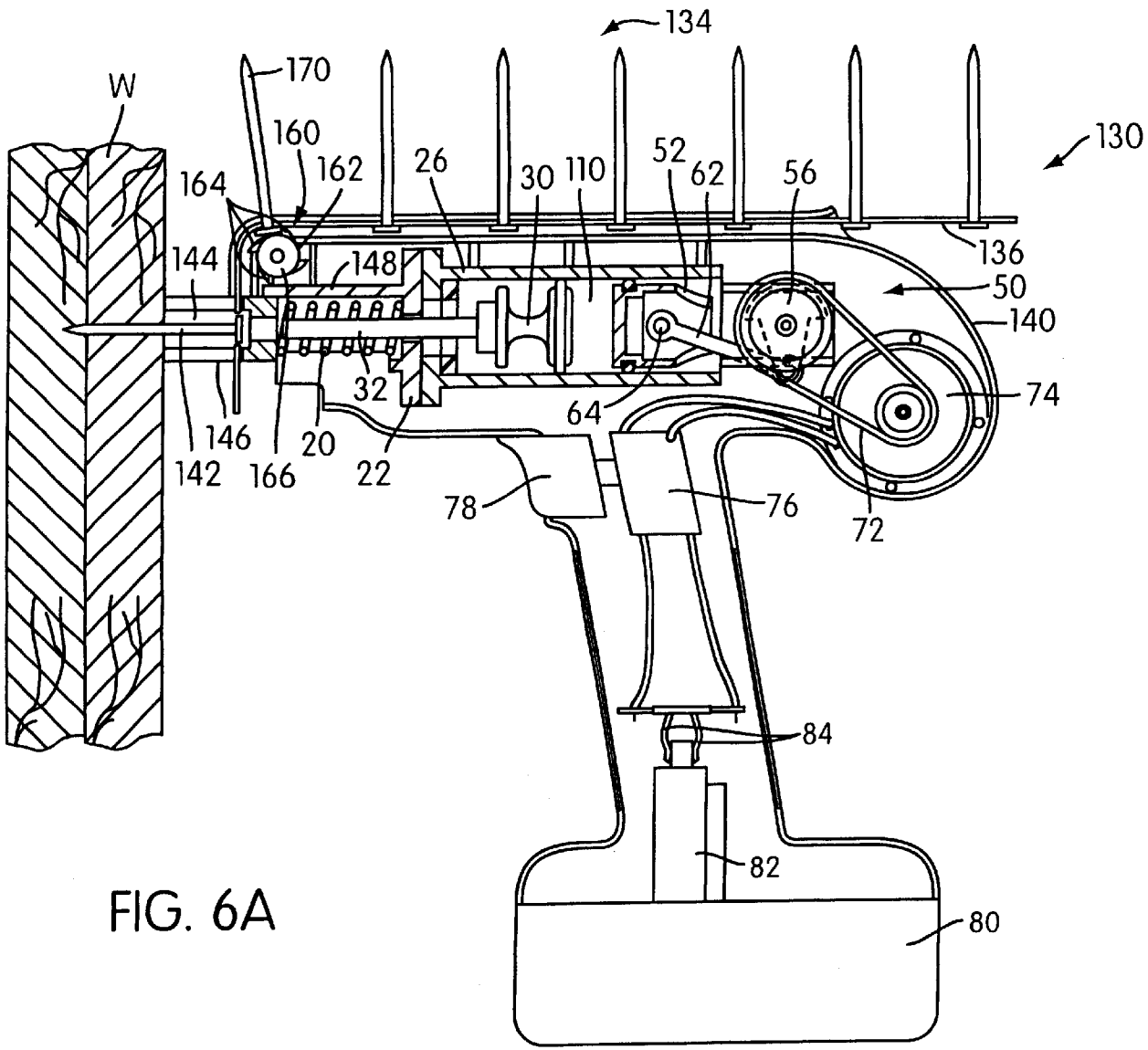
FIG. 6A is a cross-sectional view of the multi-stroke fastening device in accordance with the second embodiment of the present invention illustrating the fastening device during its return stroke.

Shown in the FIGS. 2, 2A, and 3, as the rearward end 98 of the feed pawl 96 rides up the ramp surface 102 as the nose assembly 16 is retracted into the nose receiving channel 18, the pawl 96 becomes positioned behind the third fastener 114. When the rearward end 98 of the feed pawl 96 is permitted to ride back down the ramp surface 102 as the nose assembly 16 is forced outwardly of the nose receiving channel 18 after a fastening operation, the forward end of the feed pawl 96 is fully positioned behind the third fastener 114, and the spring bias of torsion spring 100 acting through pawl 96 on the third fastener 114, moves the entire collation of fasteners 34 upwardly so that the second fastener 116 is moved through the slot 17 in the nose assembly 16 and into the drive track 14. The fastener 116 is now in position to be driven in subsequent fastening operations, as illustrated in FIG. 4.

Opening 120 is disposed in the upper portion of the nose assembly 16 for receiving the used collation 36. Similarly, openings 123 and 125 are provided in the nose receiving channel 18 and the housing 12, respectively, to similarly accommodate the spent collation (not shown). Where the collation 36 is made from a paper material (as opposed to plastic or metal), it may not be necessary to provide for any exit thereof, as it will be substantially disintegrated.

FIGS. 5–8 illustrate a second embodiment of the multi-stroke fastener device in accordance with the principles of the present invention, generally indicated at 130. Operation of the second embodiment is quite similar to that of the first embodiment, and hence, corresponding components are illustrated with the same reference numerals as in the first embodiment. The differences between the first embodiment and this second embodiment will be described with particularity.

Figure 7:
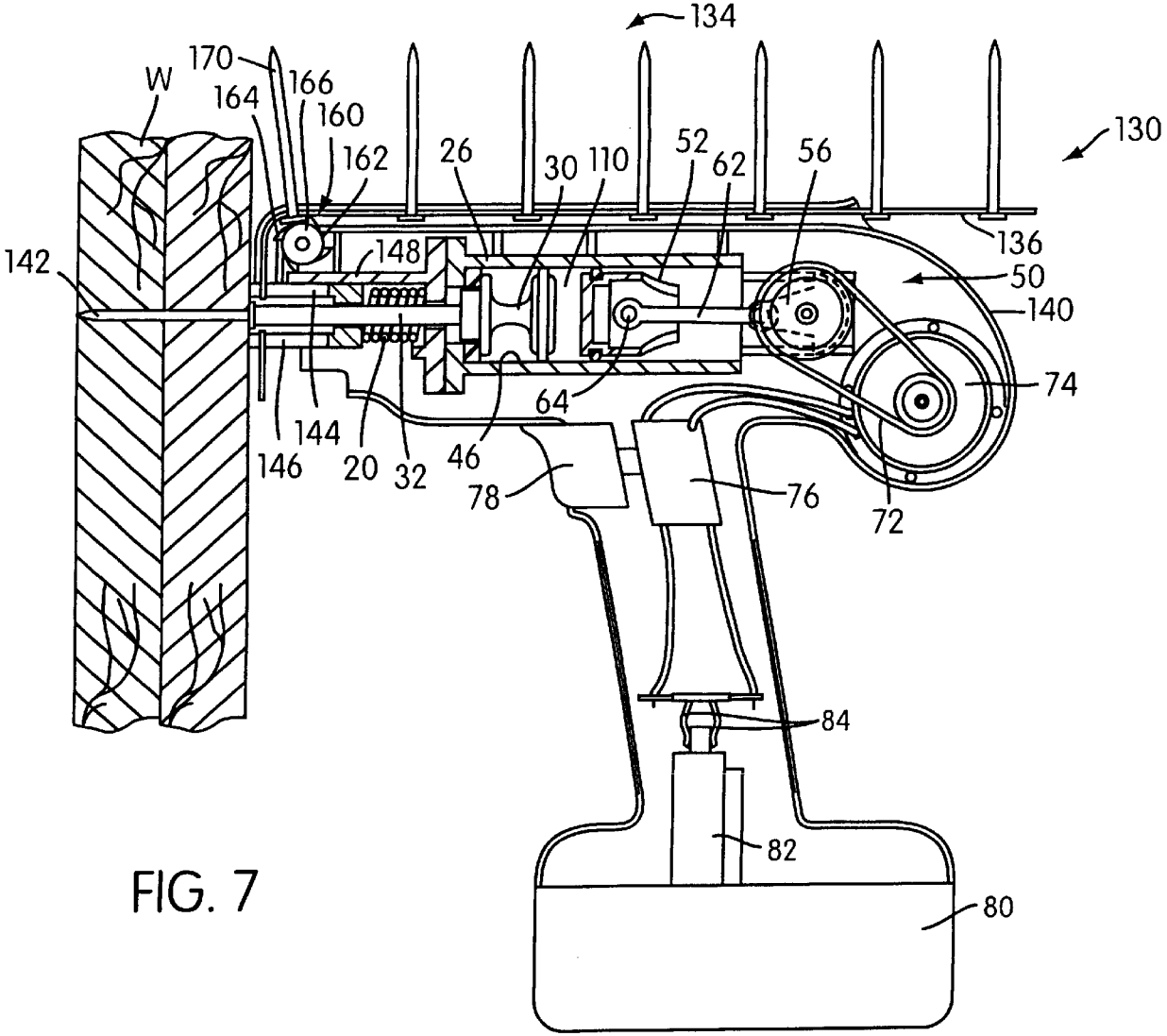
FIG. 7 is a cross-sectional view of the multi-stroke fastening device in accordance with the second embodiment of the present invention illustrating the fastening device as it completes its drive stroke.
Figure 8:
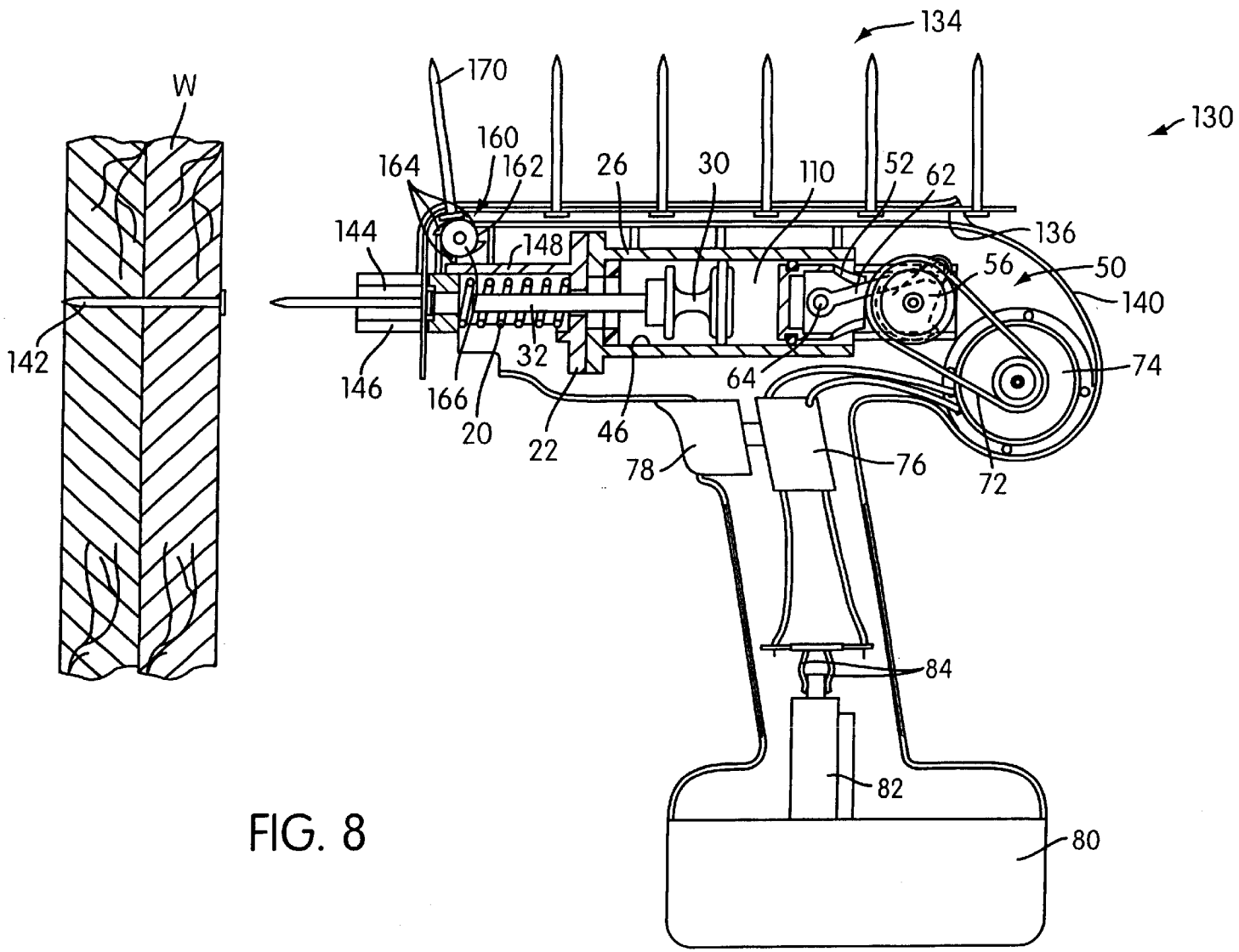
FIG. 8 is a cross-sectional view of the multi-stroke fastening device in accordance with the second embodiment of the present invention illustrating the fastening device in its reset position.

In accordance with the second embodiment of the present invention, the fastening device 130 employs an array of collated fasteners 134, but preferably utilizes a more flexible collation 136 to connect the fasteners to one another. The collation 136 and the heads of the fasteners are manipulated through a longitudinal slot in the top of clam shell housing 140. As shown, a first fastener 142 is disposed in the drive track 144. The fastener 142 is driven essentially in the same fashion as described with respect to fastener 33 in the embodiment of FIGS. 1–4. At the completion of a fastening operation (as illustrated in FIG. 7), movement of the nose assembly 146 into its retracted position within the nose receiving channel 148 causes the nose contact trip or switch to be tripped, thereby causing circuit 76 to terminate operation of the motor 74 and hence, the power drive assembly 50. When the device 130 is pulled away from the workpiece W (see FIG. 8), a feed mechanism 160 is actuated (either by release of the first contact trip or by use of a second contact trip activated by movement of the nose assembly 146 to its extended position). The feed mechanism 160 comprises a ratchet wheel 162. Preferably, the ratchet wheel 162 has a plurality of radially extending prongs 164, which are resiliently biased outwardly via internal springs to project outwardly from a main wheel portion 166 of the feed mechanism. The prongs 164 are constructed and arranged such that engagement thereof by a structure running circumferentially or tangentially to the periphery of wheel portion 166 in one direction will move the prongs 164 inwardly, while engagement thereof in an opposite direction will not, as will be appreciated more fully from the following further description. Although not shown, the ratchet wheel 162 is connected by a gear train to the nose assembly 146, as can be appreciated by those skilled in the art. When the nose assembly 146 is retracted during a fastener driving operation, the ratchet wheel 162 is rotated in a clockwise direction as viewed in FIGS. 5–8. During this clockwise rotation, the radially extending spring biased members 164 have convex cam surfaces that are permitted to ride over the head of the next fastener 170 and are forced inwardly against the internal spring bias thereof. In contrast, when the nose assembly 146 is extended from the nose receiving channel 148 after a fastener driving operation, the ratchet wheel 162 is rotated in a counter-clockwise direction (relative to the FIGS. shown). With this action, concave catching surfaces of the resiliently biased projections 164 engage the head of the next fastener 170 and drive the same into the drive track 144 for the next fastening operation.

In accordance with the second embodiment, the front end of the device 130 can be made somewhat smaller in comparison with that of the first embodiment.

Figures 9A, 9B:
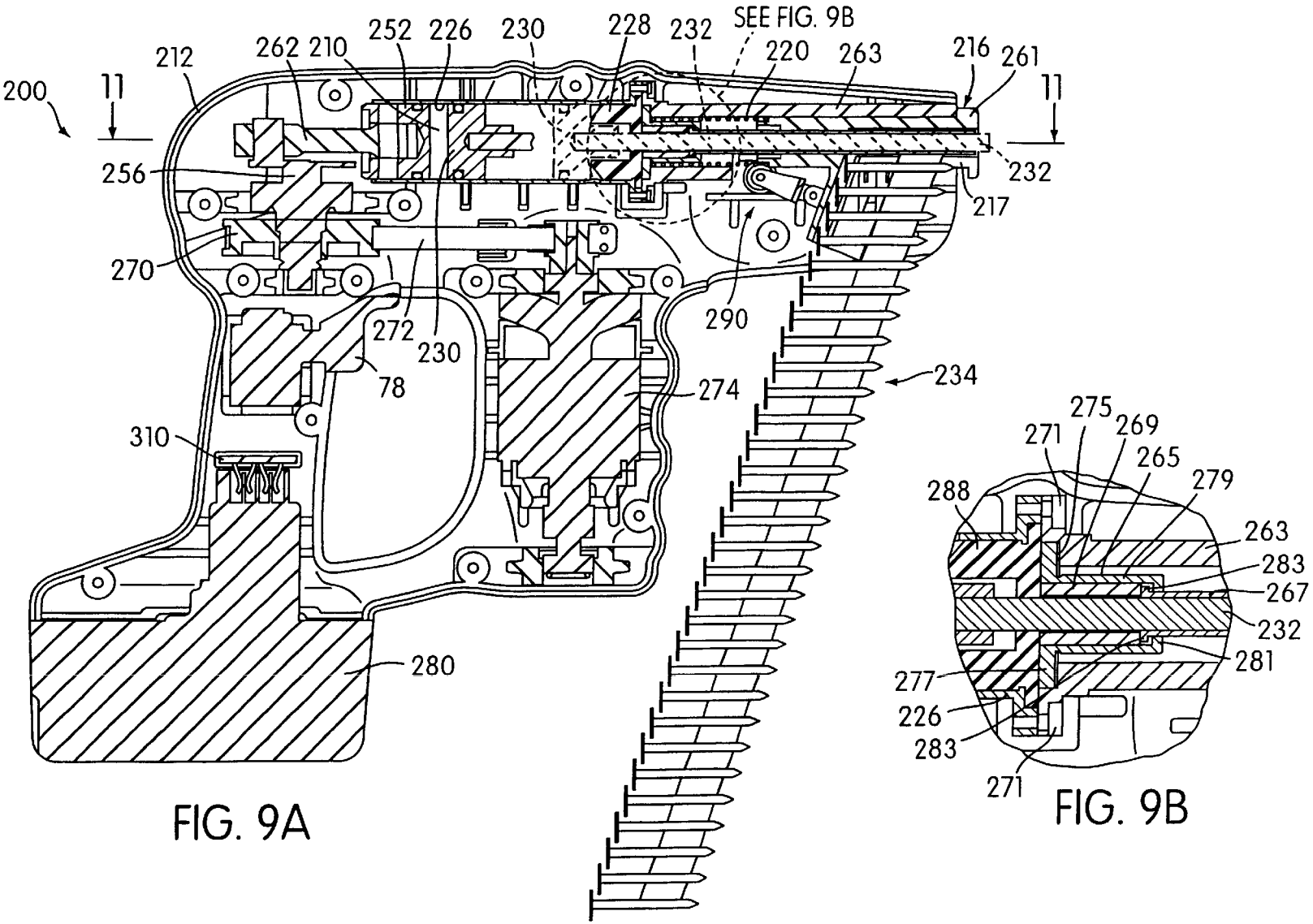
FIG. 9A is a cross-sectional view of the multi-stroke fastening device in accordance with a third embodiment of the present invention.
FIG. 9B is an enlarged view of circled section B in FIG. 9A.

FIG. 9A is a cross-sectional view of a third embodiment of a multi-blow fastening device, generally indicated at 200, in accordance with the principles of the present invention. FIG. 9B is an enlarged view of circled section B in FIG. 9A. The device 200 is the same in many respects as the device illustrated in FIG. 1. For example, the multi-blow fastening device 200 has a housing 212, a cylindrical striker assembly guide track 226, piston 252 within the cylindrical track 226, plunger 240 connected with a driver member 232, airspace 210, crank arm 262, crank 256, pulley 270, belt 272, motor 274, feed mechanism 290, an elastomeric bumper 228, and a battery 280, all as described above with respect to the first embodiment, and need not be repeated here. Driver member 232 together with plunger 240 constitute what may be termed a striker assembly or driver assembly 230, a forward position of which is shown in phantom lines and a rearward position of which is shown in partial cross section. The piston 252 is shown in its rearward position only. It will be appreciated by those skilled in the art that other specific details of the embodiments of FIGS. 1–8 (such as with respect to an exit for the spent collation) may also be applied to the embodiments of FIGS. 9–18 and not be repeated here. The device of 200 differs from the first embodiment most significantly towards the front end of the device 200 that interfaces with the fasteners to be driven.

Specifically, the device 200 includes a nose assembly 216 mounted in the housing 212. The nose assembly 216 preferably includes a channel-like nose member 261 which is spring biased forwardly by a coil spring member 220. The nose member 261 receives collated fasteners 234 through a lower slot 217 in the nose member 261. The nose member 261 of the nose assembly defines a drive track along which the forward end of driver 232 travels during the drive strokes and return strokes.

The nose member 261 is mounted for longitudinal, axial sliding movement within a nose receiving channel member 263. More specifically, as shown best in FIG. 11, which is a sectional view taken through the line 11—11 in FIG. 9A, the nose receiving channel member 263 is provided with a pair of nose guide members 266 extending laterally inwardly openings 299 through the housing 212, and threadedly received in threaded bores in the side wall of the channel member 263. The forward ends of guide members 266 are received in respective grooves or channels 268 formed in opposite sides of the nose member 261. The engagement of guide members 266 with channels 268 enable the nose member 261 to be slidably mounted within channel member 263. The length of channels 268 limits the longitudinal travel of the nose member 261.

Figure 12:
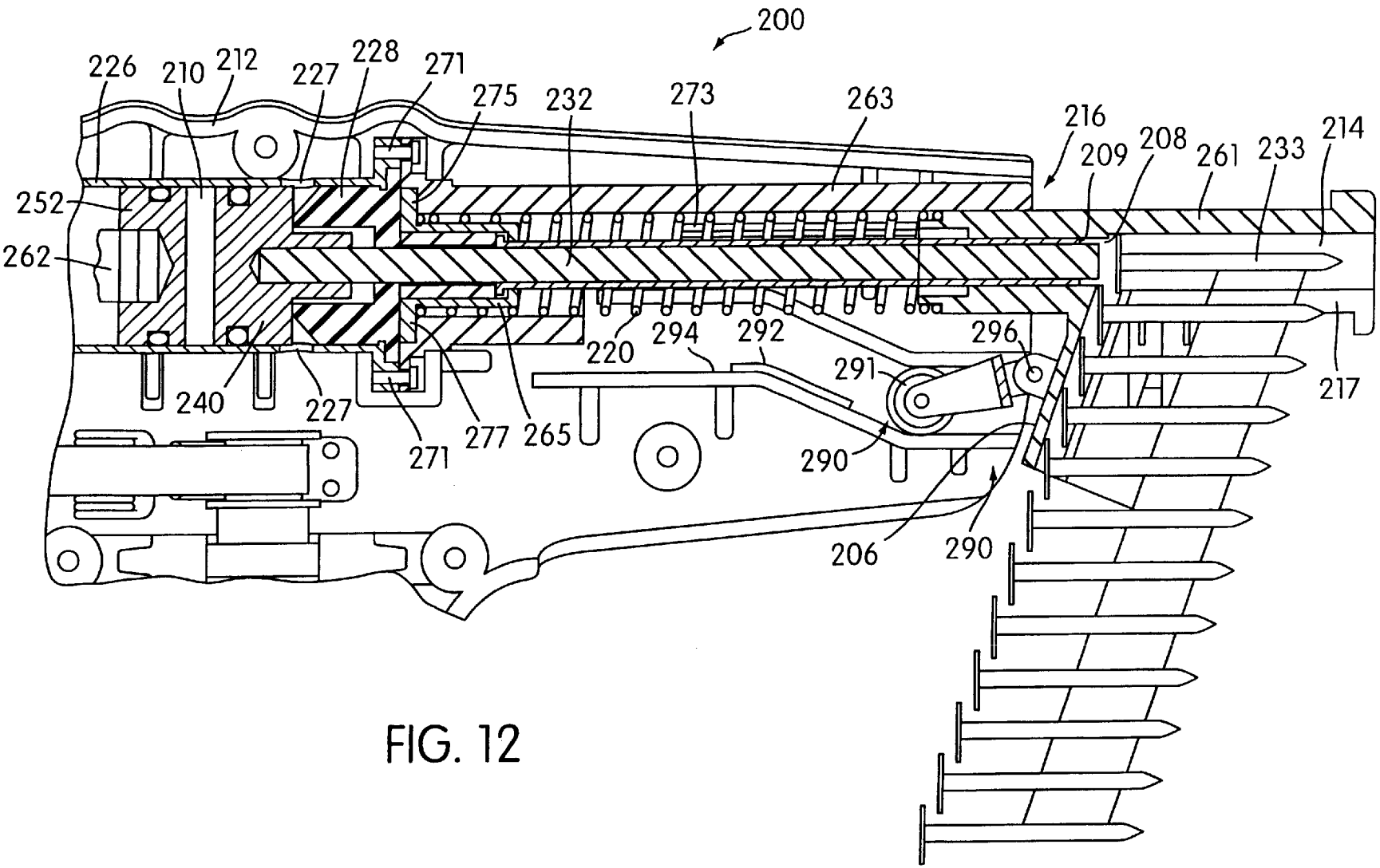
FIG. 12 is an enlarged cross-sectional view of the multi-stroke fastening device in accordance with the third embodiment of FIG. 9A illustrating the fastening device at rest.

As can be appreciated from FIG. 12, the nose receiving channel 263 is a generally cylindrical tubular structure, preferably having a portion of its circumference (preferably about 50°) cut-away towards the forward bottom portions thereof to enable the nose receiving channel 263 to receive the lower feed track portion 206 of nose member 261 as it moves rearwardly into the tool against the force of spring 220 during a fastener driving operation. The nose receiving channel 263 may also be provided with one or more longitudinally extending interior tracks or ribs 273 that cooperate with corresponding tracks or ribs (not shown) on the external surface of the nose member 261 so that the nose member 261 can slide in controlled fashion relative to the channel 263.

Figure 10:
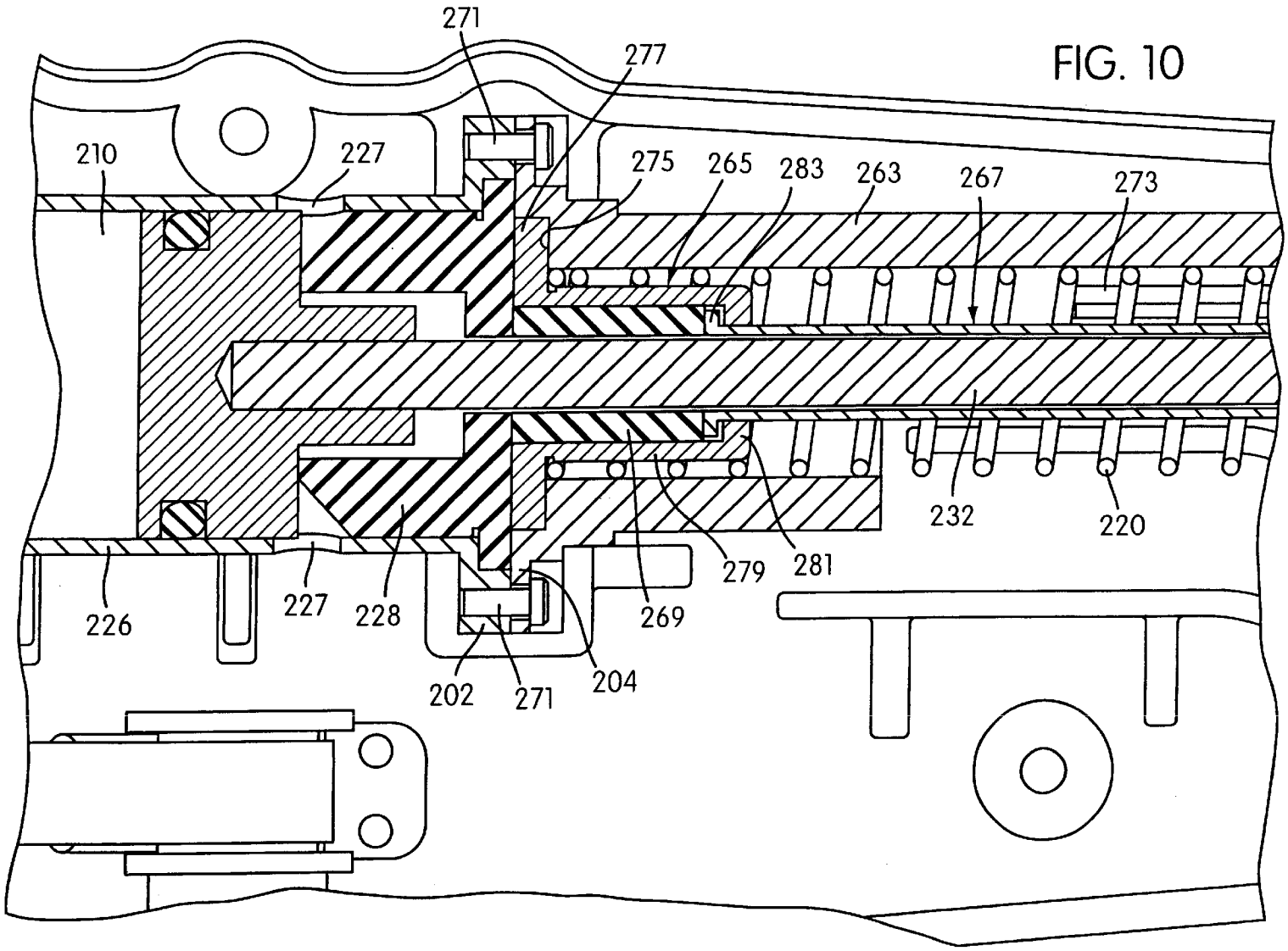
FIG. 10 is an enlarged view of the head of the fastener device illustrated in FIG. 9.
Figure 11:
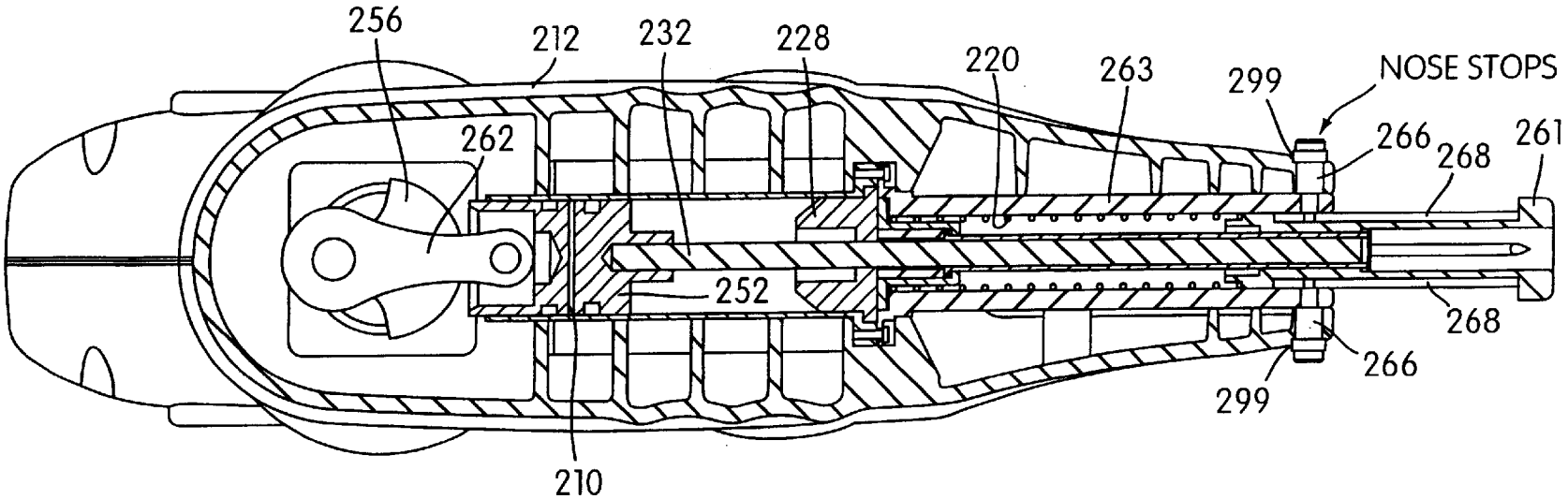
FIG. 11 is a sectional view taken through line 11—11 in FIG. 9A.

As can be seen best in FIG. 10, the nose receiving channel member 263 is fixed to the housing 212 and also has its rearward end fixed to the forward end of the striker assembly guide track 226 by appropriate fasteners 271 extending through respective abutting annular flanges 202,204 of the guide track 226 and of the nose receiving channel 263, respectively. The preferred guide track 226, as with the previous embodiments, is a cylindrical tubular structure and has an air vent 227 towards the forward end thereof (see FIG. 10) that vents displaced air from in front of the plunger 240.

The connection between the nose receiving channel 263 with the striker assembly guide track 226 also serves to secure a mounting structure 265. Specifically, as best seen in FIG. 10, which is an enlarged sectional view of a portion of FIG. 9A, an annular recess 275 is formed in the rear end of nose receiving channel member 263 to receive an annular flange 277 of the mounting structure 265. The mounting structure 265 has a main cylindrical portion 279 extending axially in parallel relation to the nose receiving channel 263. The forward end of the mounting structure 265 has a radially inwardly projecting flange 281, which terminates in slidable abutting relation with the cylindrical outer surface of a fastener head engaging structure 267. More specifically, the fastener head engages structure 267 is generally tubular member having a rearward end telescopingly received in the mounting structure 265. The forward end portion of fastener head engaging structure 267 is received within an axial bore 208 in the nose member 261, as seen in FIG. 12.

Referring back to FIG. 10, a radially outwardly projecting flange 283 at the rear end of the fastener head engaging structure 267 has a forward surface thereof abutting against the flange 281 of the tubular mounting structure 265 so that the rear end of the fastener head engaging structure 267 is retained within the mounting structure 265.

The fastener head engaging structure 267 acts as a guide tube for the driver member 232 received therethrough. The fastener head engaging structure 267 also serves to engage the head of a fastener being driven and to maintain the fastener in spaced relation, at a predetermined spaced distance, from the guide track 226 throughout a drive stroke.

As shown in FIG. 9B, the cylindrical portion 279 of the mounting structure 265 has a diameter which is sufficiently large so as to be radially outwardly spaced from the driver 232. Disposed within this space is a resilient elastomeric tubular structure 269 generally cylindrical in shape. The forward annular edge of the resilient structure 269 engages the rearward surface of the annular flange 283 of fastener head engaging structure 267. The rearward annular edge of the resilient structure 269 engages the forwardly facing surface of the resilient bumper 228. Preferably, the resilient structure 269 is formed from a rubber-based material, as is the bumper 228.

It is contemplated that the resilient structure 269 may be integrally formed/molded with the bumper 228.

As best seen in FIG. 10, the resilient structure 269 is operatively coupled to the fastener head engaging structure 267 (by being engaged therewith) to permit limited longitudinal movement of the fastener head engaging structure 267 relative to the striker assembly guide track 226. The resilient structure 269 is constructed and arranged to dampen the engagement (and any slight impact) between the forward end of the fastener engaging structure 267 and the head of a fastener being driven (see FIGS. 13 and 14). Specifically, the resilient structure 269 is longitudinally compressed or stressed by the fastener head engaging structure 267 under the force and weight of the tool bearing upon the fastener being driven (see FIG. 14). When the driver member 232 impacts the head of the fastener with each stroke, the head of the fastener being driven may become slightly forwardly spaced from the forward, annular fastener engaging surface 209 of the fastener head engaging structure 267. When the driver member 232 is retracted, the force of gravity acting on the device 200 and/or the application of force by the user to the device 200 maintains the forward edge 209 of the fastener head engaging structure 267 in contact with the head of the fastener being driven. Any slight impacts between the forward edge 209 and the head of the fastener being driven are damped by the resilient structure 269.

Figure 13:
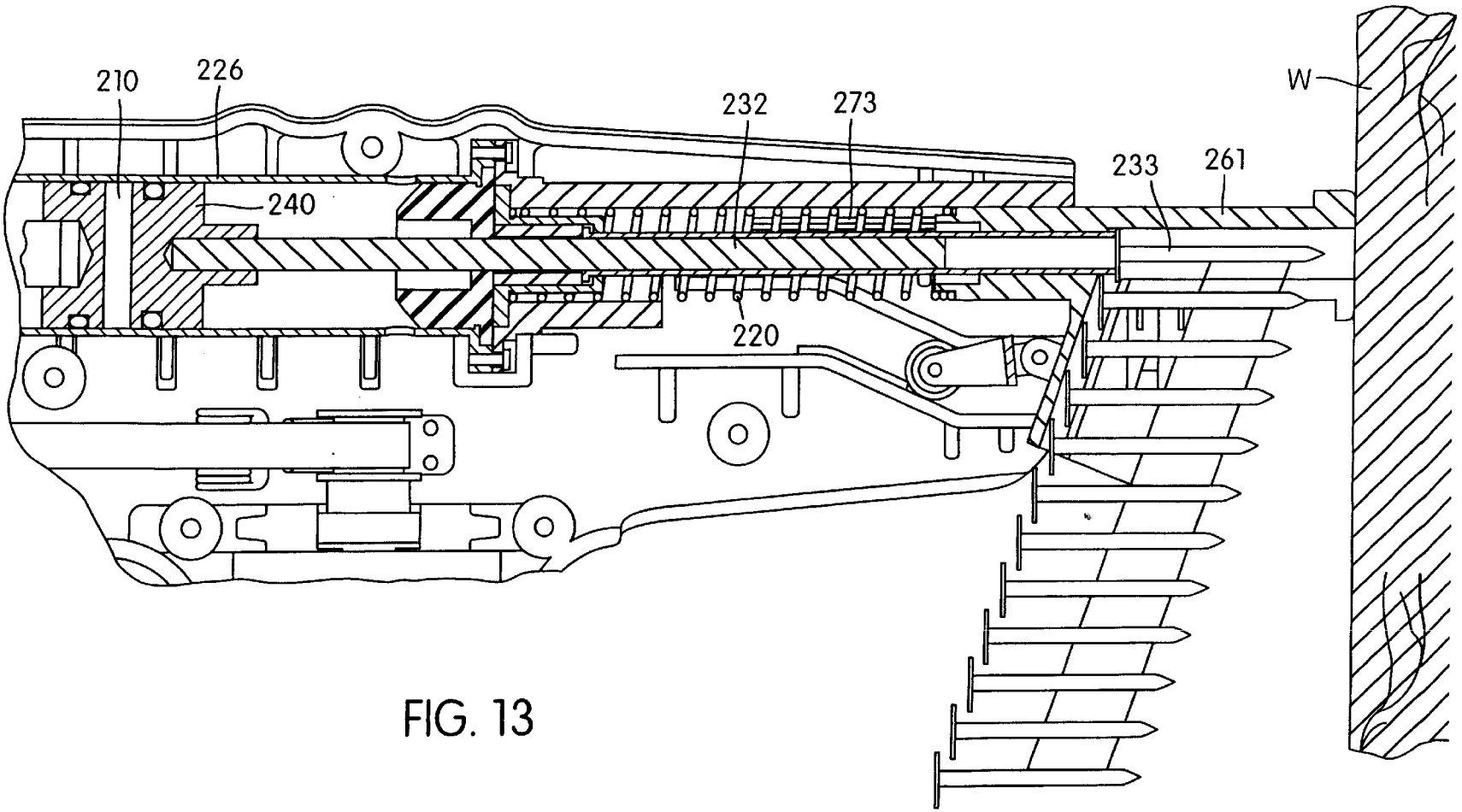
FIG. 13 is a cross-sectional view of the multi-stroke fastening device in accordance with the third embodiment of FIG. 9A illustrating the fastening device at an initial stage of operation.

FIG. 12 illustrates the device 200 at rest, prior to cycling of the driver member 232, and with a fastener 233 disposed in the drive track 214. The nose member 261 is in its fully extended position under the force of coil spring 220. FIG. 13 illustrates an initial stage of tool operation, i.e., the user has pulled the trigger and has forced the forward end of nose member 261 against a workpiece W to compress spring 220 a predetermined distance to activate a nose switch 292 connected with a control circuit that commences cycling of the plunger 240 and driver 232. The feed mechanism 290 has a roller 291 that rides along a track 294 as the nose element 261 is forced against a workpiece and moves into the housing 212 against the bias of coil spring 220. When the roller 291 reaches a contact portion 292 of a nose switch, which contact portion is disposed along the track 294, control circuitry within the tool causes motor 274 is energized to commence cycling of the tool. The nose switch contact portion 292 is illustrated schematically, and the electrical connection between the nose switch contact portion 292 and motor 274 is not shown, nor is the control circuit shown in detail, as those skilled in the art will appreciate that these types of elements and connections can be one of several different known constructions and still fall within the scope the present invention. When the nose switch contact trip 292 remains depressed, the tool continues to cycle. When the roller 291 rides past the mechanical contact portion 292 after the nose assembly is forced into the housing (which in the embodiment shown is in the form of an elongated button) the control circuit sends a signal to shut down the motor (or in a contemplated embodiment, first slows down the motor to a fraction of its duty cycle before completely shutting the motor down).

As the tool is subsequently pulled away from the workpiece, the nose assembly is permitted to project outwardly from the housing, and the roller rides down a different, adjacent return path, which is parallel to the surface 294 so that it does not depress contact portion 292 on its return as the nose is extended out from the housing after a fastening operation. This can be accomplished by a cross-over railroad track type intersection.

As an alternative to an elongated contact portion 292, the roller 291 may be provided with a cam follower that maintains engagement with a smaller contact portion 292 as the nose assembly is moved into the housing, but releases the contact portion once the nose assembly is moved fully into the housing. In any event, the contact portion remains depressed until the nose assembly is substantially fully received within the housing, at which point the contact portion is released to permit the circuit and motor to terminate the fastening cycle.

Figure 14:
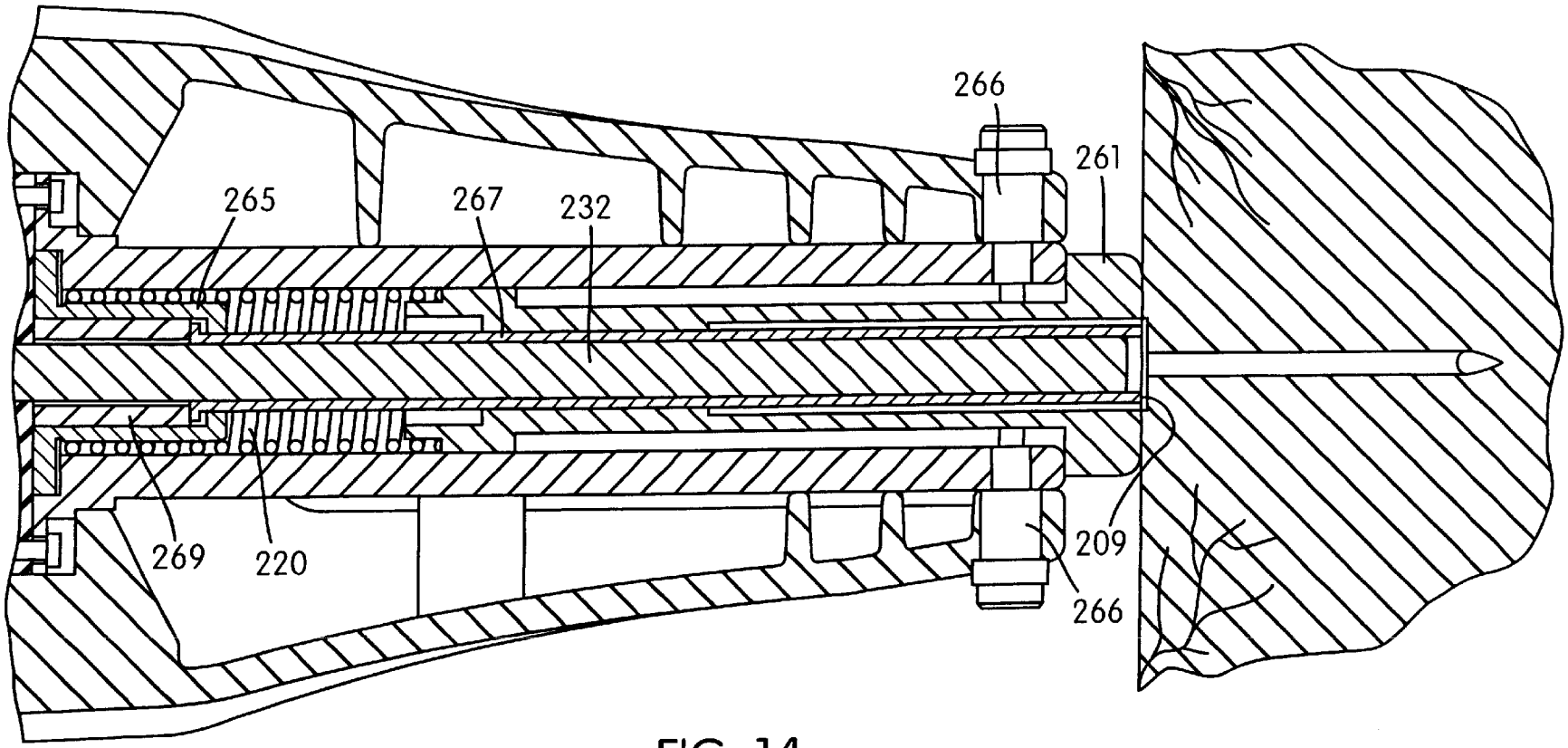
FIG. 14 is an enlarged partial sectional view of the multi-stroke fastening device in accordance with the third embodiment of FIG. 9A illustrating the fastening device at the end of a fastening operation.

As the roller 291 rides up ramp 295 of the track 294 as the tool is pressed against a workpiece to commence a fastening operation, the feed mechanism 290 pivots about a pivot 296 to enable a feed pawl (also not shown) to engage the collated fasteners 234 and move a lead fastener 233 into the drive track 214. As shown in FIG. 13, the plunger 240 has commenced its initial retraction within the guide track 226, however, it should be appreciated that the present embodiment contemplates that initial movement of the plunger 240 need not commence at this stage. Rather, it is possible to design the tool such that it only commences cycling after the nose member 261 is sufficiently moved rearwardly within the tool a sufficient distance such that the forward point of fastener 233 engages workpiece W. FIG. 14 is an enlarged partial sectional view similar to FIG. 11, but illustrates the device 200 towards the end of a fastening operation.

The resiliency of the resilient structure 269, the length of driver member's 232 forward extension beyond the forward end of fastener head engaging structure 267 during the drive stroke, the downward force applied when using the tool, among other factors, may have a bearing on the separation between the head of the fastener being driven and the forward surface 209 of the fastener head engaging structure 267. In any case, it should be appreciated that the resiliency of the resilient structure 269 minimizes the distance of, or can practically eliminate the disengagement between the fastener head engaging structure 267 and the head of the fastener being driven during the drive and return strokes. That is, when the forward end of the driver member 232 extends forwardly of the fastener contacting forward edge of fastener head engaging structure 267, the resiliency of the resilient structure 269 enables the fastener contacting edge of the fastener head engaging structure 367 to remain closely coupled with or remain only slightly spaced from the head of the fastener with each stroke. The resilient structure 269 is compressed slightly during each return stroke under the weight (force) of the tool, and decompresses slightly at the end of each drive stroke to maintain the close engagement between the fastener head engaging structure 267 and the head of the fastener being driven.

By providing the resilient structure coupled with fastener head engaging structure, the operation of the tool becomes much smoother and vibrations are effectively damped, thus eliminating tool bounce off the fastener.

The fastener head engaging structure 267 maintains the head of the fastener being driven spaced a predetermined distance relative to the guide track 226, which distance varies essentially only as a function of the resilience of the resilient structure 269. Preferably, the resilient structure 269 is made from a urethane material, which is the same urethane material that forms bumper 228.

In the embodiment specifically described and shown, the fastener head engaging structure 267 is formed as a separate structure from the nose assembly 216. It is contemplated, however, that the fastener head engaging structure 267 may constitute part of the nose assembly 216 in alternate embodiments contemplated by this invention.

FIGS. 15–53 illustrate a fourth embodiment of a multistroke fastening device 300 in accordance with the present invention for driving a fastener 333 into a workpiece, generally shown at W.

Figure 15:
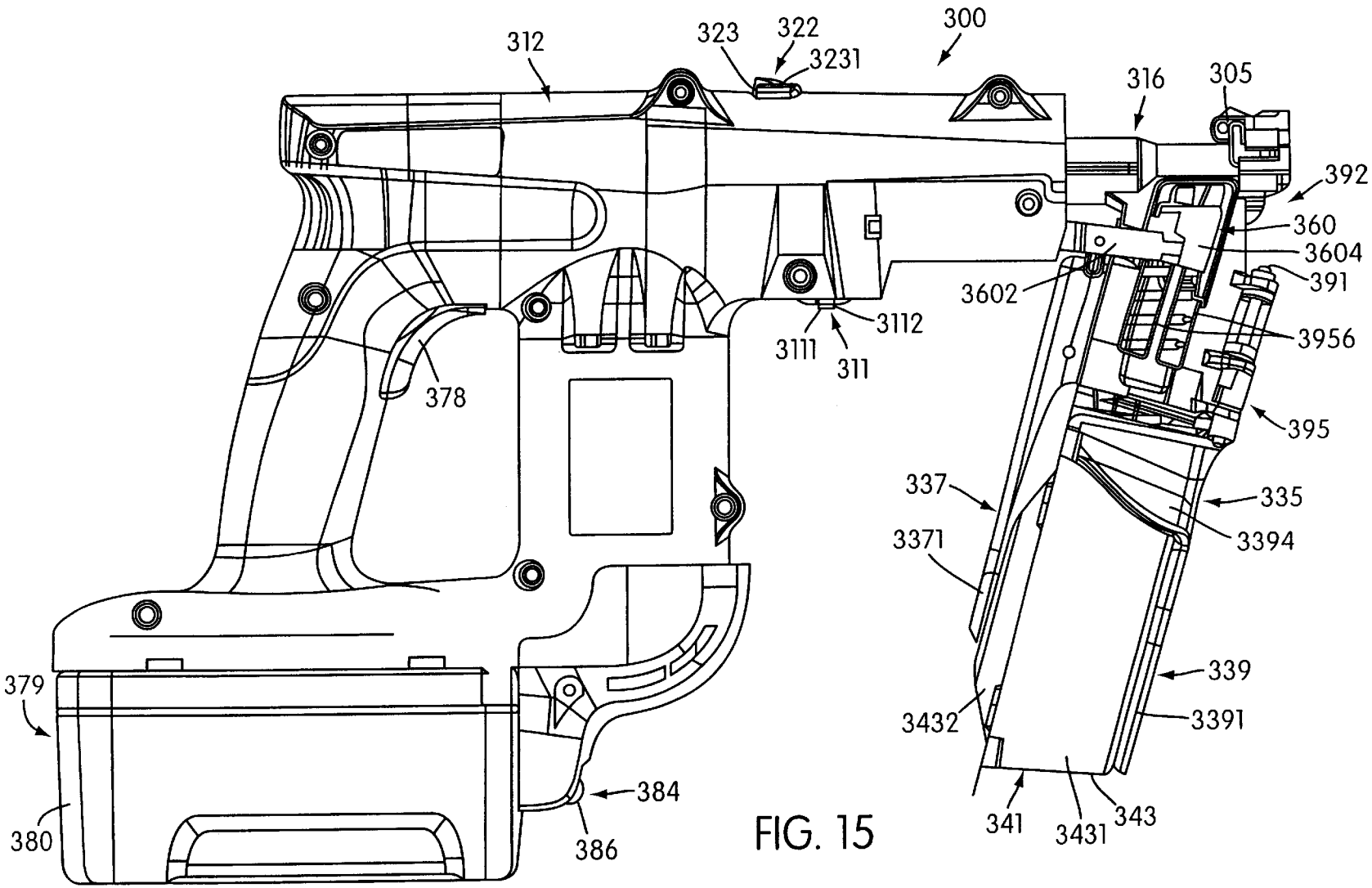
FIG. 15 is a side view of a multi-stroke fastening device in accordance with a fourth embodiment of the present invention.

The device 300 includes a housing 312, as shown in FIG. 15. A nose assembly 316 is movably mounted within a portion of the housing 312 at a forward portion thereof. The nose assembly 316 has a fastener drive track 314, or also referred to as a fastener drive channel, along which a driver assembly, generally shown at 330, and the fastener 333 travel when the fastener 333 is driven into the workpiece W, as shown in FIGS. 21–25.

A striker assembly 324 is movably mounted within the housing 312. The striker assembly 324 refers to the combination of the driver assembly 330 and a power drive assembly 350, as shown in FIGS. 16, 17 and 21–25. The striker assembly 324 is adapted to strike the fastener 333 to be driven into the workpiece W and comprises, among other things, a driver member 332 and a plunger 340. Like the embodiments described above, the striker assembly 324 contacts the fastener 333 multiple times during a fastening operation to drive the fastener 333 into the workpiece W. The power drive assembly 350 is constructed to drive the driver assembly 330 and comprises a piston 352, a crank member 356, a crank arm 362, and a gear train, generally shown at 370, as shown in FIGS. 16, 17, 19 and 20.

Figure 19:
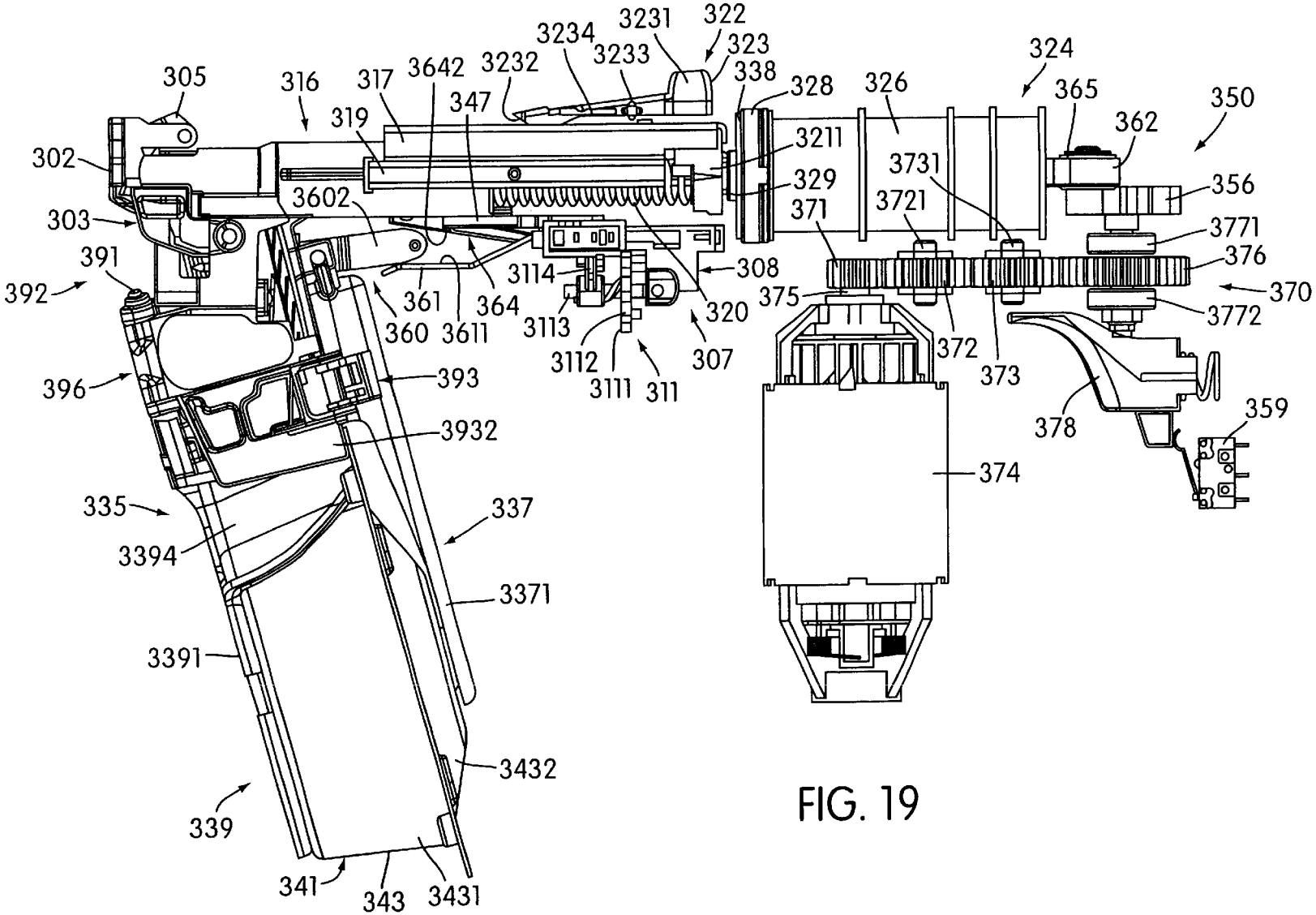
FIG. 19 is a partial schematic of one side of the mechanical feed mechanism, nose assembly, and drive assembly in accordance with the embodiment of FIG. 15.
Figure 20:
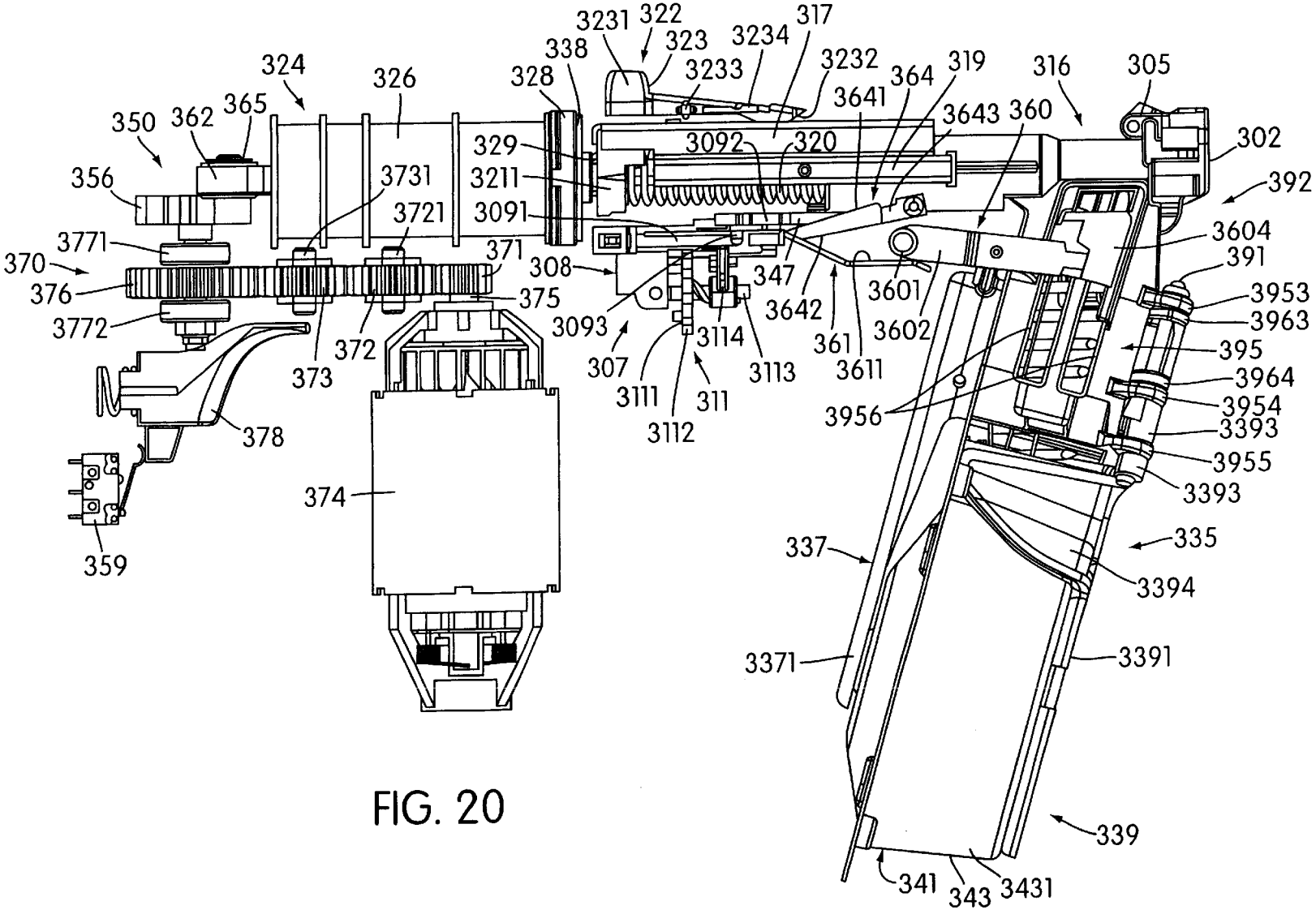
FIG. 20 is a partial schematic of an opposite side of the mechanical feed mechanism, nose assembly, and drive assembly in accordance with the embodiment of FIG. 15.
Figure 26:
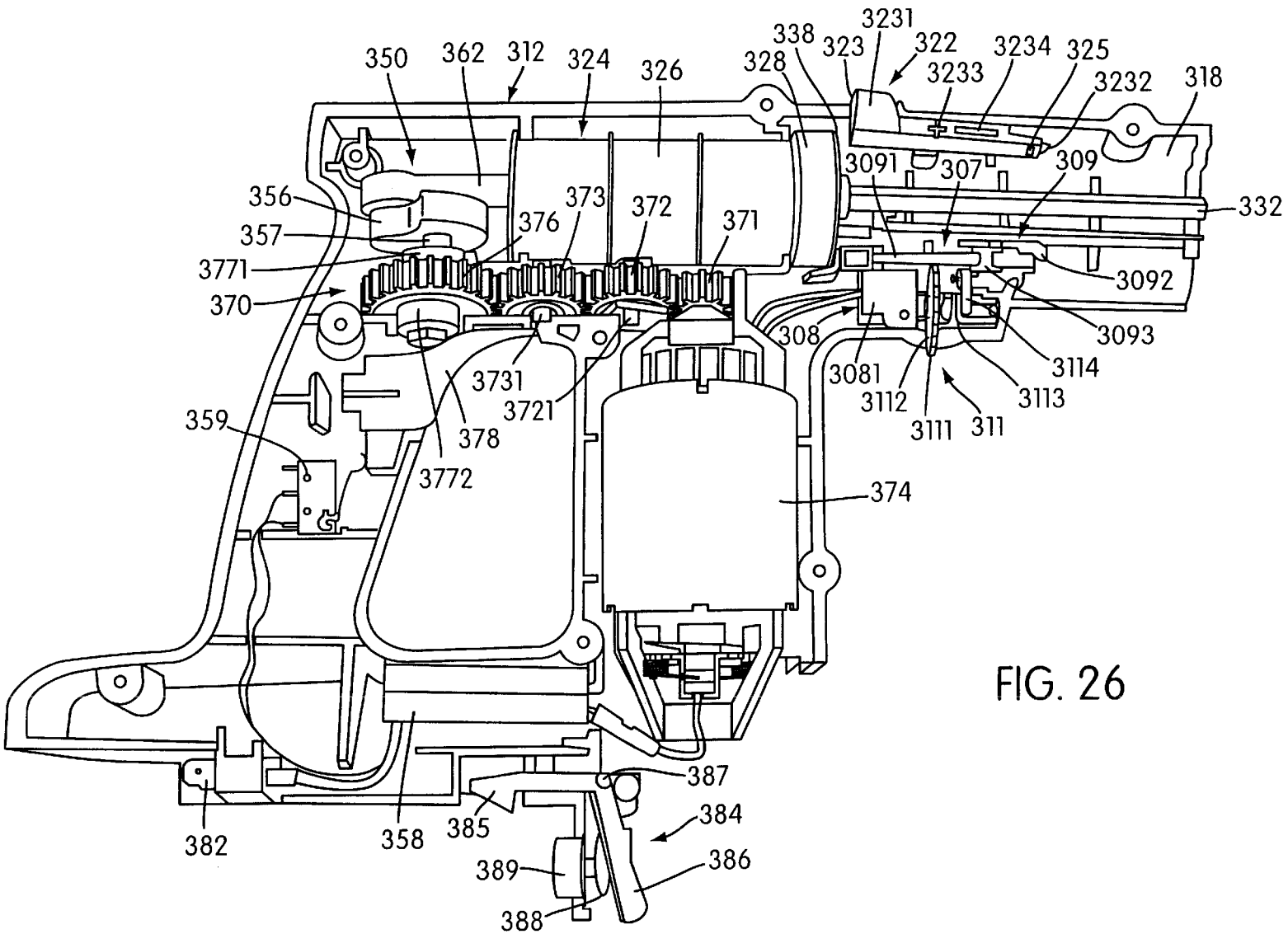
FIG. 26 is a schematic view of the multi-stroke fastening device of FIG. 15 having a portion of the housing removed.

The striker assembly 324 has a guide track 326, preferably made from metal, which has a forward end and a rearward end. It, however, is contemplated that other materials such as for example a plastic having similar properties may be used. The guide track 326 has an annular resilient bumper 328, preferably made from an elastomeric material such as rubber, disposed towards the forward end of the guide track 326, as shown in FIGS. 19, 20 and 26. The guide track 326 preferably has a cylindrical shape, however, other shapes and configurations are considered to be well within the scope of the present invention.

The driver assembly 330 is mounted in slidable relation within the guide track 326, as shown in FIGS. 16 and 21–25.

Figure 53:
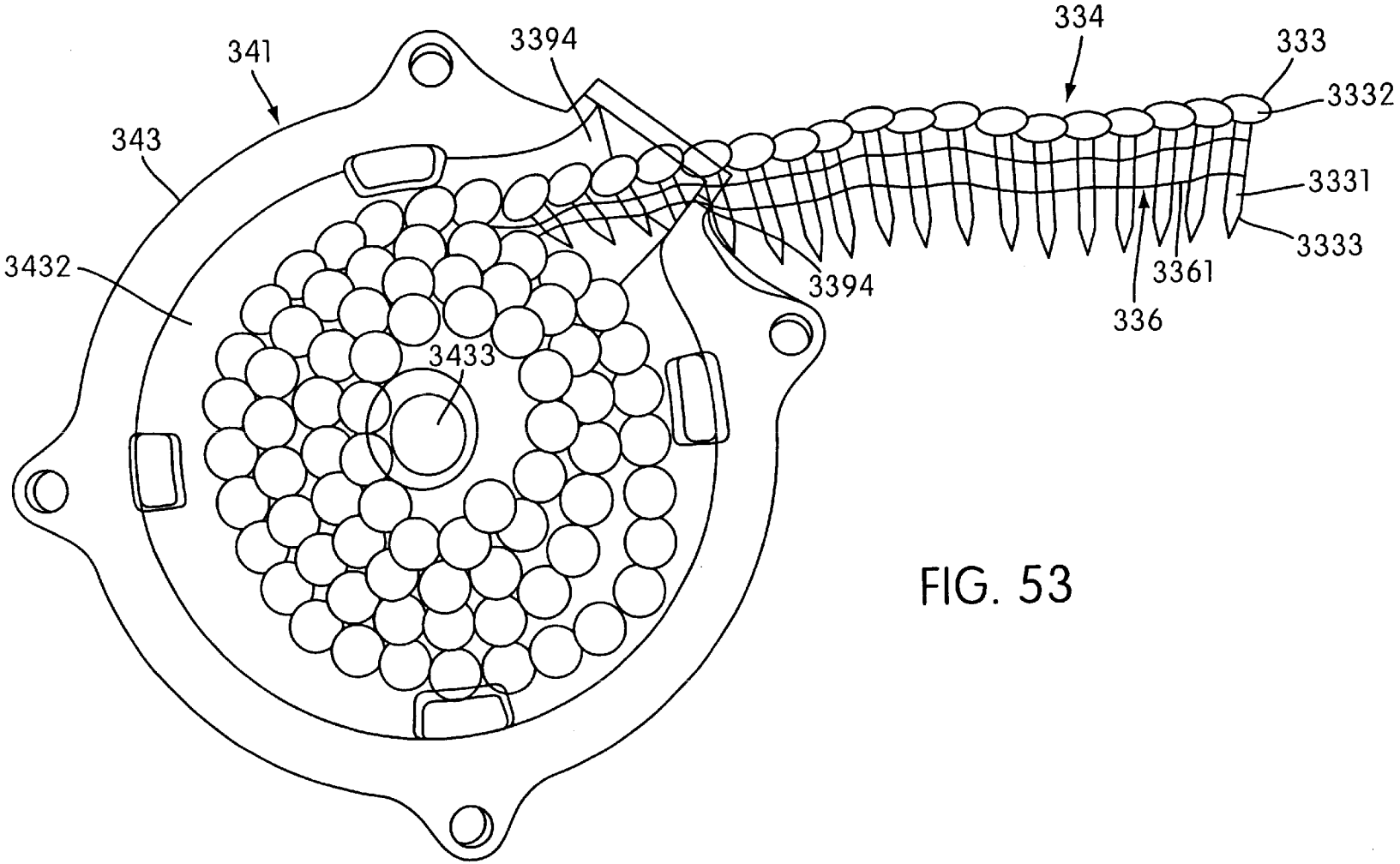
FIG. 53 is a schematic view of a coil of collated fasteners and fastener dispensing assembly in accordance with the present invention.

The driver assembly 330 includes the driver member 332 that is constructed and arranged to strike the fastener 333, which is the leading fastener within a coil of collated fasteners, generally shown at 334 in FIG. 53. The collated fasteners 334, discussed in greater detail below, comprise a plurality of coated collated roofing nails interconnected by a flexible collation material 336.

Similar to the previous embodiments, the driver assembly 330 is movable through the drive track 314 during a plurality of alternating fastener impacting drive strokes and return strokes to impart a plurality of impacts of the driver member 332 upon the fastener 333 to drive the fastener 333 into the workpiece W.

Figure 16:
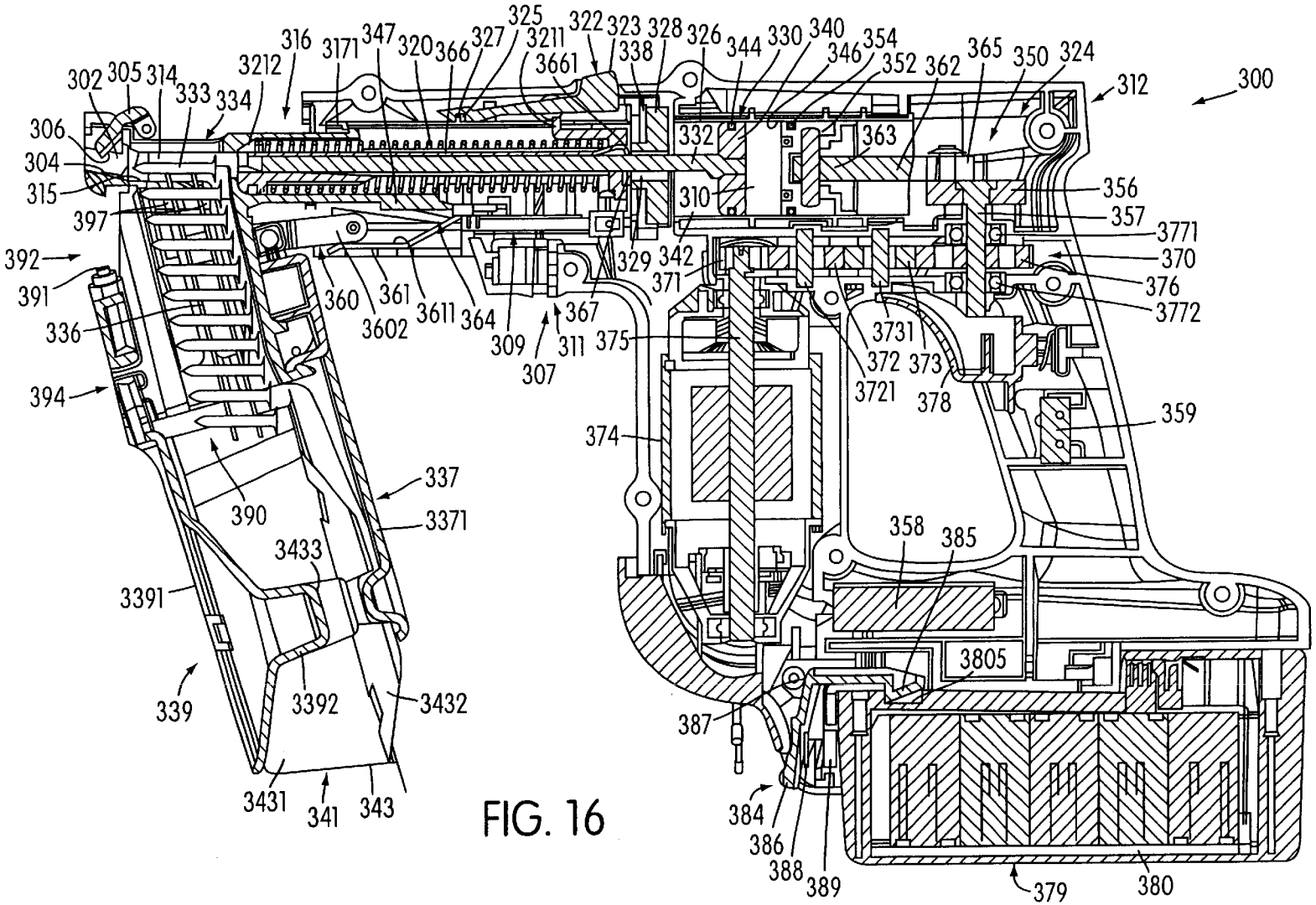
FIG. 16 is a cross-sectional side view of the multi-stroke fastening device of FIG. 15.

The driver member 332 extends through an opening 329 within the bumper 328 and further extends through the center of a mounting washer 338, as shown in FIG. 16. A forward end of the driver member 332 is received within an opening 367 in the rearward end of the nose assembly 316 to be received in the drive track 314 for impacting upon the fastener 333. The opening 329 in the bumper 328 and the opening 367 in the rearward end of nose assembly 316 maintains the driver member 332 in axially aligned relation with the drive track 314.

The driver assembly 330 further comprises the disc-shaped plunger 340 to which the driver member 332 is connected, as shown in FIG. 16. The plunger 340 has a peripheral annular groove for receiving a generally annular sealing member 344 disposed in slidable and sealed relation with an interior cylindrical surface 346 of the guide track 326. The plunger 340 has a cross-section that is complimentary to the cross-section of the guide track 326.

Figure 17:
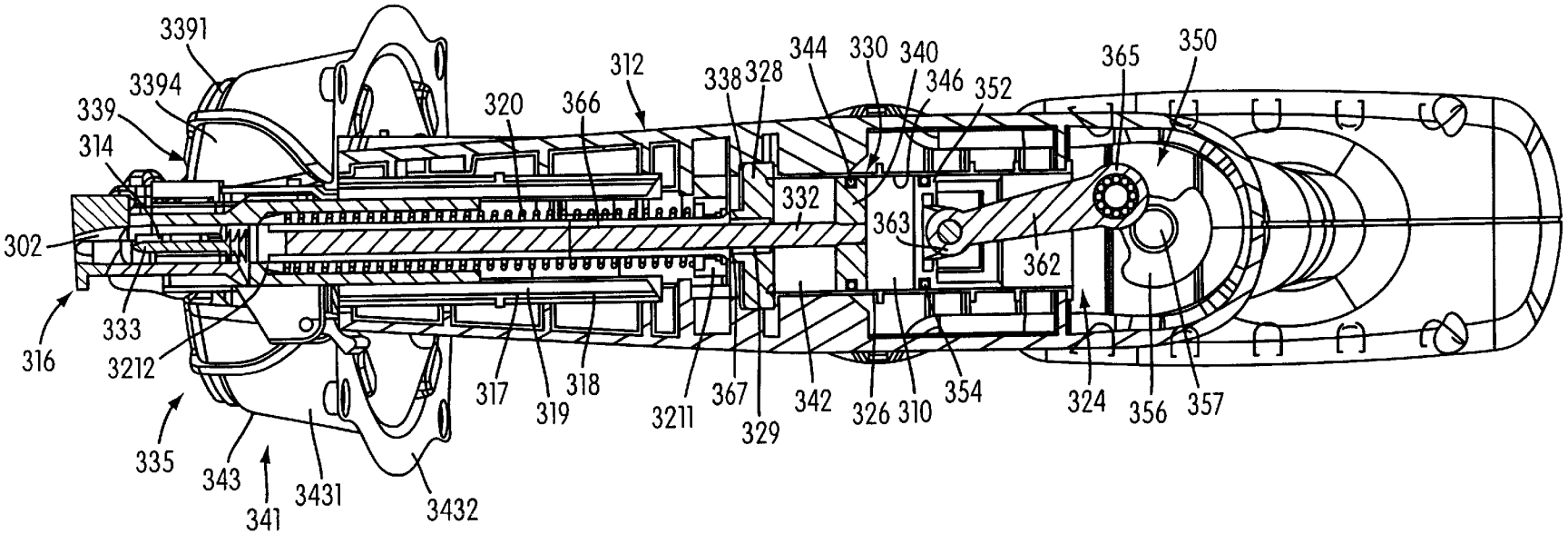
FIG. 17 is a cross-sectional top view of the multi-stroke fastening device of FIG. 15.

The power drive assembly 350 is constructed and arranged to drive the driver assembly 330 to effect a plurality of impacts of the driver member 332 upon the fastener 333. The piston 352 of the power drive assembly 350 preferably has a generally cylindrical outer configuration, as shown in FIGS. 19, 20 and 26, and an outer periphery having a sealing member 354 disposed in slidable and sealed relation with the inner surface 346 of the guide track 326, in similar fashion to the sealing member 344 of the plunger 340. The crank member 356 is mounted to a shaft 357 received in the housing 312 which mounts the crank member 356 for rotational movement about an axis. The crank arm 362 is pivotally connected at opposite ends thereof, including a first end 363 pivotally connected to the piston 352, and an opposite end 365 pivotally connected with the crank member 356, as shown in FIG. 17. Thus, rotation of the crank member 356 causes reciprocating motion of the crank arm 362 which translates into reciprocating motion of the piston 352 within the guide track 326.

Unlike the illustrated embodiments of the previous embodiments, the crank member 356 of the present invention is driven by the gear train 370. The gear train 370 provides a three-stage spur gear drive. A drive gear 371 of the gear train 370 is mounted to an output shaft 375 of a motor 374, which motor 374 rotatably drives the crank member 356 via the gear train 370. Gears 372, 373 of the gear train 370 are mounted on shafts 3721, 3731 received in the housing 312. Washers and spacers placed on opposing sides of the gears 372, 373 prevent axial movement of the gears 372, 373 along the shafts 3721, 3731. Gear 376 is mounted on the shaft 357 to drive the crank member 356. Gear 376 is secured on the shaft 357 between a pair of bearings 3771, 3772, which are mounted in the housing 312. Although the above-described gear train 370 is preferred, it, however, is contemplated by the inventors that other coupling arrangements as described above in connection with the other embodiments may be employed. For example, it is contemplated that a pulley and belt arrangement could be used to provide the multiple strokes.

The power drive assembly 350 is operatively coupled to the driver assembly 330 via a substantially sealed air space 310 between the piston 352 and the plunger 340 of the driver assembly 330. As appreciated in the previous embodiments, the pressurization of the air space 310 drives the plunger 340, and hence the entire driver assembly 330 forwardly, so that the driver member 332 impacts upon the head of the fastener 333.

It should be noted that the initial impact of the driver member 332 upon the fastener 333 tends to force the fastener 333 towards a bottom surface 315 of the drive track 314 due to the interconnection of the fastener 333 with the coil of fasteners 334 by the collation material 336. The nose assembly 316 is constructed and arranged to counter this initial effect, as will be discussed in greater detail below.

It is preferred that the plunger 340 does not impact the bumper 328 at the end of each impact drive stroke. Sufficient space 342 is provided between the plunger 340 and the bumper 328 wherein the resistance of the fastener 333 being driven into the workpiece W serves to stop the movement of the driver assembly 330 prior to the plunger 340 impacting on the bumper 328, as shown for example in FIG. 16. The space 342 allows all the energy of the driver assembly 330, during the impact drive stroke, to be absorbed by the fastener 333. Thus, no energy will be lost due to impact with the bumper 328, which conserves power.

After each impact stroke, the driver assembly 330 is drawn rearwardly within the guide track 326 as a result of its being coupled to the power drive assembly 350. More particularly, as the piston 352 is withdrawn within the guide track 326 by the action of the crank member 356, a vacuum is created in the substantially sealed air space 310 so as to draw the plunger 340 rearwardly with the piston 352.

It should be appreciated that the operative coupling provided by the air space 310 substantially cushions the driving impact of the driver assembly 330 upon the fastener 333. This reduces vibration of the device 300 and provides for a quieter operation. In addition, after the driver assembly 330 is pulled back by the vacuum in air space 310, and the piston 352 instantaneously reverses direction so as to commence forward movement, a pressure pulse or spike is generated in air space 310, thus creating high levels of kinetic energy for driving the driver assembly 330 forwardly. The air space 310 in effect acts as an air spring.

It should also be appreciated that because the vibrations of the device 300 are reduced, the life of the device 300 can be increased, and the user experiences less fatigue from use of the device 300 as a result.

A power source, generally shown at 379, for supplying power to the motor 374 to operate the striker assembly 324, is removably mounted on a lower portion of the housing 312, as shown in FIGS. 15 and 16. The power source 379 is in the form of a rechargeable battery 380. The battery 380 has battery contacts, which can be removed from housing contacts 382 to enable the battery 380 to be recharged and/or replaced. It is contemplated that the battery 380 may include a plurality of batteries contained within a battery housing wherein each battery can be individually recharged and/or replaced. It should be appreciated that other power sources 379 may be used for powering the striker assembly 324. For example, the device 300 may be connected with line voltage, an air pressure supply where the device 300 is pneumatically driven, combustion power, etc. It should be appreciated, however, that a self-contained battery powered device provides the operator with greater versatility and maneuverability.

The device 300 also includes a releasable battery retainer, generally shown at 384, for releasably retaining the battery 380 on the housing 312, as shown in FIG. 16. The battery 380 has a pair of rigid flanges located on an upper surface, which are slidably received in flanges formed in a lower portion of the housing 312. A recess 3805 in the upper surface is positioned to receive the battery retainer 384 to secure the battery 380 to the housing 312, as the battery 380 is slided thereon. The battery retainer 384 is pivotally mounted within the housing 312 and includes a camming portion 385 and a releasing portion 386 that extend through openings in the housing 312. The camming portion 385 engages the upper surface of the battery 380 as the battery 380 slides on the flanges, whereby the battery retainer 384 pivots about an axis provided by pins 387 until the camming portion 385 is received within the recess 3805. The canning portion 385 is biased into engagement with the recess 3805 by a spring 388 received between the releasing portion 386 and a spring retainer 389 that extends through a hole in the housing 312. Depression of the releasing portion 386 pivots the camming portion 385 about the axis pins 387, against the biasing of the spring 388, out of the recess 3805 to release the battery 380 for sliding movement in order to remove the battery 380 from the housing 312. Although the above-described battery retainer 384 is preferred because it provides for both easy mounting and removal of the battery 380, it is contemplated that other assemblies may be used to releasably secure the battery 380 to the device 300.

The structure of the nose assembly 316 will now be described in greater detail. The nose assembly 316 is releasably secured to the housing 312 to permit axial movement of the same in a direction along a fastener driving axis. Specifically, the nose assembly 316 has a slidably mounted supporting structure 317 on an upper portion thereof, as shown in FIG. 17. A nose receiving channel 318 is fixed within the housing 312 towards a forward portion of the housing 312. The nose receiving channel 318 is preferably provided with a grooved track that receives projecting flanges 319, or laterally extending wings, provided on opposite sides of the supporting structure 317 so that the channel 318 slidably receives the supporting structure 317 and hence the nose assembly 316. A nose releasing assembly releasably, generally shown at 322 in FIGS. 16 and 28–32, secures the supporting structure 317 of the nose assembly 316 to the housing 312, as will be discussed. The nose assembly 316 is guided axially into the housing 312 by the supporting structure 317 during a driving operation, as shown in FIG. 17. The nose receiving channel 318 is a generally cylindrical tubular structure having a forward bottom portion of its circumference cut-away to enable the nose receiving channel 318 to receive a feed mechanism, generally shown at 392, described in greater detail below.

A spring assembly 320, in the form of a coil spring, biases the nose assembly 316 outwardly from the housing 312. The present invention, however, is not limited to the use of the spring; rather, other biasing assemblies are contemplated to be within the scope of the present invention. One end of the spring 320 is supported by a support 3211 connected to the supporting structure 317. The opposite end of the spring 320 is supported by a guide 3212 received within the drive track 314. A projection 3171 on the supporting structure 317 serves as a forward stop of the nose assembly 316 which is biased outwardly from the supporting structure 317 by the spring 320. The support 3211 and the guide 3212 each have openings to receive the driver member 332 and a fastener head engaging structure 366.

The fastener head engaging structure 366 acts as a guide tube for the driver member 332 which is received therethrough. The fastener head engaging structure 366 also serves to engage the head of the fastener 333 being driven and to maintain the fastener 333 in spaced relation, at a predetermined spaced distance, from the guide track 326 throughout a drive stroke. The fastener head engaging structure 366 is channel shaped and extends through the openings of the support 3211, the guide 3212, and the spring assembly 320. A rearward end 3661 of the fastener head engaging structure 366 is received within the support 3211 and provides the opening 367 in which the driver member 332 extends through. The rearward end 3661 rests against a flanged portion of the bumper 328 when the nose assembly 316 is secured within the nose receiving channel 318. The guide 3212 is configured and positioned to guide the fastener head engaging structure 366 within the drive track 314 as the drive track 314 moves relative the fastener head engaging structure 366 when the nose assembly 316 is retracted into the housing 312.

The nose releasing assembly 322 for releasably securing the nose assembly 316 to the housing 312 comprises a pivoting assembly 323 that provides an engagement recess 325 adapted to receive an engagement projection 327 of the nose assembly 316 as the nose assembly 316 is inserted into the housing 312, as shown in FIGS. 29–32. The engagement projection 327 is formed on the supporting structure 317 of the nose assembly 316 and engages the engagement recess 325 upon insertion of the nose assembly 316 within the housing 312. It is contemplated that the recess 325 may be located on the nose assembly 316 and the engagement projection 327 may be located on the pivoting assembly 323.

Figure 28:
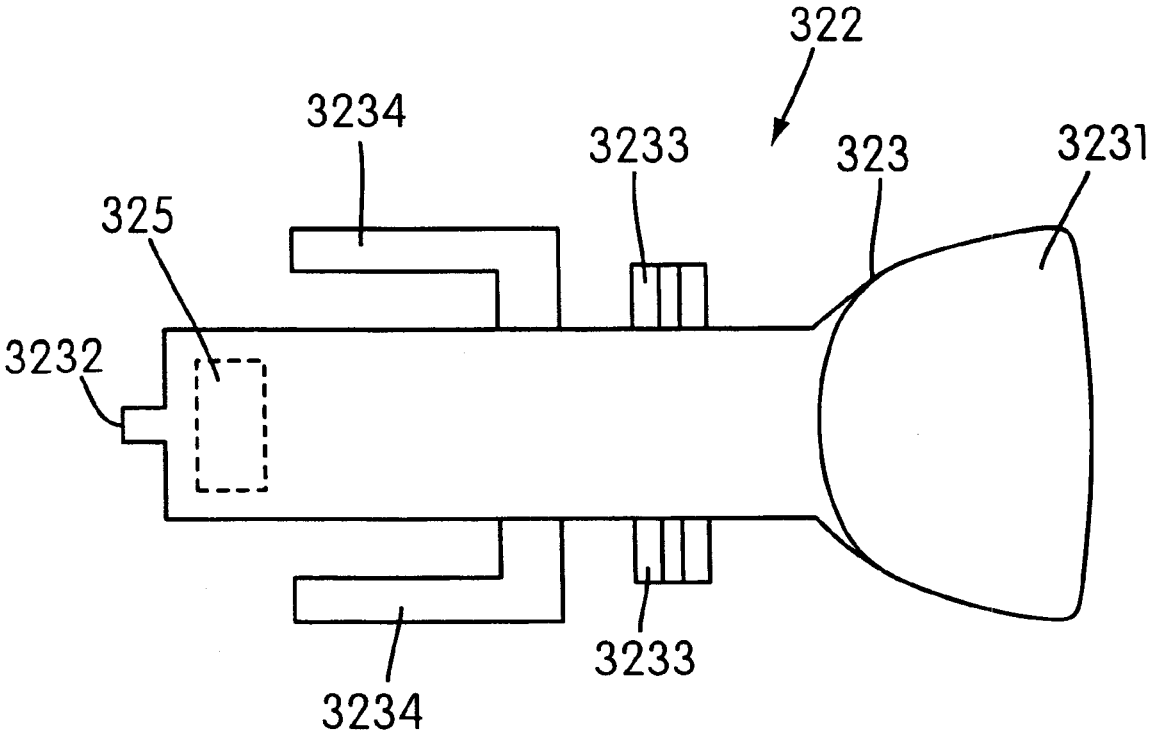
FIG. 28 is an overhead view of the nose releasing assembly in accordance with the embodiment of FIG. 15.
Figure 29:
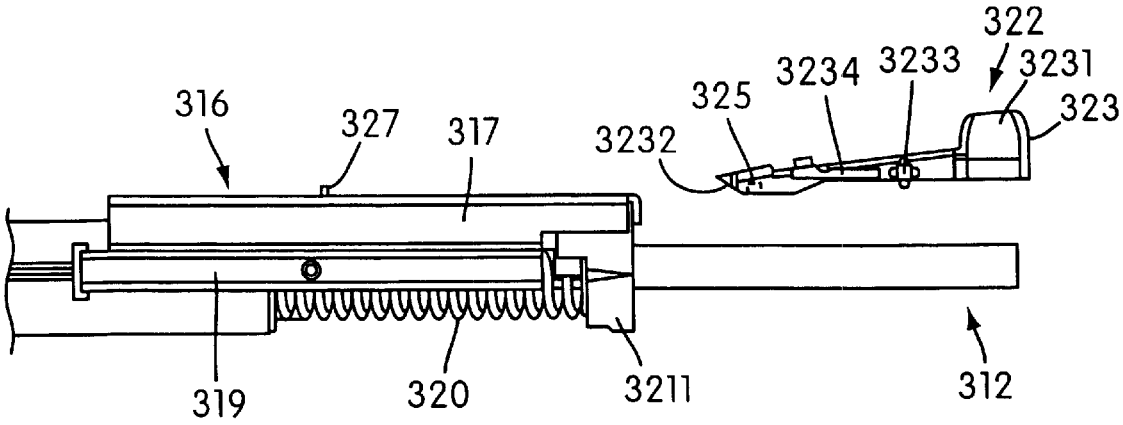
FIGS. 29–32 are schematic views illustrating the operation of the nose releasing assembly of FIG. 15 as the nose assembly is inserted into the housing of the multi-stroke fastening device.
Figure 30:
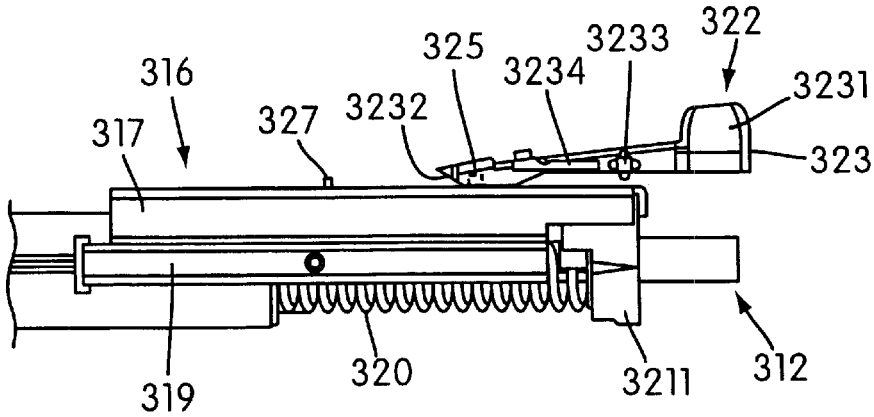
Figure 31:
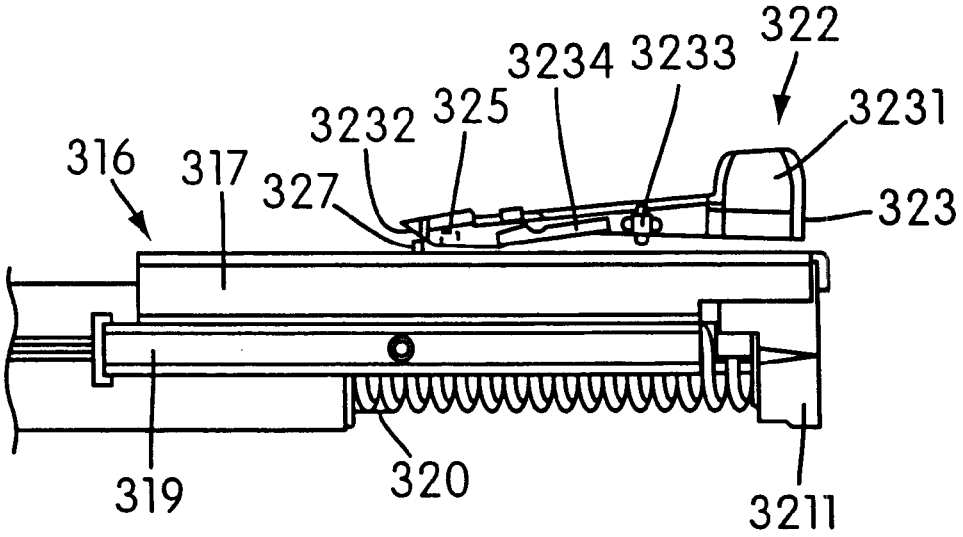
Figure 32:
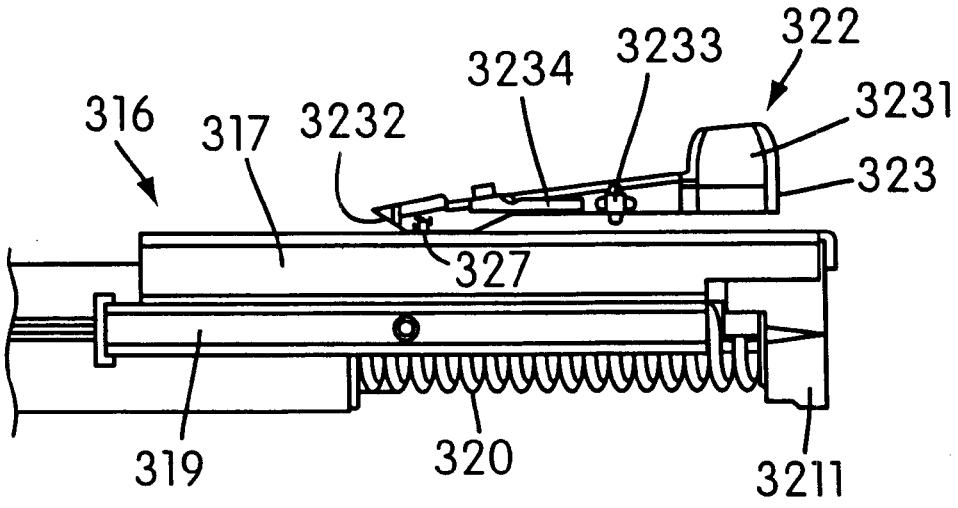

The pivoting assembly 323 is pivotally connected to the housing 312 and includes an actuator assembly 3231. The actuator assembly 3231 extends through an opening in the housing 312 for operating the nose releasing assembly 322 to release the nose assembly 316 from the housing 312. The location of the actuator assembly 3231 permits easy operation by the user (e.g. finger operation) to remove the nose assembly 316 from the housing 312 The pivoting assembly 323 also includes a projection engagement surface 3232 for engaging the engagement projection 327 of the nose assembly 316 as the nose assembly 316 is inserted into the housing 312, whereby the pivoting assembly 323 pivots about an axis, provided by projections 3233 supported by the housing 312, such that the engagement projection 327 is received within the engagement recess 325. The engagement recess 325 is biased into engagement with the engagement projection 327 as shown in FIG. 32 by resilient arm members 3234 extending from the pivoting assembly 323 and positioned on platforms in the housing 312, as shown in FIG. 28.

The nose releasing assembly 322 facilitates removal of the nose assembly 316, without the use of tools, in order to remove jams, or repair the nose assembly 316. This minimizes downtime.

Figure 18:
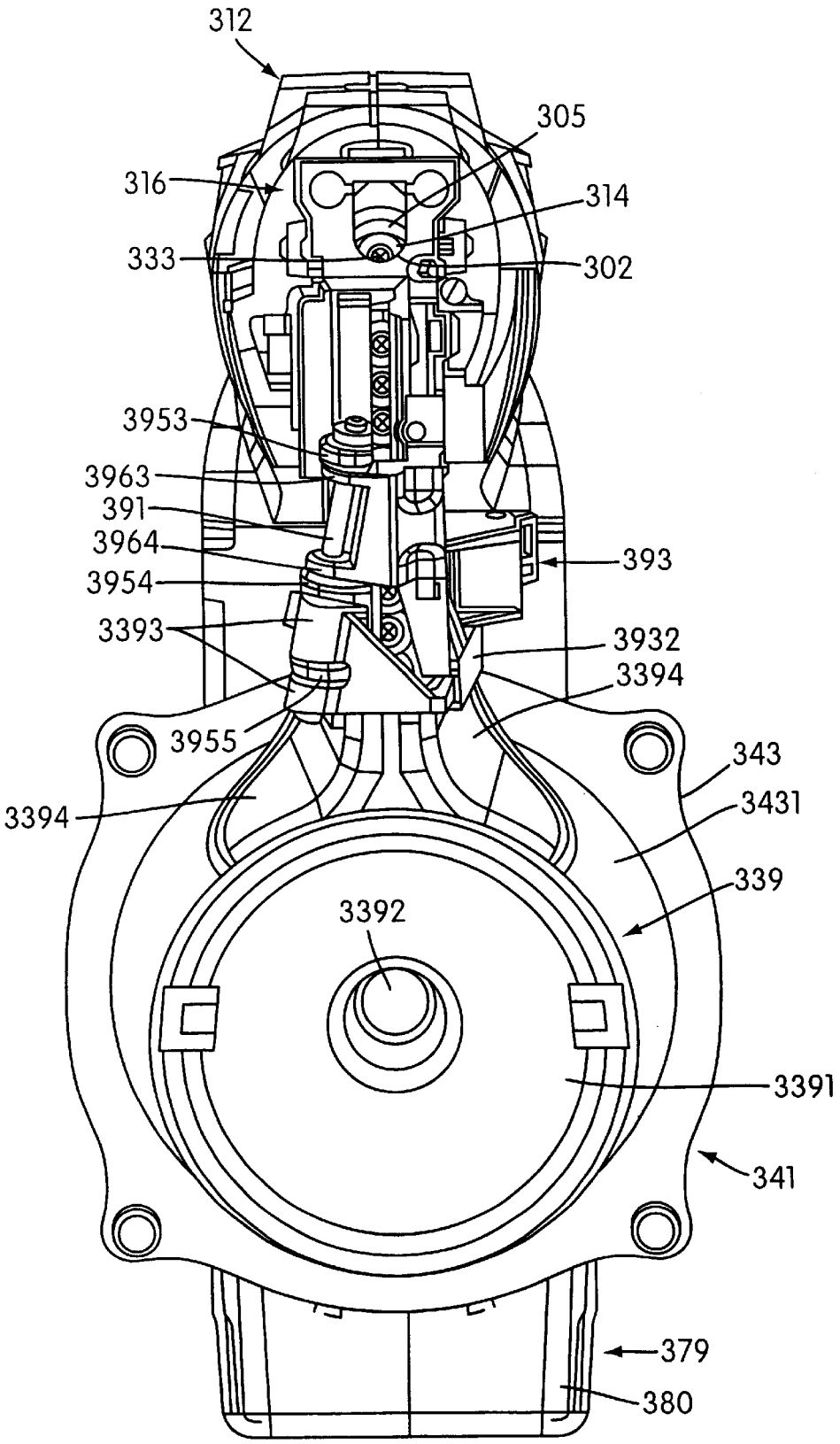
FIG. 18 is an end view of the multi-stroke fastening device of FIG. 15.

The fastener drive track 314 terminates at a generally elliptically-shaped aperture 302 in one end of the nose assembly 316 through which the fastener 333 passes as the fastener 333 is driven into the workpiece W, as shown in FIGS. 17 and 18. The shape of the aperture 302 assists in ensuring the proper orientation of the fastener 333 as the fastener 333 is driven into the workpiece W. The elliptical shape assists to control both horizontal and vertical movement of the fastener 333. The fastener drive track 314 includes an angled guide surface 304 and an upper guide surface 306 adjacent the aperture 302.

The angled guide surface 304, which forms a portion of the bottom surface 315 of the fastener drive track 314, adjusts the orientation of the fastener 333 while the fastener 333 is driven into the workpiece W. Specifically, the angled surface 304 directs the fastener 333 in a generally upward direction as the fastener 333 passes through the fastener drive track 314, as shown in FIGS. 33–40. This tends to counteract the initial downward movement of the fastener 333 due to its connection with the coil of collated fasteners 334, illustrated in FIG. 35. If the fastener 333 is not correctly oriented as it is driven, the fastener 333 may be deformed and/or driven into the workpiece W incorrectly.

Figure 35:
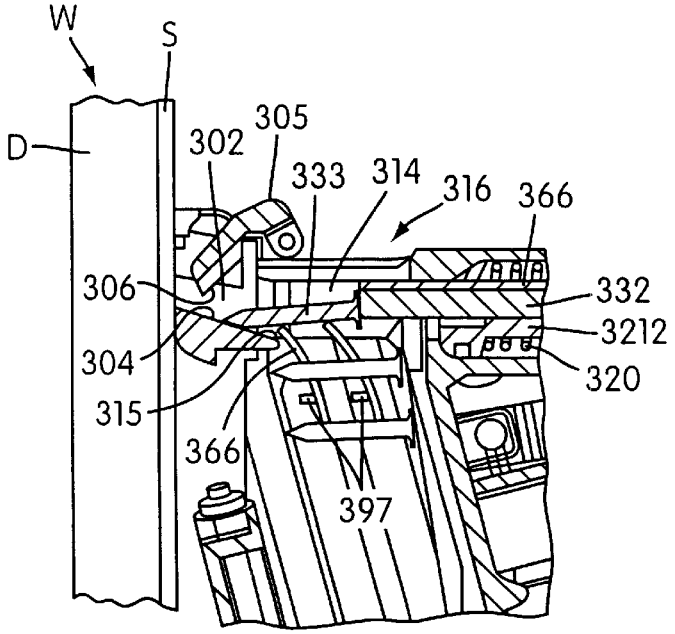
Figure 36:
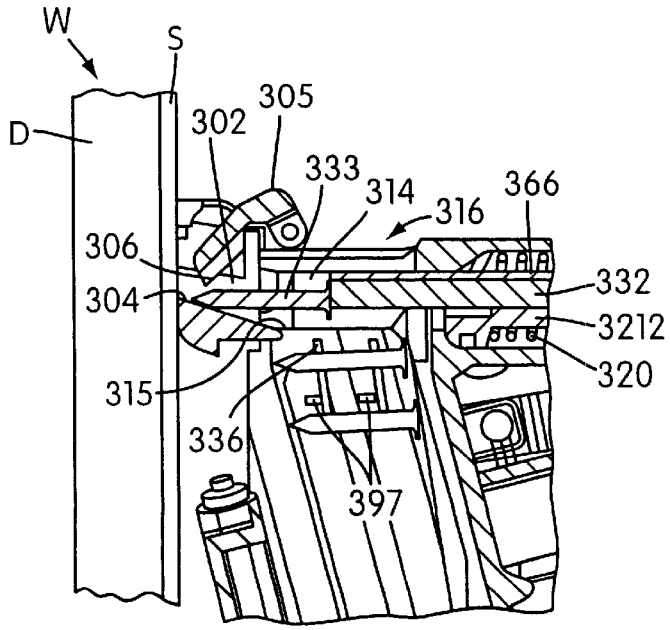
Figure 37:
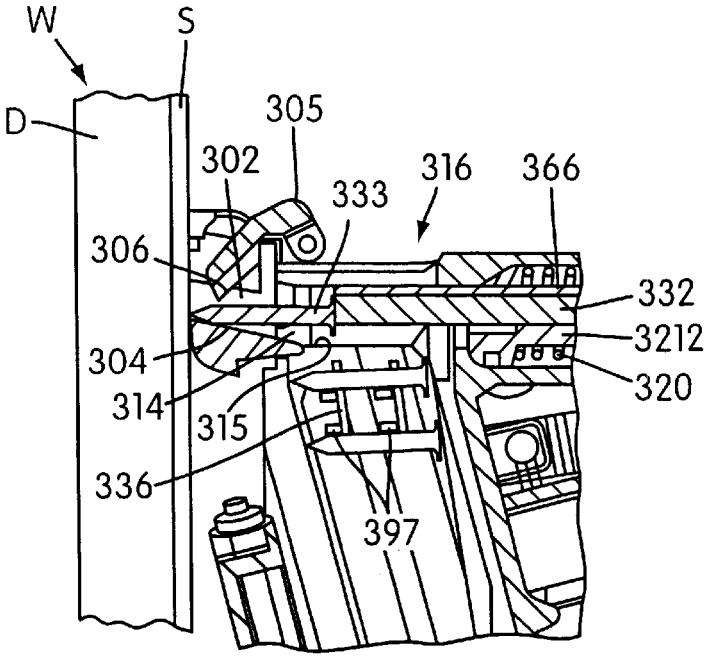

As mentioned above, the interconnection of fasteners 333 by the collation material 336 causes the fastener 333 to pivot about the collation connection with an adjacent fastener in a generally downwardly direction, as shown in FIG. 35. The fastener 333 engages the angled surface 304 and is directed towards the center of the drive track 314. The collation material 336 fractures as the fastener 333 is continually driven. Further, as the fastener 333 travels up the angled surface 304 to the aperture 302 where it exits, relative movement occurs between the driver member 332 and the fastener 333. The fastener 333 slightly crosses over the fastener driving axis of the driver member 332 as it exits from the aperture 302.

Figure 47:
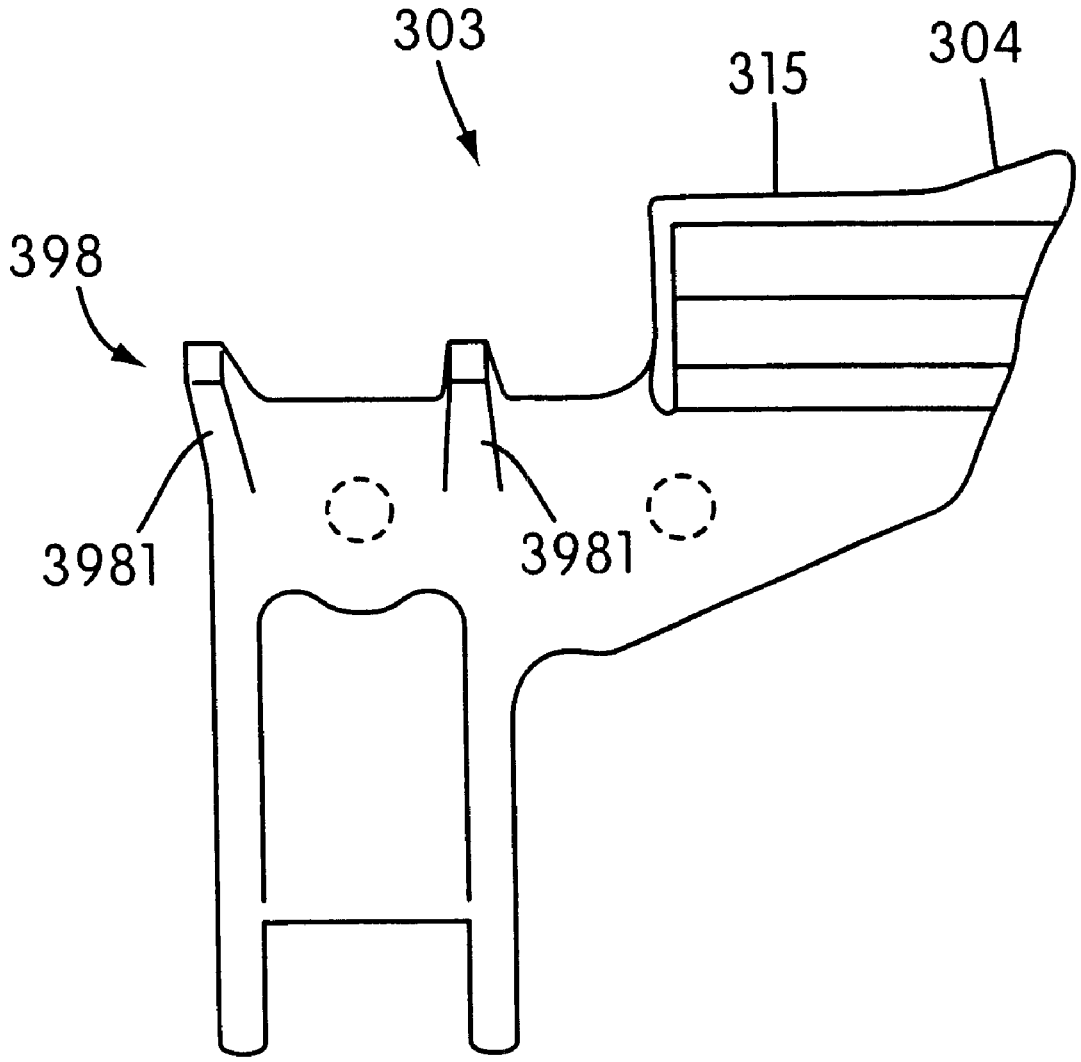
FIG. 47 is a schematic view illustrating the construction of the locking mechanism and the angled guide surface in accordance with the present invention.

A portion of the angled guide surface 304 is located on a pivoting assembly, generally shown at 303 in FIG. 47, which is part of the feed assembly 392 for feeding the fastener 333 into the fastener drive track 314, as will be discussed. This portion of the angled guide surface 304 pivots away from the fastener drive track 314 while the fastener 333 is being loaded into the fastener drive track 314 by the feed mechanism 392. Further, because a portion of the angled guide surface 304 is located on the pivoting assembly 303, the nose assembly 316 can be more compact.

Figure 38:
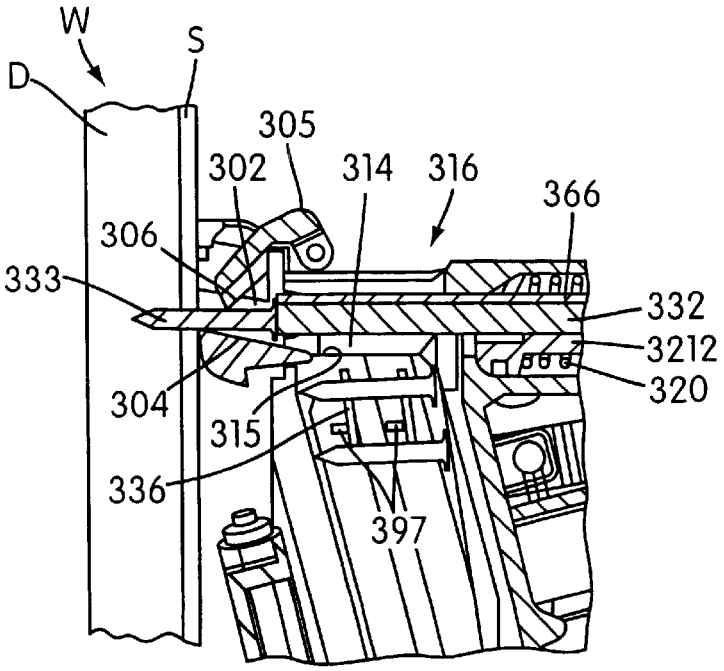
Figure 39:
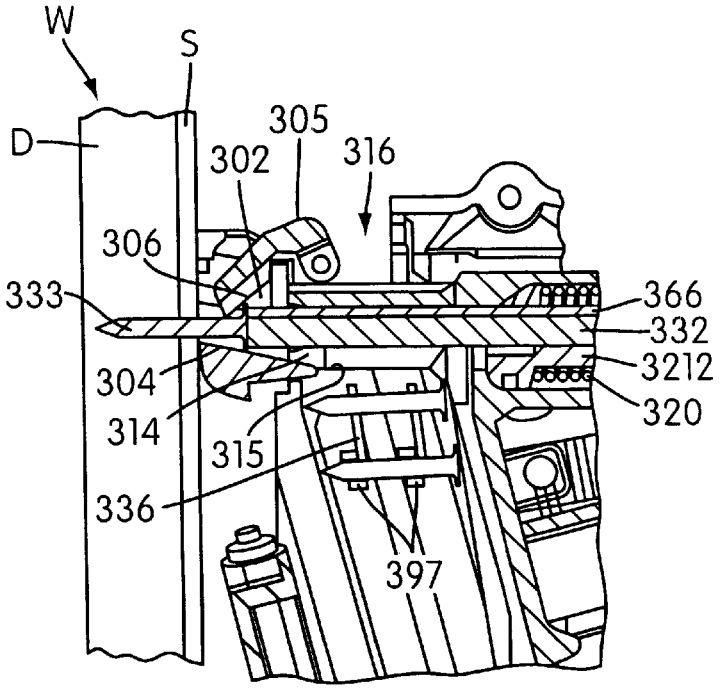
Figure 40:
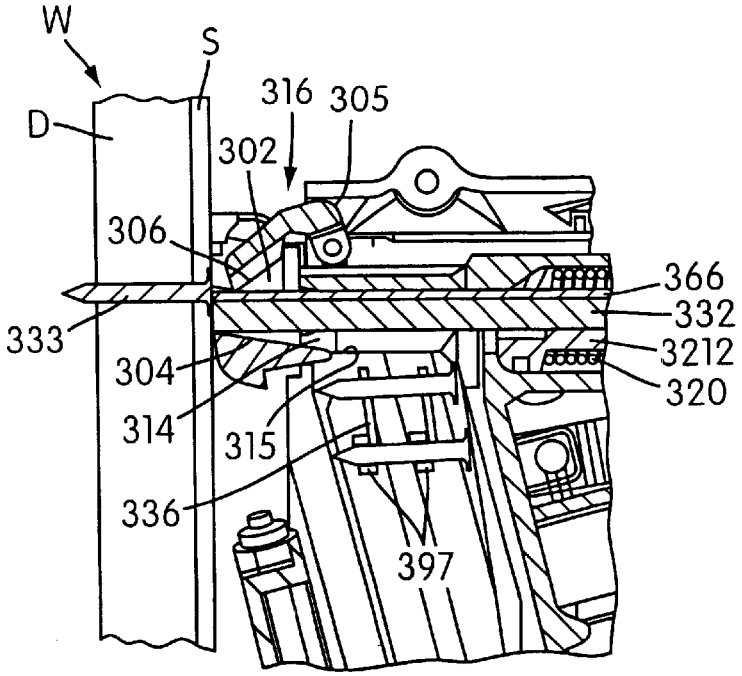
Figure 41:
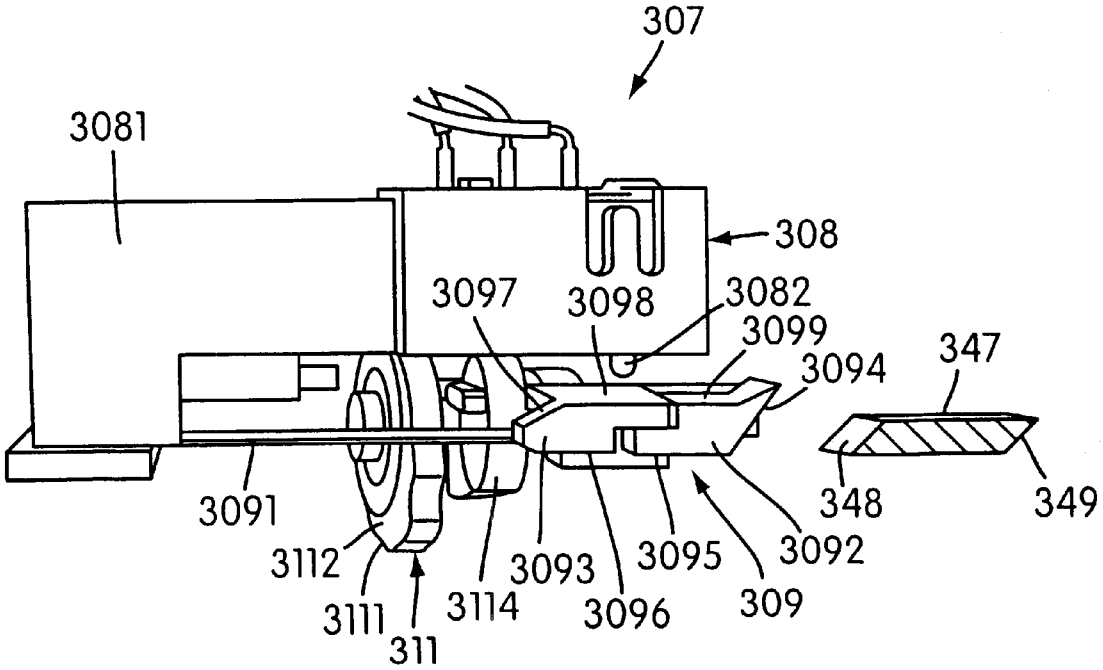
FIGS. 41–46 are schematic views illustrating the operation of the energy control assembly of the multi-stroke fastening device of FIG. 15 as the nose assembly retracts into the housing as the fastener is driven into the workpiece.

The upper guide surface 306 is provided on an upper guide member 305 which is pivotally attached to the nose assembly 316 and partially covers the aperture 302 during predetermined operating conditions, as shown in FIGS. 33–40. The upper guide surface 306 pivots away from the aperture 302 when contacted by the fastener and fastener head engaging structure 366 in response to compression of the nose assembly 316 as the fastener 333 is driven into the workpiece W, as shown in FIGS. 38–40. Further, the upper guide surface 306 guides the fastener 333 to the center of the drive track 314 in response to the upward travel of the fastener 333 as it moves along the angled surface 304. It is contemplated that the upper guide surface 306 may form an upper surface of the aperture 302.

Figure 33:
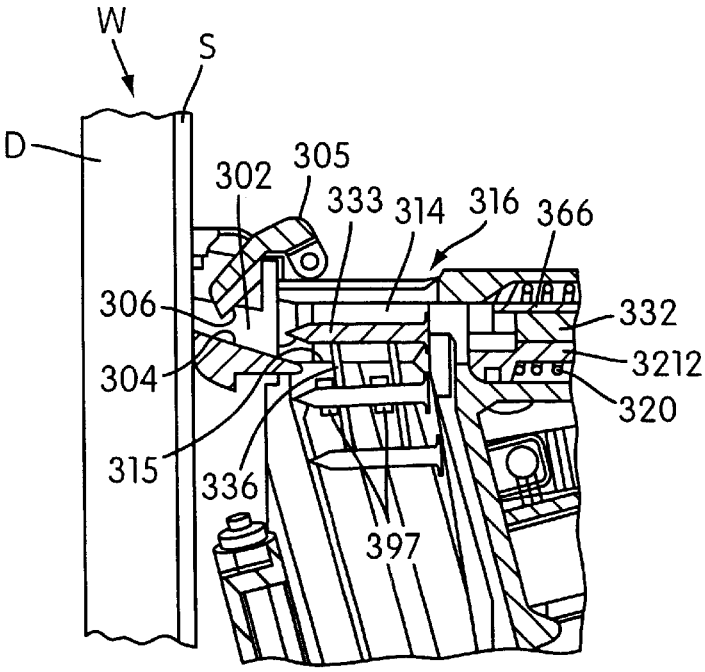
FIGS. 33–40 are partial cross-sectional views illustrating the operation of the angled guide surface and pivoted guide surface of the nose assembly as the fastener is driven into the workpiece by the multi-stroke fastening device in accordance with the present invention.
Figure 34:
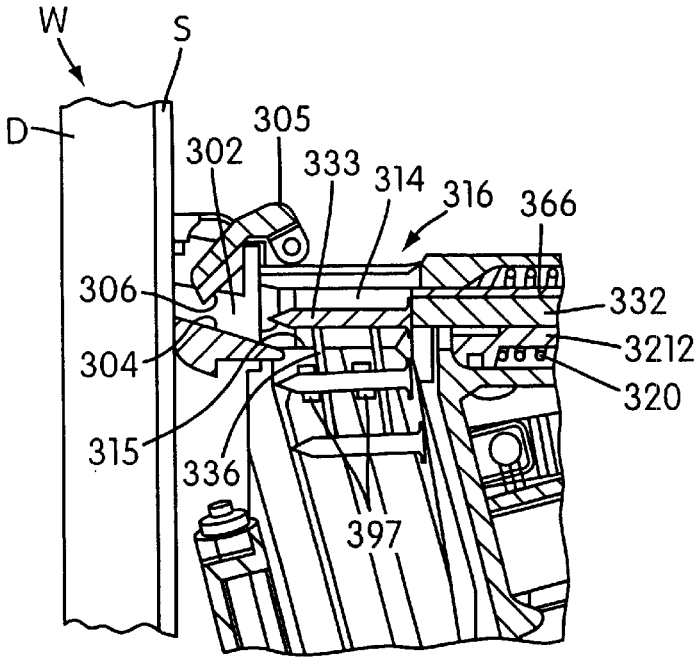

The pivoted guide surface 306 is disposed in opposing relation to the angled surface 304. The pivoted guide surface 306 being biased towards a first position wherein the pivoted guide surface 306 is disposed adjacent to the angled guide surface 304, as shown in FIGS. 33 and 34, so that the pivoted guide surface 306 and the angled guide surface 304 form a fastener outlet which is dimensioned to be smaller than a head of the fastener 333, as shown in FIG. 18. The head of a fastener 333 engage the pivoted guide surface 306 as the fastener is being driven so as to force the pivoted guide surface 306 away from the angled guide surface 304 against a spring bias to enable the outlet to be sufficiently sized to permit the fastener head to pass therethrough. The angled guide surface 304 and the pivoted guide surface 306 guidably engage the head as the head passes thereby.

The nose assembly 316 must be progressively retracted into the housing 312 against the bias of the spring assembly 320 in order to activate the motor 374 to operate the driver assembly 330. The retracting action is largely a result of the forward manual force applied by the operator. Moreover, because the device 300 is preferably used for roofing applications and the nose assembly 316 is always pointing downwardly, the weight of the device 300 also assists in movement of the nose assembly 316 into the housing 312 against the force of the spring assembly 320. The workpiece W, in typical roofing applications, generally consists of roofing shingle S and decking D, such as plywood. The fasteners 333 are used to secure the shingle S to the decking D.

Specifically, the motor 374 is switched on and off by a control circuit 358, which includes a trigger switch 359, that is activated by a manually actuated trigger 378, and also includes an energy control assembly, generally shown at 307. The control circuit 358 is connected with the motor 374. Both the trigger switch 359 and the energy control assembly 307 must be actuated in order to operate the device 300.

The energy control assembly 307 illustrated in FIGS. 16, 19–26 and 41–46 terminates the supply of power from the power source 379 to the driver assembly 330 after a predetermined travel of the nose assembly 316. The energy control assembly 307 includes a switch assembly, generally shown at 308. The nose assembly 316 includes a nose actuating assembly 347 for actuating the switch assembly 308 at predetermined operating conditions of the fastening device 300. The energy control assembly 307 further includes a switch activating assembly, generally shown at 309, for actuating the switch assembly 308. The switch activating assembly 309 is adjustable for adjusting the predetermined operating conditions, such as the depth of the fastener 333 within the workpiece W.

The energy control assembly 307 controls the operation of the fastening device 300. The switch 308 is actuated by the nose actuating assembly 347 in response to the nose assembly 316 being moved a selected distance inwardly with respect to the 312 housing, as shown in FIGS. 41–46. The switch activating assembly 309 is constructed and arranged to adjust the actuating position of the switch 308. Adjustment of the switch activating assembly 309 adjusts the selected distance which the nose assembly 312 must move before operation of the fastening device 300 is termianted.

The nose actuating assembly 347 is in slidable contact with the switch activating assembly 309 and contacts the switch activating assembly 309, as the nose assembly 316 is retracted into the housing 312, to operate the switch assembly 308 after the nose assembly 316 has traveled a selected distance.

The nose actuating assembly 347 has first and second ramping surfaces 348, 349 at opposing ends thereof, as shown in FIGS. 41–46. The switch activating assembly 309 includes a resilient elongated member 3091 having a camming portion 3092 fixed at one end with the opposite end mounted to a base 3081 of the switch assembly 308. The switch activating assembly 309 further includes an adjustable camming portion 3093 that is slidably mounted on the elongated member 3091. The adjustable camming portion 3093 is operatively connected with an adjuster assembly, generally shown at 311.

The adjuster assembly 311 adjusts the position of the switch activating assembly 309 relative to the switch assembly 308, which adjusts the predetermined operating conditions. Adjustment of the adjuster assembly 311 adjusts the duration of contact between the nose actuating assembly 347 and the switch activating assembly 309. The adjuster assembly 311 includes an actuator 3111, wherein a head portion 3112 of the actuator 3111 extends through an opening in the housing 312. The actuator 3111 further includes a shank portion 3113 integrally formed with the head portion 3112, wherein the shank portion 3113 has a spiral groove. One end of a connecting member 3114 is engaged with the spiral groove such that rotation of the head portion 3112 moves the connecting member 3114 longitudinally along the shank portion 3113. The opposite end of the connecting member 3114 is connected with the adjustable camming portion 3093, whereby longitudinal movement of the connecting member 3114 slidably moves the adjustable camming portion 3093 along the elongated member 3091.

The retracting action of the nose assembly 316 also functions to operate the feed assembly 392. The feed assembly 392 shown in FIGS. 16, 19–25, 27 and 48–52 is operatively connected to the nose assembly 316 for advancing the fastener 333 into the fastener drive track 314 in response to compression of the nose assembly 316 to enable successive fasteners 333 to be struck by the driver assembly 330. The feed assembly 392 is constructed and arranged to advance a lead fastener 333 of a coil of collated fasteners 334 in response to manually generated movement of the nose assembly 316 into the housing 312.

Figure 24:
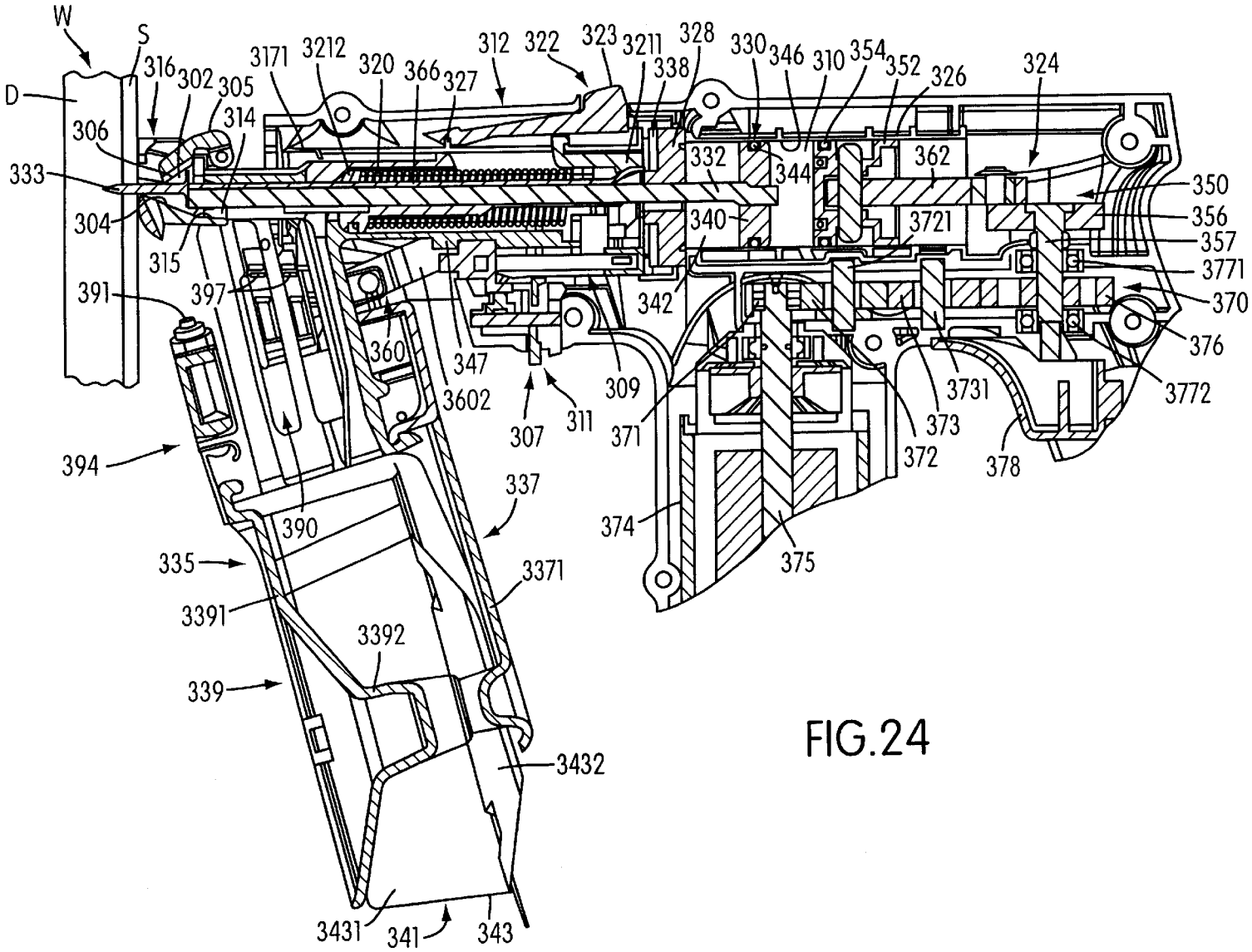
Figure 25:
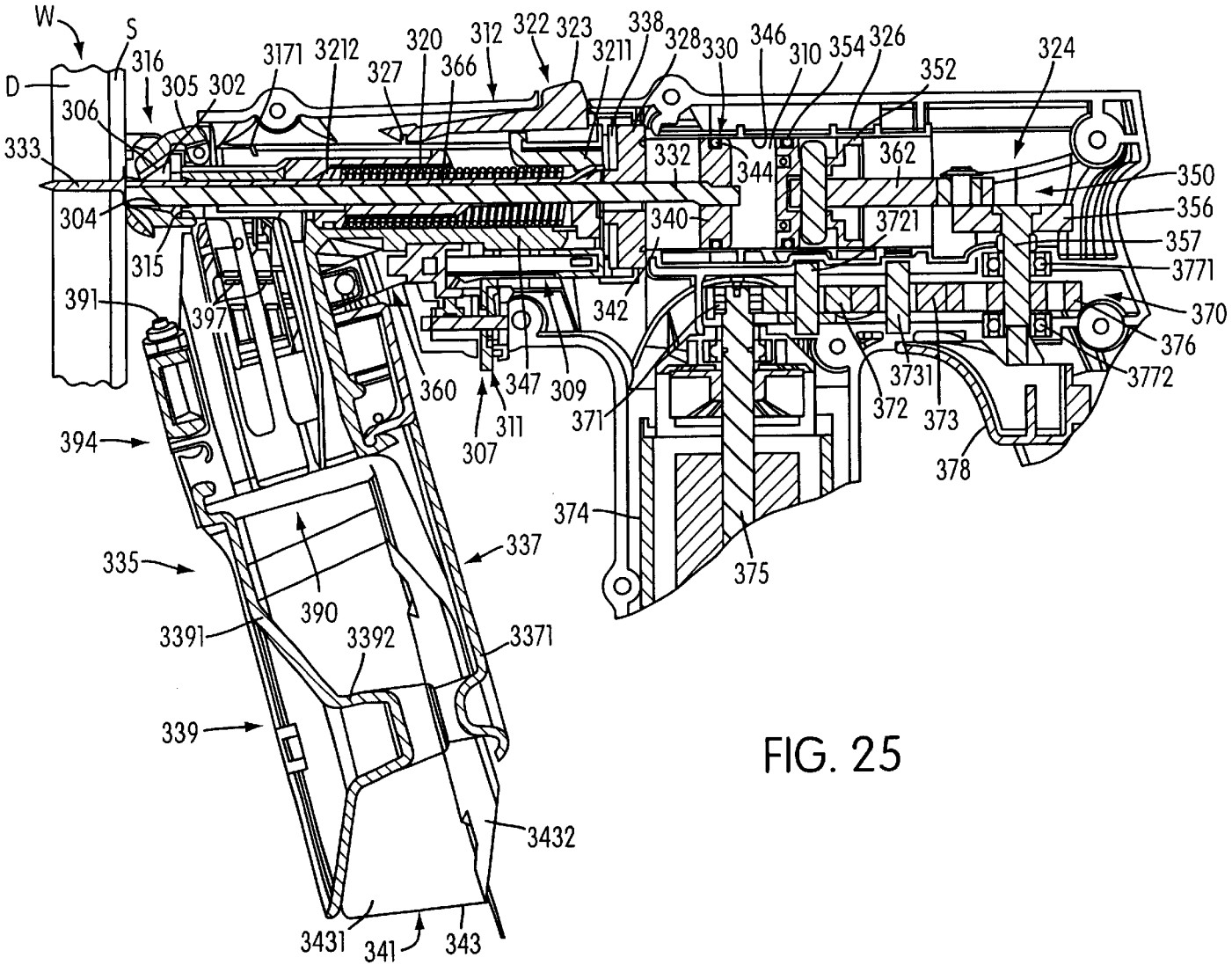
Figure 27:
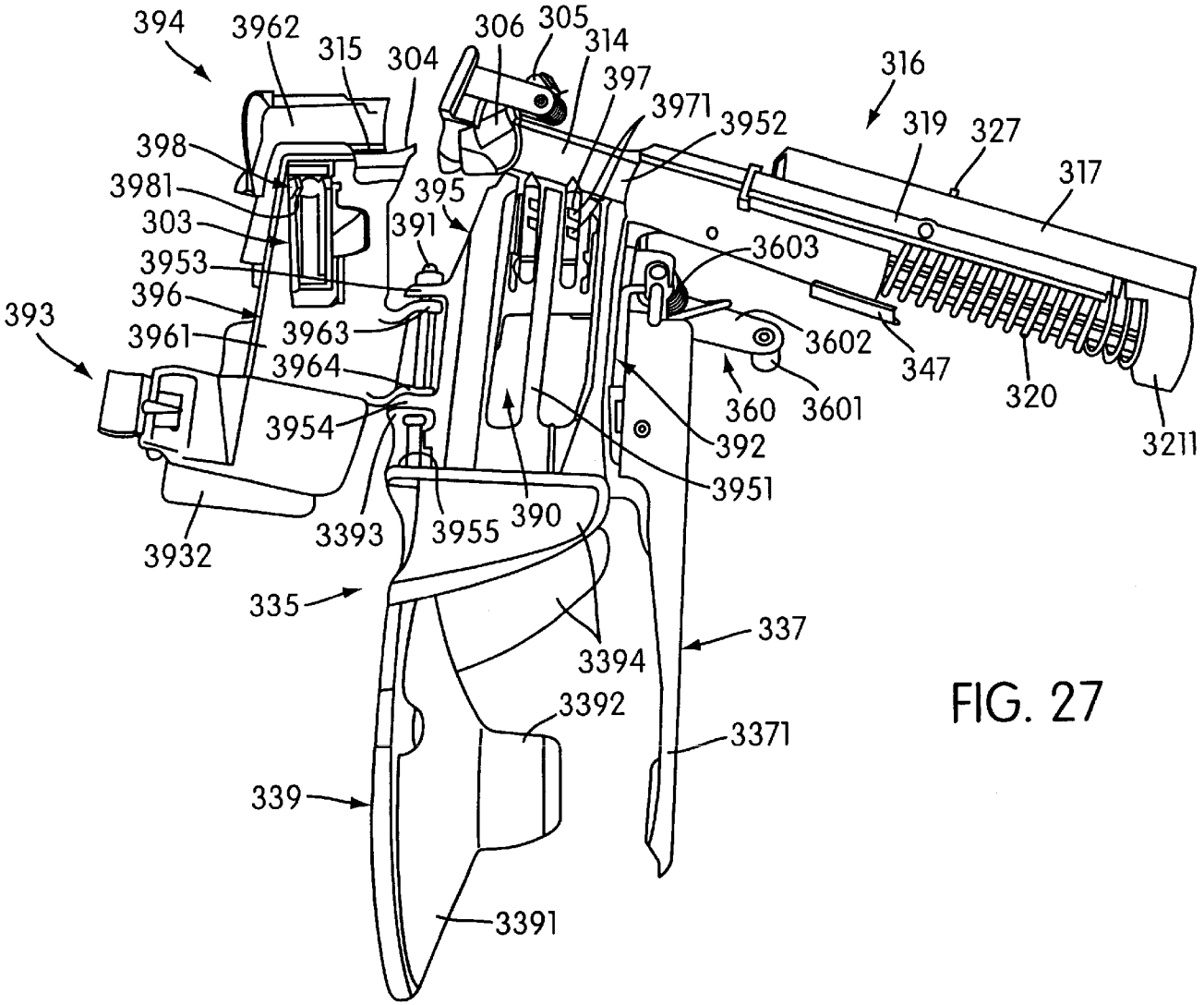
FIG. 27 is a schematic view of the nose assembly and feed assembly of the multi-stroke fastening device of FIG. 15 removed from the housing of the multi-stroke fastening device and in an open position.

The feed assembly 392 comprises a feed assembly housing, generally shown at 394, having a first housing part 395 and a second housing part 396 pivotally connected to one another. The second housing part 396 is pivotal between an open position as shown in FIG. 27 and a closed position as shown in FIGS. 24 and 25. The first housing part 395 and second housing part 396 form a feed path 390 along which the fastener 333 is advanced to the fastener drive track 314. Specifically, the first housing part 395 has a feed path defining portion 3951 and a drive track defining portion 3952. Likewise, the second housing part 396 has a feed path defining portion 3961 and a drive track defining portion 3962. When the second housing part 396 is moved to the closed position, interior surfaces of the drive track defining portions 3952, 3962 cooperate to define the drive track 314. Further, interior surfaces of the feed path defining portions 3951, 3961 cooperate in spaced apart relation to define the feed path 390.

The second housing part 396 has a pair of flanges 3963, 3964 with a pivot pin receiving opening formed therethrough, as shown in FIG. 27. The first housing part 395 has flanges 3953, 3954, 3955 with pivot pin receiving openings formed therethrough. The second housing part 396 is pivotally connected to the first housing part 395 by aligning the pivot pin receiving openings of flanges 3953, 3954, 3963, 3964 and inserting an elongated pivot pin 391 therethrough. The pivot pin 391 extends past the flange 3955 in order to further secure a fastener supply attachment assembly 335, as will be discussed.

An advancing assembly 360 is secured to the first housing part 395 and is operatively connected to the housing 312. More specifically, the advancing assembly 360 includes a follower 3601, or also referred to as a roller, as shown in FIG. 16, which is rotatably mounted on one end of a fastener feed pawl 3602 that extends into the housing 312 so that the follower 3601 engages a first surface 3611 provided by a track 361 mounted within the housing 312. An intermediate portion of the feed pawl 3602 is pivotally connected on a shaft supported by a portion of the first housing part 395. The opposite end of the feed pawl 3602 is connected to a gripping arm housing 3604 which is slidably received on guide portions 3956 of the first housing part 395. A torsion spring 3603 biases the feed pawl 3602 and hence the gripping arm housing 3604 to a rest position at an upper portion of the guide portions 3956, which positions the follower 3601 into engagement with the first surface 3611.

The feed assembly 392 includes at least one gripping arm 397 pivotally connected to the gripping arm housing 3604 of the advancing assembly 360. Each gripping arm 397 includes a fastener receiving portion 3971, that extends into the feed path 390, and is sized to receive at least a portion of the fastener 333, preferably the shank, for engaging and advancing the fastener 333 along the feed path 390. The fastener receiving portions 3971 are biased by a spring into the feed path 390.

Figure 48:
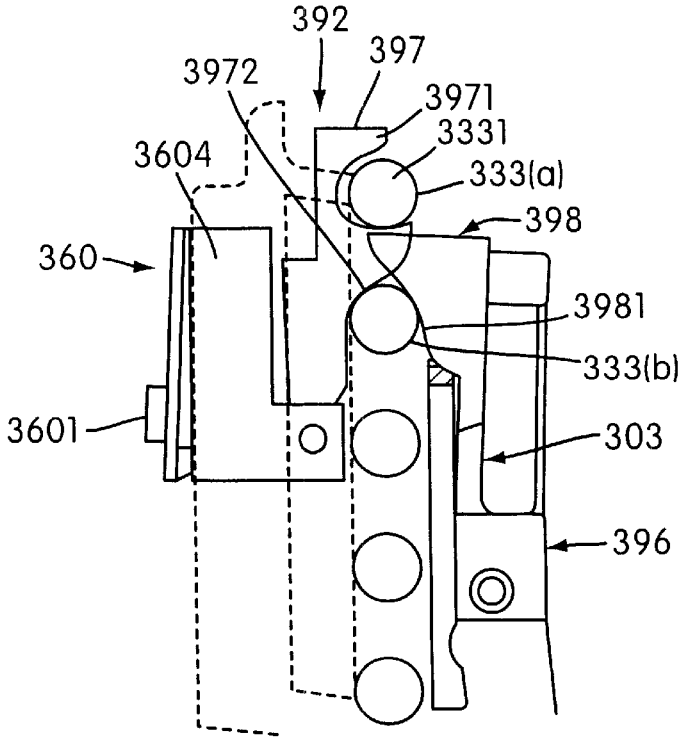
FIGS. 48–52 are schematic views illustrating the operation of the gripping arms and locking mechanism of the feed assembly of the multi-stroke fastening device of FIG. 15 as the fastener is driven into the workpiece and subsequent fastener is fed into the fastener drive channel.
Figure 49:
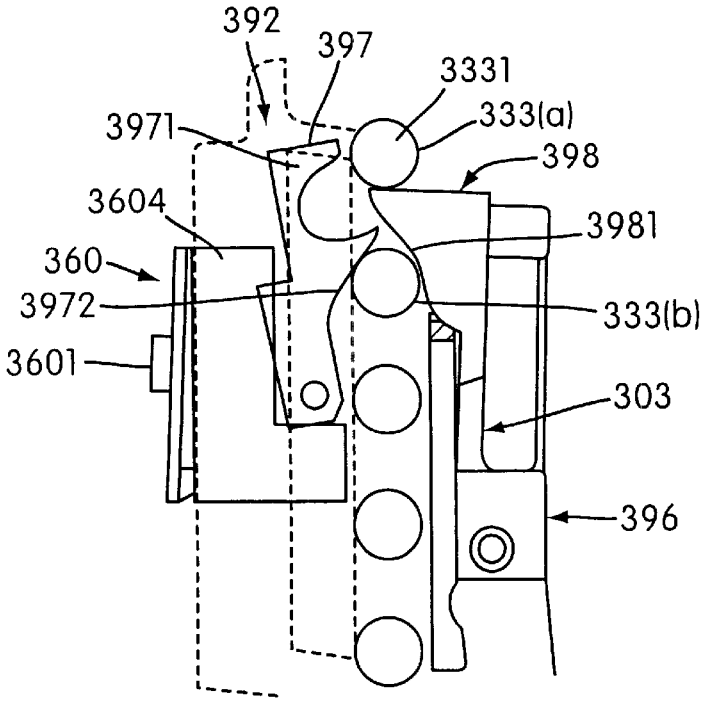
Figure 50:
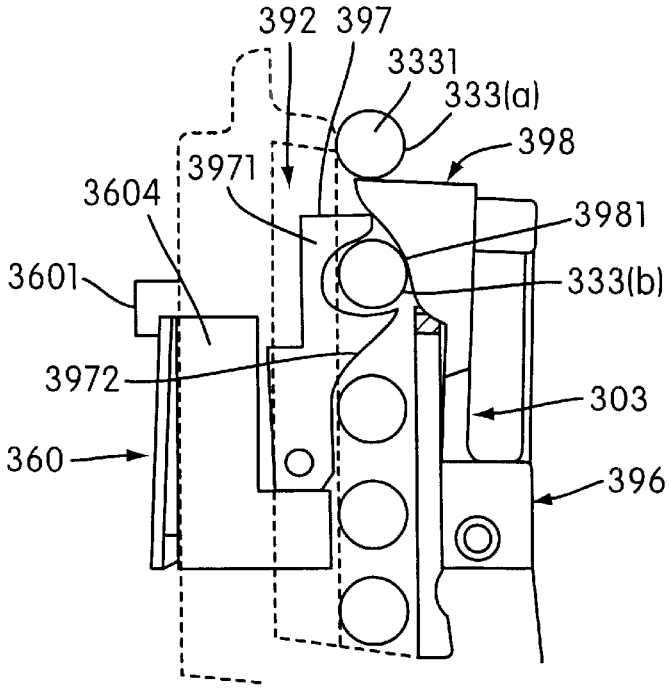

The feed assembly 392 further includes a locking mechanism 398 located within the feed path 390, wherein the locking mechanism 398 prevents movement of the fasteners 333 within the feed path 390 as the gripping arms 397 travel from the rest position to an advancing position, as shown in FIGS. 48–50. The locking mechanism 398 is located on a side of the feed path 390 opposite the gripping arms 397 and is pivotally connected to the second housing part 396.

A portion of the bottom surface 315 is operatively connected to the locking mechanism 398. This portion of the bottom surface 315 retracts from the fastener drive track 314 when the locking mechanism 398 is released. The release of the locking mechanism 398 permits the individual fasteners 333 to advance along the feed path 390 to the fastener drive track 314. Specifically, the bottom surface 315 and the locking mechanism 398 are integrally formed together in the pivoting assembly 303, as shown in FIG. 47. The pivoting assembly 303 is pivotally mounted on a shaft supported by the second housing part 396 and is biased into the feed path 390 by a spring assembly or biasing assembly. The portion of the bottom surface 315 also includes a portion of the angled surface 304 for adjusting the position of the fastener 333 as the fastener 333 is advanced through the fastener drive track 314 into the workpiece W. The operation of the feed assembly 392 will be described in greater detail below.

The feed assembly 392 further comprises a releasable latch assembly 393 connected to the second housing part 396 for releasably securing the second housing part 396 to the first housing part 395, as shown in FIGS. 18 and 19.

The fastener supply attachment assembly 335 is pivotally connected to the first housing part 395 and operatively coupled to the second housing part 396, as shown in FIG. 16, wherein the fastener supply attachment assembly 335 is adapted to receive a coil of collated fasteners. The fastener supply attachment assembly 335 is aligned with the feed path 390, such that the fasteners from the supply of fasteners are directed into the feed path 390.

Specifically, the attachment assembly 335 has a pair of engaging members 337, 339. Engaging member 337 has a rigid arm 3371 depending downwardly from the first housing part 395 and fixed thereto by fasteners, as shown in FIGS. 19–24. Engaging member 339 has a disc-shaped structure 3391 with a projection 3392 projecting from one side of the center. Engaging member 339 is pivotally connected to the second housing part 396 by C-shaped clamps 3393 which are secured to the pivot pin 391 with a snap action. This enables the engaging member 339 to be removed and replaced in the event of damage, etc. Further, the fastener supply attachment assembly 335 is coupled to the second housing part 396 such that pivoting of the engaging member 339 causes the second housing part 396 to pivot. Specifically, one of a pair of container orienting walls 3394 is positioned to engage a body portion 3932 of the latch assembly 393, such that during pivoting movement away from the rigid arm 3371 the wall 3394 engages the body portion 3932 and causes the second housing part 396 to pivot. Likewise, when the second housing part 396 is pivoted into engagement with the first housing part 395, the body portion 3932 of the latch assembly 393 engages the wall 3394 and causes the attachment assembly 335 to pivot.

A dispensing assembly, generally shown at 341 and illustrated in FIG. 53, or collation carrying structure, is provided for dispensing the coil of collated roofing nails 334. The dispensing assembly 341 comprises a housing 343 sized to receive the coil of collated roofing nails 334 therein. The housing 343 includes a cup-shaped container portion 3431 and a cover member 3432. An opening is provided in the housing 343 for dispensing the coil of collated roofing nails 334, wherein the opening is aligned with the feed path 390 by the walls 3394.

The housing 343 includes a recess 3433 adapted for securing the dispensing assembly 341 to the attachment assembly 335. The recess 3433 forms a projection extending into an interior of the housing 343, wherein the coil of collated roofing nails 334 extends around the projection within the interior of the housing 343.

To mount the dispensing assembly 341 on the attachment assembly 335, the engaging member 339 is moved to an open position which also moves the second housing part 396 to an open position, as described above. The recess 3433 is aligned with the projection 3392 such that the dispensing assembly 341 may be moved onto the attachment assembly 335, with the opening in the housing 343 received between the walls 3394. The engaging member 339 is pivoted towards engaging member 337 to a closed position as shown in FIG. 16 with the second housing part 396 remaining in the open position. The dispensing assembly 341 is secured to the attachment assembly 335 in a generally sandwich-like relationship with the cover 3432 engaging against the rigid arm 3371 of engaging member 337. The leading fastener 333 of the coil of collated fasteners 334 is positioned in the drive track 314 with the gripping arms 397 of the feed mechanism 392 providing support. Additional fasteners 333 are positioned in the feed path 390, as shown for example in FIG. 16. Then, the second housing part 396 is moved to the closed position, which places the device 300 in condition for a fastening operation.

The removable mounting described above allows the dispensing assembly 341 to be removed for fastener replenishment. Fastener replenishment is accomplished by providing and mounting a dispensing assembly 341 with a full coil of collated fasteners 334. Alternatively, a new supply of collated fasteners 334 may be loaded into the existing dispensing assembly 341.

It is contemplated that the dispensing assembly 341 may also be replaced with an attachment assembly wherein the engaging member 339 has an annular wall enclosing the disc-shaped structure 3391. Conventional fasteners may be loaded separately into the attachment assembly. The snap action feature of the C-shaped clamps 3393 of the attachment assembly facilitates assembly of any contemplated attachment assembly.

As described above, it has been found that coated fasteners are especially useful in connection with the operation of the fastening device 300 or any of the other devices described above where reductions in power consumption are desired. The coating facilitates insertion of the fasteners 333 into the workpiece W, which results in an overall reduction in power consumption. Each of the nails, or also referred to as fasteners 333, of the coil of collated roofing nails 334 has a shank portion 3331 with a shank diameter of about 0.120"±0.0015" and a head portion 3332 with a head diameter of about 0.350"–0.438". The head diameter is preferably about 0.354"–0.384".

Moreover, each of the nails 333 is coated with a thermoplastic material 3333 that serves as a lubricant which facilitates driving of the nails 333 into a workpiece W so as to reduce the energy required to drive the nails 333 into the workpiece W. Thus, battery power can be conserved resulting in increased battery life. Since less energy or force is required to drive the nails 333, wear to the striker assembly 324 is reduced which increases the life of the device 300 as well. Further, the thermoplastic coating acts as an adhesive after the nails 333 are driven into the workpiece W, which increases the strength of connection.

Each of the nails 333 is preferably formed from steel or stainless steel. Other materials having similar physical properties are considered to be well within the scope of the present invention. The collation material 336 includes at least one flexible wire 3361 that interconnects the plurality of collated roofing nails 334. In the embodiment shown, two flexible wires 3361 are used. The flexible wires 3361 are secured to a portion of the shank portion 3331, by spot-welding or use of an adhesive. The wires 3361 fracture as one of the collated nails is driven into the workpiece W.

Figure 21:
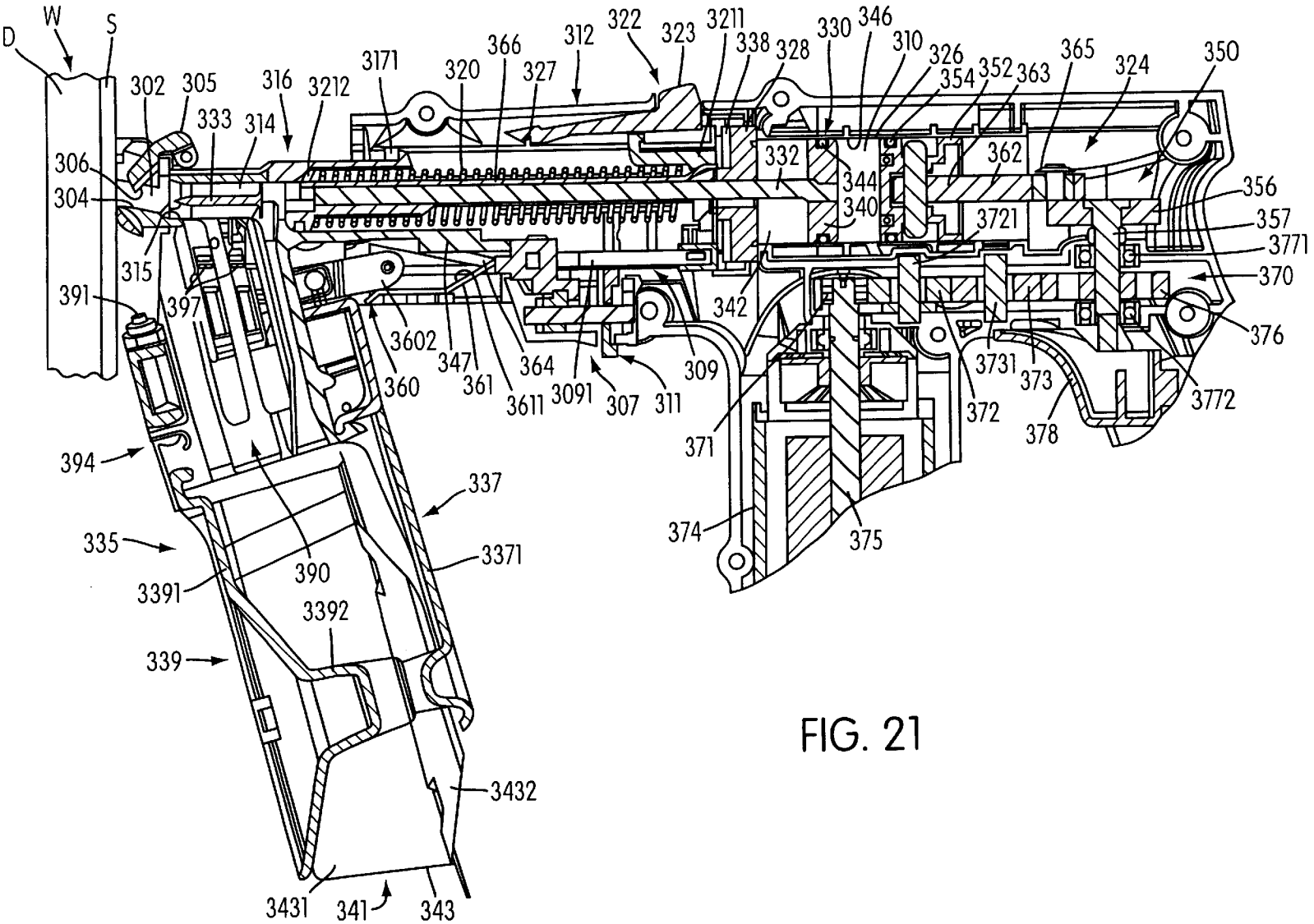
FIG. 21 is a cross-sectional view of the multi-stroke fastening device of FIG. 15 in a reset position.
Figure 22:
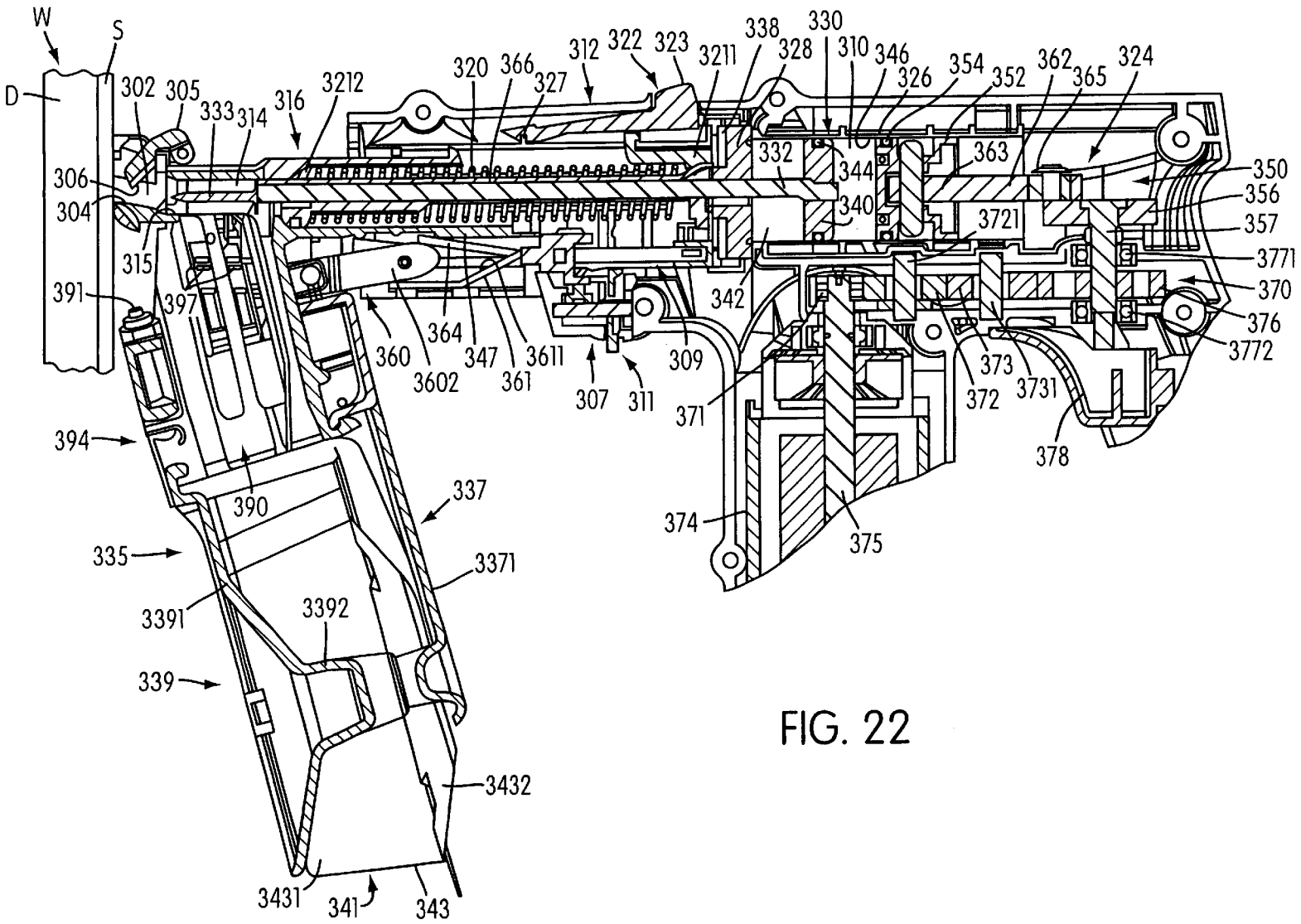
FIGS. 22–25 are cross-sectional views of the multi-stroke fastening device of FIG. 15 illustrating the operation of driving a fastener into the workpiece.
Figure 42:
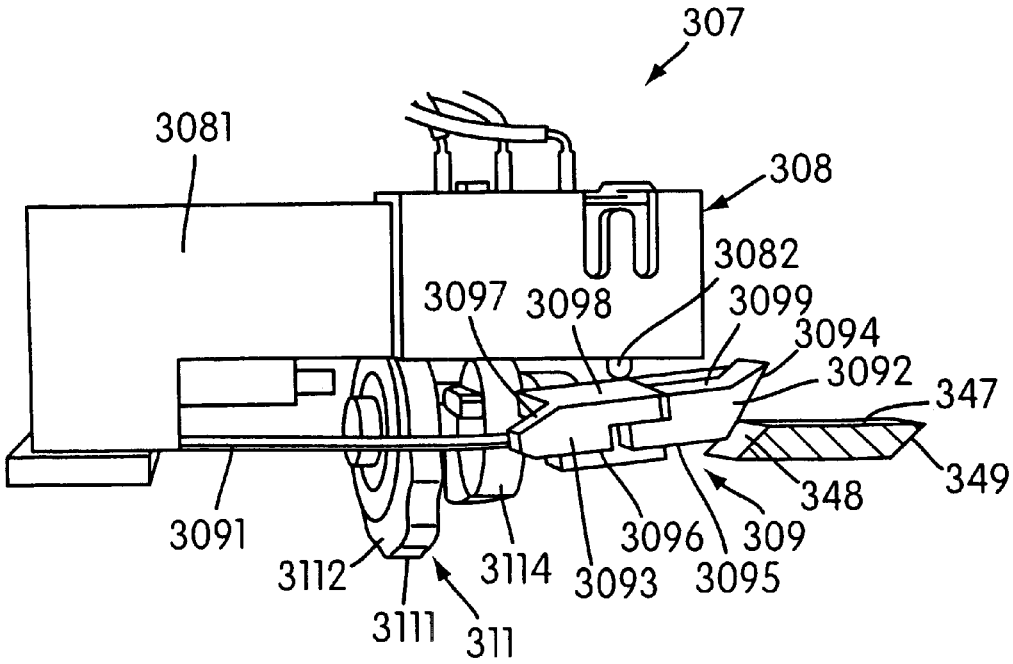

The operation of the fastening device 300 will now be described in greater detail. First, the operator manually grasps the device 300 about a gripping portion of the housing 312 and positions his/her finger on the trigger 378. Then, the nose assembly 316 is positioned into engagement with the workpiece W, as shown in FIG. 21. The operator provides a suitable amount of pressure on the device 300 to retract the nose assembly 316. The nose assembly 316 must be progressively retracted into the housing 312 in order to activate the motor 374 to operate the driver assembly 330. As mentioned above, both the trigger switch 359 and the energy control assembly 307 must be actuated in order to operate the device 300. As the nose assembly 316 is retracted into the housing 312 with the trigger 378 being depressed by the operator, the first ramping surface 348 of the nose actuating assembly 347 contacts a camming surface 3094 of the camming portion 3092 which moves the switch activating assembly 309 into contact with an activating button 3082 of the switch assembly 308 to actuate the switch assembly 308, as shown in FIG. 42.

Figure 43:
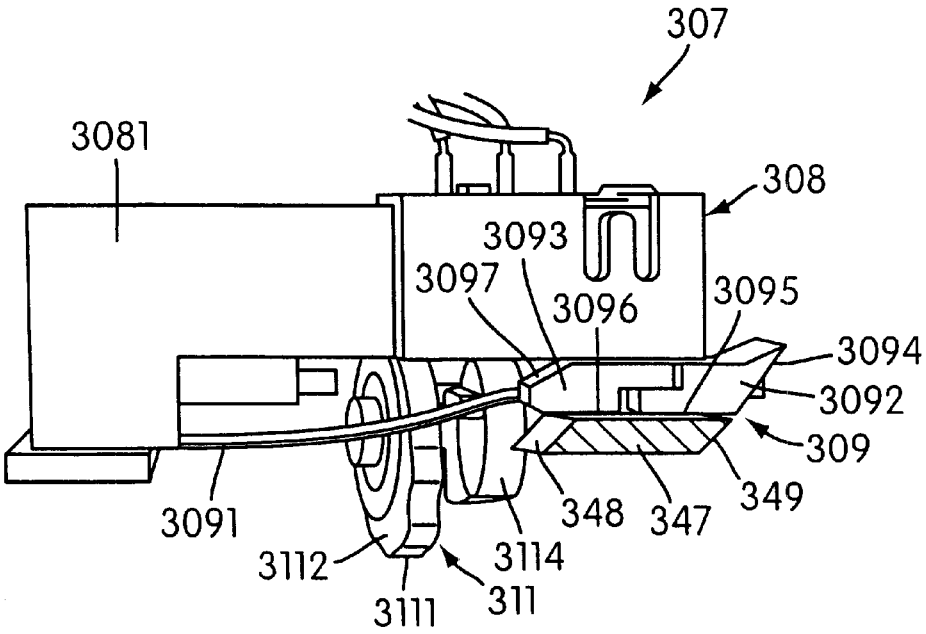

As the nose actuating assembly 347 continues to move relatively to the switch activating assembly 309, the nose actuating assembly 347 slides along side surfaces 3095 of the camming portion 3092 to side surfaces 3096 of the adjustable camming portion 3093. As long as the nose actuating assembly 347 is in contact with surfaces 3094, 3095, 3096 of the camming portions 3092, 3093, the switch activating assembly 309 will remain in contact with the switch assembly 308 to continue to energize the motor 374 which cycles the striker assembly 324 to drive the fastener 333 into the workpiece W, as shown in FIG. 43.

Specifically, once the motor 374 is energized, the motor 374 drives the crank member 356 via the gear train 370 which crank member 356 causes the reciprocating motion of the piston 352 via the crank arm 362. The piston 352 drives the driver assembly 330 via the sealed air space 310 between the piston 352 and the plunger 340. Thus, the reciprocating motion of the piston 352 causes the reciprocating motion of the driver member 332, which drives the fastener 333 into the workpiece W by a plurality of impacts upon the head of the fastener 333. As the fastener 333 is driven into the workpiece W, the angled surface 304 as well as the upper guide surface 305 adjust the orientation of the fastener 333 so the fastener 333 can be driven substantially perpendicular to the workpiece W, as shown in FIGS. 35–40.

Figure 23:
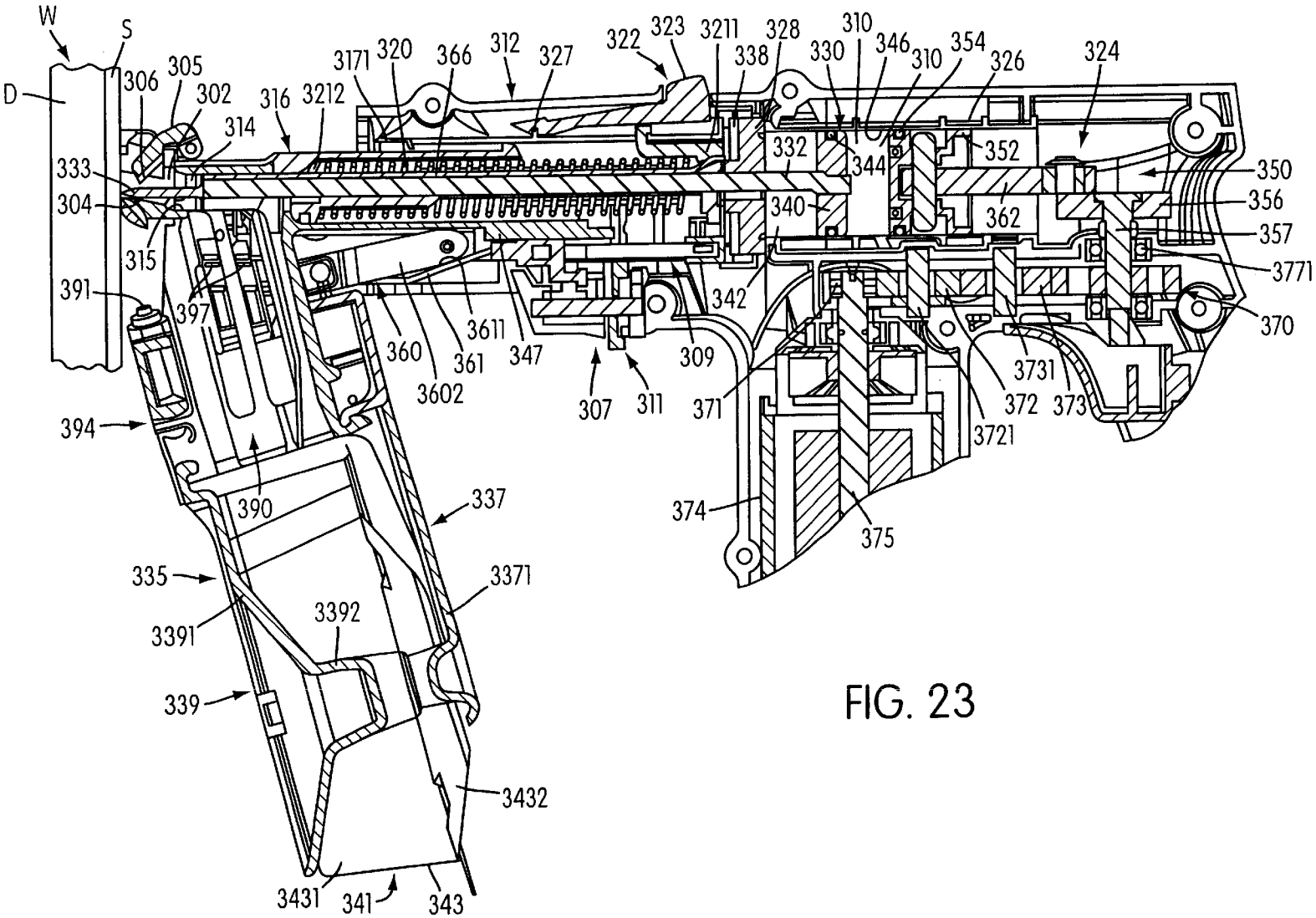

The retracting action of the nose assembly 316 also functions to operate the feed assembly 392 to advance the next fastener into the fastener drive track 314. The advancing assembly 360 cooperates with the gripping arms 397 to advance the fastener 333 into the fastener drive track 314. Specifically, the follower 3601 travels from a first position, as shown in FIGS. 16 and 19, to a second position, as shown in FIGS. 23 and 24, along the first surface 3611 within the housing 312 in response to compression of the nose assembly 316 against the biasing of the spring assembly 320. The gripping arm housing 3604 slides along the guide portions 3956 of the first housing part 395, thus moving the gripping arms 397 from a rest position, as shown in FIG. 48, to an advancing position, as shown in FIG. 50, as the follower 3601 travels along the first surface 3611 between the first position and the second position. As the gripping arm housing 3604 slides along the guide portions 3956, the fastener receiving portion 3971 retracts from the feed path 390, as shown in FIG. 49, against the biasing of a spring assembly when a portion 3972 of the gripping arms 397 contacts an additional fastener 333*b* following the fastener 333*a* that is held by the locking mechanism 398.

Figure 44:
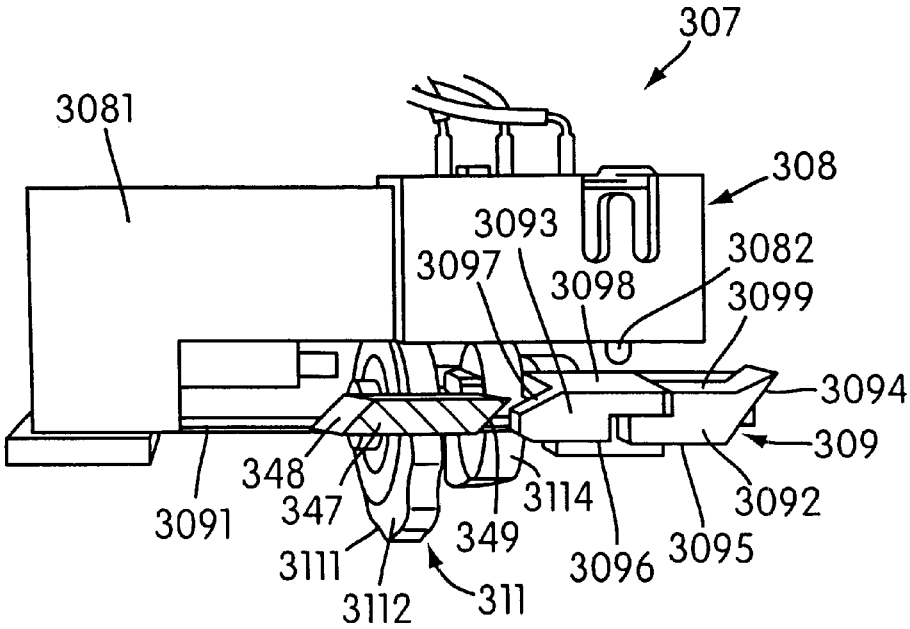
Figure 45:
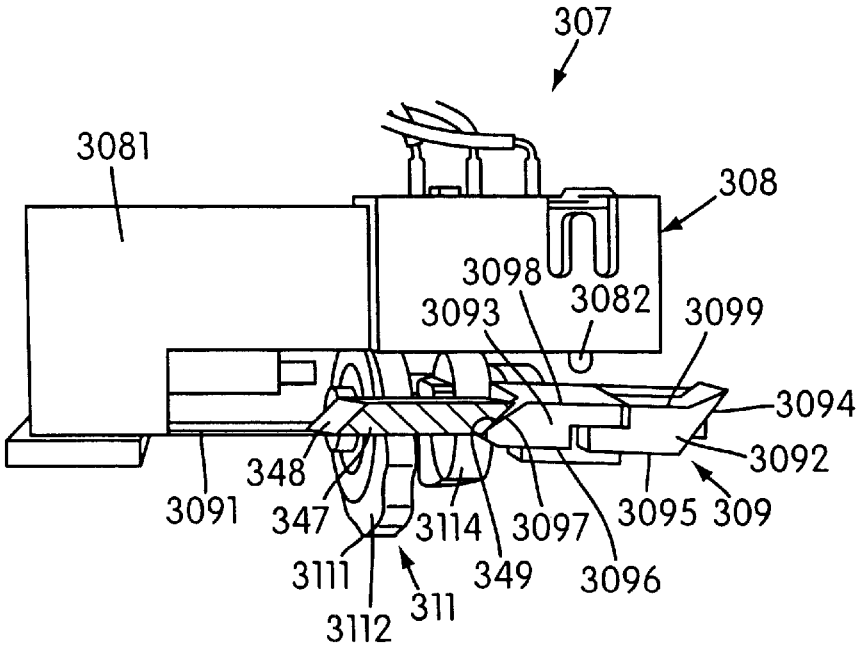
Figure 46:
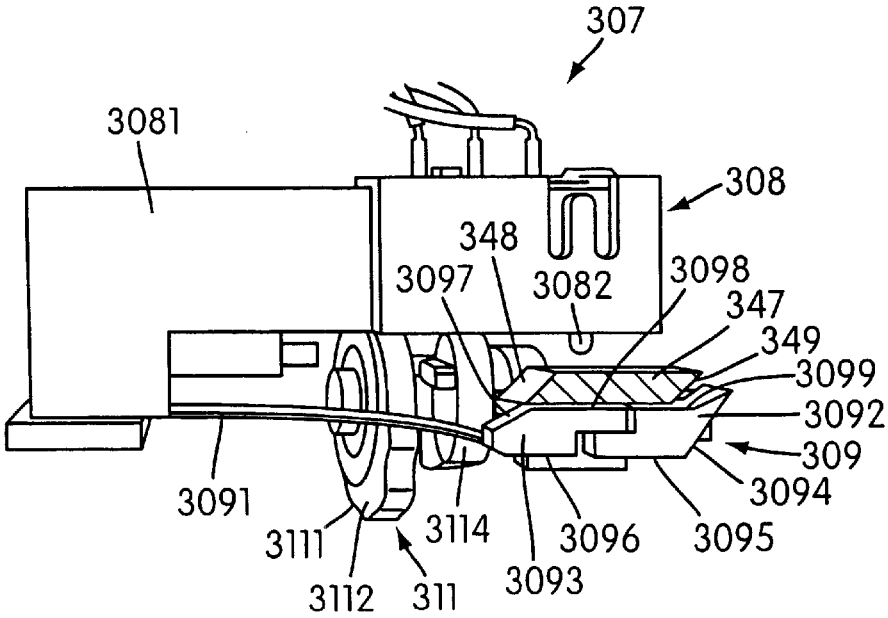

Once the nose actuating assembly 347 clears the adjustable camming portion 3093 of the switch activating assembly 309 and the switch activating assembly 309 is released from contact from the switch assembly 308, as shown in FIG. 44 resiliently returning to a rest position spaced from the switch assembly 308, the motor 374 shuts off. The switch assembly 308 must be reactivated in order to reactivate the motor 374 to cycle the striker assembly 324. In order to do this, the device 300 must be pulled away from the workpiece W so the nose assembly 316 can extend outwardly from the nose receiving channel 318 under biasing of the spring assembly 320 so that the nose assembly 316 can be depressed again. As the nose assembly 316 is forced outwardly of the nose receiving channel 318, the second ramping surface 349 of the nose actuating assembly 347 contacts a camming surface 3097 of the adjustable camming portion 3093 which cams the switch activating assembly 309 in a direction away from the activating button 3082 of the switch assembly 308 so that the switch assembly 308 does not become depressed and reactivate the striker assembly 324 before the device 300 is repositioned, as shown in FIGS. 45 and 46. The nose actuating assembly 347 slides along side surfaces 3098, 3099 of the camming portions 3093, 3092 opposite the side surfaces 3095, 3096 until the nose actuating assembly 347 clears the camming portion 3092, whereby the nose assembly 316 can be repositioned and depressed again by the operator.

The trigger 378 can remain depressed by the operator and movement of the nose assembly 316 between extended and retracted positions would be the means by which to shut off and restart the motor 374 between fastening operations. The energy control assembly 307 reduces power consumption by the fastening device by terminating operation of the driver assembly 330 at the predetermined operating conditions.

After a fastening operation, as the spring assembly 320 biases the nose assembly 316 out of the housing 312, the follower 3601 travels a predetermined distance along a second surface 3641 shown in FIGS. 19 and 20 within the housing 312 from the second position to a third position along the second surface 3641. The gripping arms 397 remain in the advancing position, as shown in FIG. 50, as the follower 3601 travels from the second position to the third position. As shown in FIG. 50, the fastener receiving portion 3971 is adapted to receive the additional fastener 333(*b*) which follows the fastener 333(*a*) held by the locking mechanism 398.

Specifically, the follower 3601 engages a pivoting arm 364 as the nose assembly 316 is being compressed. The pivoting arm 364 is spring biased into engagement with the track 361 and provides the second surface 3641 and a bottom surface 3642. The follower 3601 first engages the bottom surface 3642 of the pivoting arm 364 as it moves up the track 361 which pivots the arm 364 upwardly allowing the follower 3601 to move to the second position against the biasing of the spring positioned at the pivot axis. The pivoting arm 364 returns to its engagement with the track 361 due to the spring which allows the follower 3601 to ride along the second surface 3641 of the pivoting arm 364 to the third position as the nose assembly 316 is biased outwardly from the housing 312. This prevents the follower 3601 from returning along the track 361 to the first position.

Figure 51:
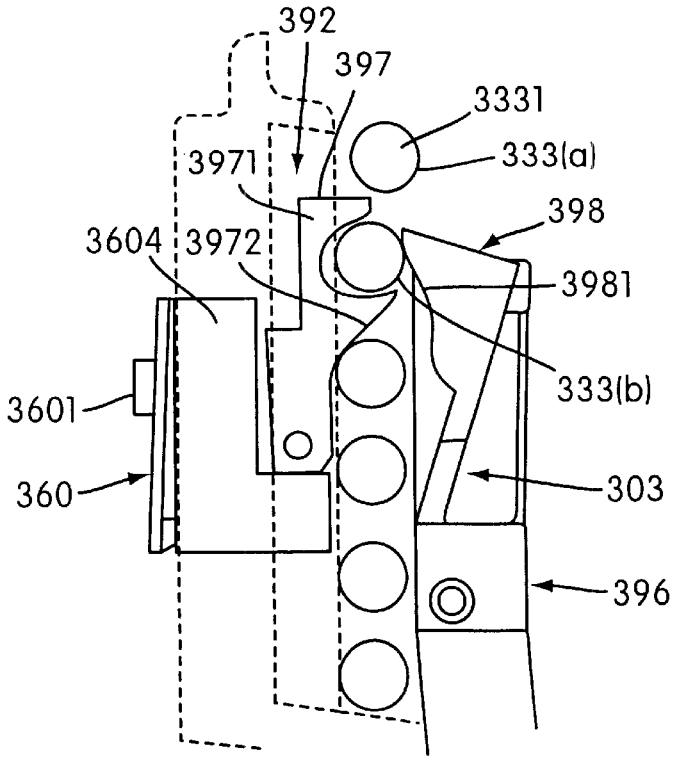
Figure 52:
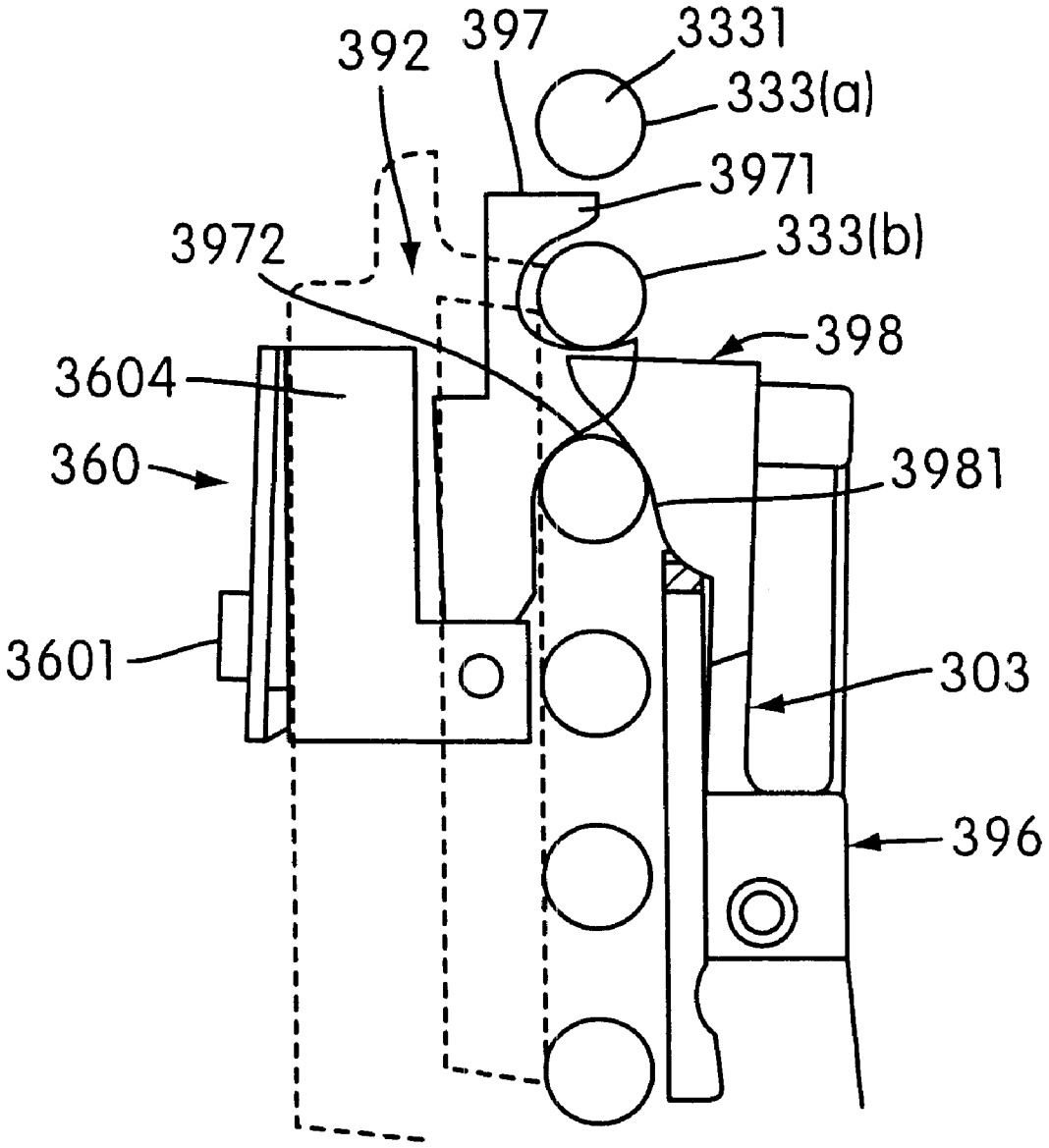

The gripping arms 397 return to the rest position when the advancing assembly 360 moves from the third position to the first position, due to the biasing of the spring on the feed pawl 3602 as it moves the follower 3601 from the third position to the first position through the recess 3643 in the pivoting arm 364 in a quick snapping action. This snapping action causes the gripping arms 397 of the feed mechanism 392 to quickly return to the position shown in FIG. 52. More specifically, a recess 3643 in the pivoting arm 364 allows the follower 3601 to return to the first position. Thus, the entire collation of fasteners 334 is moved upwardly as the fastener receiving portion 3971 engaged with the additional fastener 333(*b*) is moved upwardly. The additional fastener 333(*b*) contacts a surface 3981, as shown in FIG. 51 on the locking mechanism 398 to release the locking mechanism 398, whereby the gripping arms 397 advance the fastener 333(*a*) into the fastener drive track 314, whereupon the locking mechanism 398 engages the additional fastener 333(*b*) when the gripping arms 397 return to the rest position. Further, because the locking mechanism 398 forms a part of the pivoting assembly 303, the releasing of the locking mechanism 398 also pivots the portion of the angled surface 304 and the portion of bottom surface 315 away from the fastener drive track 314 to allow the fastener 333(*a*) to be loaded into the drive track 314. The device 300 is again in condition for a fastening operation.

It can thus be appreciated that the objectives of the present invention have been fully and effectively accomplished. The foregoing specific embodiments have been provided to illustrate the structural and functional principles of the present invention and is not intended to be limiting. To the contrary, the present invention is intended to encompass all modifications, alterations, and substitutions within the spirit and scope of the appended claims and their equivalents.

What is claimed is:

1. A fastening device for driving a fastener within a coil of collated fasteners into a workpiece, comprising:

a housing;

a striker assembly movably mounted within said housing, said striker assembly including a driver assembly for providing a plurality of drive strokes for driving the fastener to be driven into the workpiece;

a nose assembly operatively connected to said housing, said nose assembly having a fastener drive channel along which said driver assembly and the fastener travel when the fastener is driven into the workpiece; and a magazine assembly constructed and arranged to engage at least one fastener within said coil of fasteners in order to move a lead fastener within said coil of fasteners in a first direction toward said fastener drive channel, said lead fastener having a forward pointed tip thereof tending to be moved in a second direction opposite said first direction in response to a rearward head end thereof being impacted by said driver assembly due to the interconnection of the collation material between said lead fastener and a subsequent fastener;

said nose assembly including an angled guide surface constructed and arranged to engage the tip and head of said lead fastener as said fastener is driven, said guide surface being angled so as to direct said tip and said head of said lead fastener toward said first direction as said lead fastener is driven.

2. The fastening device according to claim 1, wherein said nose assembly further comprises a pivoted guide structure defining a pivoted guide surface disposed in opposing relation to said angled surface, said pivoted guide structure being biased towards a first position wherein said pivoted structure is disposed adjacent to said angled guide surface so that said pivoted guide surface and said angled guide surface form a fastener outlet which is dimensioned to be smaller than a head of said fastener, and wherein the head of a fastener engages said pivoted guide surface as the fastener is being driven so as to force the pivoted guide structure away from said angled guide surface against said spring bias to enable said outlet to be sufficiently sized to permit said fastener head to pass therethrough, said angled guide surface and said pivoted guide surface guidably engaging said head as said head passes thereby.

3. The fastening device according to 2, wherein said pivoted guide surface engages said fastener tip in the event said tip is deflected sufficiently by said angled guide surface.

4. The fastening device according to claim 1, wherein said angled surface forms a bottom surface of said fastener drive channel.

5. The fastening device according to claim 4, wherein said angled surface is located on a pivoting assembly, wherein said angled surface pivots away from said fastener drive channel at predetermined operating conditions of said fastening device.

6. The fastening device according to claim 5, wherein said angled surface pivots away from said fastener drive channel while the fastener is loaded into said fastener drive channel.

7. The fastening device according to claim 6, wherein said angled surface pivots away from said fastener drive channel while said magazine assembly loads the fastener into said fastener drive channel.

8. The fastening device according to claim 7, wherein said angled surface pivots away from said fastener drive channel in response to movement of at least one fastener within said magazine assembly.

9. The fastening device according to claim 1, wherein said fastener drive channel terminates at an aperture having a generally elliptical shape.

10. The fastening device according to claim 9, wherein said fastener drive channel has generally tapered interior surfaces adjacent said aperture.

11. The fastening device according to claim 1, wherein said fastener drive channel includes an axis, wherein the angled guide surface is positioned on a side of the axis that includes the magazine assembly.

12. The fastening device according to claim 1, wherein the angled guide surface is positioned within the fastener drive channel.

13. The fastening device according to claim 1, wherein the angled guide surface is adapted to engage the head of the lead fastener as the fastener is driven so as to direct the head of the lead fastener along with the tip of the lead fastener toward said first direction as said lead fastener is driven.

14. The fastener device according to claim 1, wherein the lead fastener includes a shank having a shank axis, the shank axis is positioned within the fastener drive channel prior to impact by the driver assembly such that a driver assembly axis of the driver assembly is positioned on one side of the shank axis and the angled guide surface is positioned on an opposite side of the shank axis.

15. The fastener device according to claim 14, wherein the shank axis moves as the fastener is driven by the driver assembly such that the shank axis moves from one side of the driver assembly axis to an opposite of the driver assembly axis.

16. A fastening device for driving a fastener within a group of collated fasteners into a workpiece, comprising:

a housing;

a striker assembly movably mounted within said housing, said striker assembly including a driver assembly for striking the fastener to be driven into the workpiece;

a nose assembly operatively connected to said housing, said nose assembly having a fastener drive channel along which said driver assembly and the fastener travel when the fastener is driven into the workpiece; and a magazine assembly constructed and arranged to engage at least one fastener within said group of fasteners in order to move a lead fastener within said coil of fasteners in a first direction toward said fastener drive channel, said lead fastener having a forward pointed end thereof tending to be moved in a second direction opposite said first direction in response to a rearward head end thereof being impacted by said driver assembly due to the interconnection of the collation material between said lead fastener and a subsequent fastener;

said nose assembly including an angled guide surface that engages the tip of said lead fastener as it is being driven, said guide surface being angled so as to direct said tip of said lead fastener toward said first direction as said lead fastener is being driven, wherein the angled guide surface engages a head of the lead fastener as it is being driven so as to direct the head of the lead fastener along with the tip of the lead fastener toward said first direction as said lead fastener is being driven.

17. A fastening device for driving a fastener within a group of collated fasteners into a workpiece, comprising:

a housing;

a striker assembly movably mounted within said housing, said striker assembly including a driver assembly for striking the fastener to be driven into the workpiece;

a nose assembly operatively connected to said housing, said nose assembly having a fastener drive channel along which said driver assembly and the fastener travel when the fastener is driven into the workpiece; and a magazine assembly constructed and arranged to engage at least one fastener within said group of fasteners in order to move a lead fastener within said group of fasteners in a first direction toward said fastener drive channel, said lead fastener having a forward pointed end thereof tending to be moved in a second direction opposite said first direction in response to a rearward head end thereof being impacted by said driver assembly due to the interconnection of the collation material between said lead fastener and a subsequent fastener;

said nose assembly including an angled guide surface for engaging the tip of said lead fastener as it is being driven, said guide surface being angled so as to direct said tip and said head of said lead fastener toward said first direction as said lead fastener is being driven, wherein the lead fastener includes a shank having a shank axis, the shank axis is positioned within the fastener drive channel prior to impact by the driver assembly such that a driver assembly axis of the driver assembly is positioned on one side of the shank axis and the angled guide surface is positioned on an opposite side of the shank axis.

18. The fastener device according to claim 17, wherein the shank axis moves as the fastener is driven by the driver assembly such that the shank axis moves from one side of the driver assembly axis to an opposite of the driver assembly axis.

19. A multi-stroke fastening device for driving a fastener within a coil of collated fasteners into a workpiece, comprising:

a housing;

a striker assembly movably mounted within said housing, said striker assembly including a driver assembly for providing a plurality of drive strokes for driving the fastener into the workpiece;

a nose assembly operatively connected to said housing, said nose assembly having a fastener drive channel along which said driver assembly and the fastener travel when the fastener is driven into the workpiece; and a magazine assembly constructed and arranged to engage at least one fastener within said coil of fasteners in order to move a lead fastener within said coil of fasteners in a first direction toward said fastener drive channel, said lead fastener having a forward pointed end thereof tending to be moved in a second direction opposite said first direction in response to a rearward head end thereof being impacted by said driver assembly due to the interconnection of the collation material between said lead fastener and a subsequent fastener;

said nose assembly including an angled guide surface for engaging the tip of said lead fastener as it is being driven, said guide surface being angled so as to direct said tip and said head of said lead fastener toward said first direction as said lead fastener is being driven, wherein the lead fastener includes a shank having a shank axis, the shank axis moving from one side of an axis of the driver assembly to an other side of the axis of the driver assembly as the lead fastener is being driven into the workpiece.

* * * * *

UNITED STATES PATENT AND TRADEMARK OFFICE

CERTIFICATE OF CORRECTION

PATENT NO. : 6,499,643 B1
DATED : December 31, 2002
INVENTOR(S) : Hewitt

It is certified that error appears in the above-identified patent and that said Letters Patent is hereby corrected as shown below:

Title page,
Item [73], please amend the name of the Assignee to read as follows:
-- [73] Assignee: Stanley Fastening Systems, L.P., East Greenwich, RI (US) --

Signed and Sealed this

Twenty-ninth Day of July, 2003

JAMES E. ROGAN
*Director of the United States Patent and Trademark Office*